US007372443B2

(12) United States Patent
Hosaka et al.

(10) Patent No.: US 7,372,443 B2
(45) Date of Patent: May 13, 2008

(54) DISPLAY-DEVICE DRIVE CIRCUIT AND DRIVE METHOD, DISPLAY DEVICE, AND PROJECTION DISPLAY DEVICE

(75) Inventors: Hiroyuki Hosaka, Suwa (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 710 days.

(21) Appl. No.: 10/779,783

(22) Filed: Feb. 18, 2004

(65) Prior Publication Data

US 2004/0169632 A1 Sep. 2, 2004

(30) Foreign Application Priority Data

Feb. 18, 2003 (JP) ..... 2003-039863

(51) Int. Cl.
*G09G 3/36* (2006.01)

(52) U.S. Cl. ..... 345/98; 345/87; 345/89; 345/690

(58) Field of Classification Search ..... 345/76–100, 345/204–215, 690
See application file for complete search history.

(56) References Cited

U.S. PATENT DOCUMENTS

| | | | | |
|---|---|---|---|---|
| 6,873,312 | B2 * | 3/2005 | Matsueda | 345/98 |
| 2002/0145602 | A1 * | 10/2002 | Matsueda | 345/213 |
| 2002/0149556 | A1 * | 10/2002 | Matsueda | 345/98 |

FOREIGN PATENT DOCUMENTS

| | | |
|---|---|---|
| JP | A-06-222328 | 8/1994 |
| JP | A 7-230075 | 8/1995 |

* cited by examiner

*Primary Examiner*—Vijay Shankar
(74) *Attorney, Agent, or Firm*—Oliff & Berridge, PLC

(57) ABSTRACT

To provide a drive circuit, a drive method, a display device, and a projection display device capable of increasing contrast of an image a mean gray level (first gray level characterizing brightness) Gf is detected from an image signal DATA per unit time. On the basis of the mean gray level Gf, a variation signal ΔS is set. By supplying the variation signal ΔS to an opposing electrode, the image signal DATA applied to a liquid crystal layer is modulated. In accordance with an increase in the mean gray level Gf, the gray level of an effective signal applied to the liquid crystal layer (image signal modulated using the variation signal ΔS) is set to be greater than the gray level of the unmodulated image signal.

13 Claims, 54 Drawing Sheets

DISPLAY-DEVICE DRIVE CIRCUIT AND DRIVE METHOD, DISPLAY DEVICE, AND PROJECTION DISPLAY DEVICE

BACKGROUND OF THE INVENTION

1. Field of Invention

The present invention relates to a display-device drive circuit and drive method and to a display device and a projection display device including such a drive circuit.

2. Description of Related Art

In the field of display devices, there has been an increasing demand for larger display devices with higher definition. Projection display devices, such as liquid crystal display (LCD) projectors and DMDs have been used in the related art to implement such large screen displays. There is a demand for such projection display devices to display realistic images with high display contrast.

For example, a related art LCD is known as a projection display device displaying such a high-contrast image. This LCD projector uses a polymer dispersed liquid crystal (PDLC) device, which is highly efficient in terms of light utilization, as a light modulator. By driving both the potential of each pixel electrode and the potential of an opposing electrode in the PDLC, a drive voltage is increased to display a high-contrast image.

SUMMARY OF THE INVENTION

The above-described method compensates for the low driving efficiency of a source driver by driving the opposing electrode, thereby applying a sufficient drive voltage to the PDLC. The method is not designed to increase the contrast of an image in accordance with an image signal by, for example, making a bright image brighter or a darker image darker.

In view of the foregoing problems, the present invention provides a displaydevice drive circuit and drive method, a display device, and a projection display device capable of adjusting the brightness of an image in accordance with an image signal, thereby increasing contrast.

To achieve the foregoing, a drive circuit of an aspect of the present invention is a drive circuit for driving a display device including an active matrix substrate provided with a plurality of pixel electrodes arranged in a matrix, an opposing substrate provided with a transparent opposing electrode, and a liquid crystal layer held between the active matrix substrate and the opposing substrate. The drive circuit includes a first signal supplying unit that supplies an image signal to the pixel electrodes; a first detector that detects, on the basis of the image signal per unit time, a first gray level characterizing the brightness of an image; a variation-signal setting unit that sets a variation signal on the basis of the first gray level; and a second signal supplying unit that supplies the variation signal to the opposing electrode. The liquid crystal layer is driven by an effective voltage signal generated by modulating the image signal using the variation signal. The variation-signal setting unit sets the variation signal so that the gray level of the effective voltage signal becomes greater than the gray level of the image signal in accordance with an increase in the first gray level.

In other words, the present drive circuit drives the display device by a drive method including detecting a first gray level characterizing the brightness of an image on the basis of an image signal per unit time; setting, on the basis of a setting table defining the relationship between the first gray level and a variation signal, the variation signal based on the first gray level; and supplying the image signal and the variation signal to the pixel electrodes and the opposing electrode, respectively, thereby applying an effective voltage signal to the liquid crystal layer, the effective voltage signal being generated by modulating the image signal using the variation signal. The setting table defines the variation signal so that the gray level of the effective voltage signal becomes greater than the gray level of the image signal in accordance with an increase in the first gray level.

According to the present structure, a bright image is displayed more brightly. As a result, the brightness of an image displayed per unit time (e.g., one frame or plural frames) is adjusted, thereby displaying images differing in contrast among frames.

The first gray level may be, for example, the mean gray level or the maximum gray level of an image signal per unit time or the mode of gray levels. When the mean gray level serves as the first gray level, image signals to be processed may be limited to those within a specific gray level range. For example, the mean gray level may be computed from each signal excluding those with a gray level in a specific range (e.g., 10%) from the maximum gray level of an image signal. When such a detection method is adopted, in particular, the appropriate brightness for an image displaying subtitles may be detected. In other words, to enhance visibility, the gray level of a subtitle portion is generally set to a gray level near the maximum displayable gray level. By excluding a peak signal near the maximum gray level from computation, the effect of a subtitle portion that is not very meaningful to image information may be reduced or eliminated. Needless to say, the mean may be computed from each signal excluding those with a gray level in a predetermined range from the minimum gray level (0-th gray level).

The unit time serving as the reference for detecting the first gray level may be an arbitrary period, such as one frame or plural frames.

The drive circuit may further include a second detector that detects a second gray level. The variation-signal setting unit may compute the difference between the first gray level and the second gray level and may set the variation signal so that, when the first gray level is greater than the second gray level, the gray level of the effective voltage signal becomes greater than the gray level of the image signal, and, when the first gray level is less than the second gray level, the gray level of the effective voltage signal becomes less than the gray level of the image signal.

According to the present structure, a bright image is displayed more brightly, whereas a dark image is displayed more darkly. Therefore, the brightness contrast is increased.

The second gray level may be, for example, the mean gray level or the maximum gray level of an image signal per unit time or the mode of gray levels. Also, the second gray level may be a fixed value (median of the maximum displayable gray levels).

Although the level of the variation signal may be defined differently (i.e., asymmetrically) depending on the gray level difference being positive or negative, the level of the variation signal in these cases may be symmetrical.

The opposing electrode may include a plurality of block electrodes, and the variation signal may be set for each of the block electrodes. For example, the second detector detects, as the second gray level, a gray level characterizing the brightness of an image on the entirety of a display area on the basis of the image signal per unit time. The first detector detects, on the basis of the image signal supplied to the pixel electrodes in an area opposing each of the block electrodes per unit time, the first gray level in that area. The variation-signal setting unit sets the variation signal for each of the block electrodes on the basis of the gray level difference between the first gray level and the second gray level detected for each of the block electrodes. The second signal supplying unit may supply the variation signal to the corresponding block electrode.

The present drive circuit drives the display device by a drive method including detecting a second gray level characterizing the brightness of an image on the entirety of a display area on the basis of an image signal per unit time; detecting a first gray level characterizing the brightness of the image on the basis of the image signal supplied to the pixel electrodes in an area opposing each of the block electrodes per unit time; computing the gray level difference between the first gray level and the second gray level; setting, on the basis of a setting table defining the relationship between the gray level difference and a variation signal, the variation signal for each of the block electrodes based on the gray level difference; and supplying the image signal and the variation signal to the pixel electrodes and the opposing electrode, respectively, thereby applying an effective voltage signal to the liquid crystal layer, the effective voltage signal being generated by modulating the image signal using the variation signal. The setting table defines the variation signal so that the gray level of the effective voltage signal becomes greater than the gray level of the image signal in accordance with an increase in the gray level difference.

With the present structure, the brightness of an image is adjusted in each display area (block area) associated with each of the block electrodes. Therefore, the contrast of a portion (i.e., each block area) of an image can be adjusted.

With the present structure, the block electrodes are scanned in accordance with the driving of the pixel electrodes. Therefore, time lag in adjustment of the brightness in each block area is reduced or prevented.

If a common variation signal is supplied to all block electrodes in accordance with the writing to the pixel electrodes in an upper portion of the display area, the brightness adjustment based on an image signal of the subsequent image is performed on a lower portion of the display area, which should be subjected to brightness adjustment based on an image signal of the previous image. With the present structure, individually-adjusted variation signals are sequentially supplied to the corresponding block electrode in accordance with the writing of the image signal, thereby reducing or preventing such an adjustment lag. As a result, images are displayed more naturally.

The number of block electrodes is not limited to a particular number. For example, the block electrodes may be provided in association with the individual pixel electrodes arranged in a matrix.

The block electrodes may be arranged in stripes associated with the lines of pixel electrodes arranged in a matrix. Alternatively, a single stripe-shaped block electrode (stripe electrode) may oppose the plural lines of pixel electrodes. In this case, it is preferable that the stripe electrode be disposed along scanning lines on the active matrix substrate.

The second gray level may be, as in the first gray level, for example, the mean gray level or the maximum gray level of an image signal per unit time or the mode of gray levels. The first gray level and the second gray level may be detected on the basis of different references. For example, the first gray level may be the mean gray level of an image signal, whereas the second gray level may be the mode of gray levels.

A drive circuit of an aspect of the present invention is a drive circuit for driving a display device including an active matrix substrate provided with a plurality of pixel electrodes arranged in a matrix and hold capacitors associated with the individual pixel electrodes, an opposing substrate provided with a transparent opposing electrode, and a liquid crystal layer held between the active matrix substrate and the opposing substrate. The drive circuit includes a first signal supplying unit that supplies an image signal to the pixel electrodes; a first detector that detects, on the basis of the image signal per unit time, a first gray level characterizing the brightness of an image; a variation-signal setting unit that sets a variation signal on the basis of the first gray level; and a second signal supplying unit that supplies the variation signal to the hold capacitors. The liquid crystal layer is driven by an effective voltage signal generated by modulating the image signal using the variation signal. The variation-signal setting unit sets the variation signal so that the gray level of the effective voltage signal becomes greater than the gray level of the image signal in accordance with an increase in the first gray level.

The present drive circuit drives the display device by a drive method including detecting a first gray level characterizing the brightness of an image on the basis of an image signal per unit time; setting, on the basis of a setting table defining the relationship between the first gray level and a variation signal, the variation signal based on the first gray level; and supplying the image signal and the variation signal to the pixel electrodes and the hold capacitors, respectively, thereby applying an effective voltage signal to the liquid crystal layer, the effective voltage signal being generated by modulating the image signal using the variation signal. The setting table defines the variation signal so that the gray level of the effective voltage signal becomes greater than the gray level of the image signal.

With the present structure, a bright image is displayed more brightly, and a high-contrast image is displayed.

With the present structure, since the pixel electrodes and the hold capacitors are both disposed on the active matrix substrate, both the first and second signal supplying units supplying signals to the pixel electrodes and the hold capacitors, respectively, are disposed on the active matrix substrate. In other words, with the foregoing structure in which the variation signal is supplied to the opposing electrode, the second signal supplying unit supplying the variation signal to the opposing electrode must be disposed on the opposing substrate. Because the active matrix substrate and the opposing substrate are both provided with drive circuits (first and second signal supplying units), the manufacturing cost may be increased. According to the present structure, the drive circuits may be disposed collectively on the active matrix substrate. Thus, the present structure is advantageous in terms of cost.

The drive circuit may further include a second detector that detects a second gray level. The variation-signal setting unit may compute the difference between the first gray level and the second gray level and may set the variation signal so that, when the first gray level is greater than the second gray level, the gray level of the effective voltage signal becomes greater than the gray level of the image signal, and, when the first gray level is less than the second gray level, the gray level of the effective voltage signal becomes less than the gray level of the image signal.

According to the present structure, a bright image is displayed more brightly, whereas a dark image is displayed more darkly. The brightness contrast is thus increased.

A display area may include a plurality of block areas, and the variation signal may be set for each of the block areas. For example, the second detector detects, on the basis of the image signal per unit time, the second gray level characterizing the brightness of an image on the entirety of the display area. The first detector detects, on the basis of the image signal supplied to the pixel electrodes belonging to each of the block areas per unit time, the first gray level characterizing the brightness of the image in that block area. The variation signal setting unit sets the variation signal for each of the block areas on the basis of the gray level difference between the first gray level and the second gray level detected for each of the block areas. The second signal supplying unit may supply the variation signal to the hold capacitors belonging to the corresponding block area.

The present drive circuit drives the display device by a drive method including detecting a second gray level characterizing the brightness of an image on the entirety of a display area on the basis of an image signal per unit time; detecting a first gray level characterizing the brightness of the image in each of the block areas on the basis of the image signal supplied to the pixel electrodes belonging to that block area per unit time; computing the gray level difference between the first gray level and the second gray level; setting, on the basis of a setting table defining the relationship between the gray level difference and a variation signal, the variation signal for each of the block areas based on the gray level difference; and supplying the image signal and the variation signal to the pixel electrodes and the hold capacitors, respectively, thereby applying an effective voltage signal to the liquid crystal layer, the effective voltage signal being generated by modulating the image signal using the variation signal. The setting table defines the variation signal so that the gray level of the effective voltage signal becomes greater than the gray level of the image signal in accordance with an increase in the gray level difference.

According to the present structure, the brightness of an image is adjusted in each block area. Therefore, the contrast of a portion of an image can be adjusted.

The number of segments of the display area (i.e., the number of block areas) is not limited to a particular number. For example, the block areas may be provided in association with the individual pixel electrodes. Alternatively, the block areas may be stripe areas. These stripe areas may be provided in association with, for example, the lines of pixel electrodes arranged in a matrix. Alternatively, a single stripe area may be provided in association with the plural lines of pixel electrodes. In this case, it is preferable that the stripe areas be disposed along scanning lines on the active matrix substrate. When the display area includes a plurality of stripe areas and when individually-adjusted variation signals are sequentially supplied to the corresponding stripe area in accordance with the writing of the image signal to the pixel electrodes, time lag in brightness adjustment in each stripe area is reduced or prevented, thereby displaying images more naturally.

A display device or projection display device of an aspect of the present invention is characterized in that a liquid crystal layer held between the foregoing active matrix substrate and the opposing substrate is driven by a voltage signal supplied from the foregoing drive circuit.

According to the display device or projection display device with the present structure, a high-contrast image can be displayed.

DETAILED DESCRIPTION OF EXEMPLARY EMBODIMENTS

First Exemplary Embodiment

Figure 1:
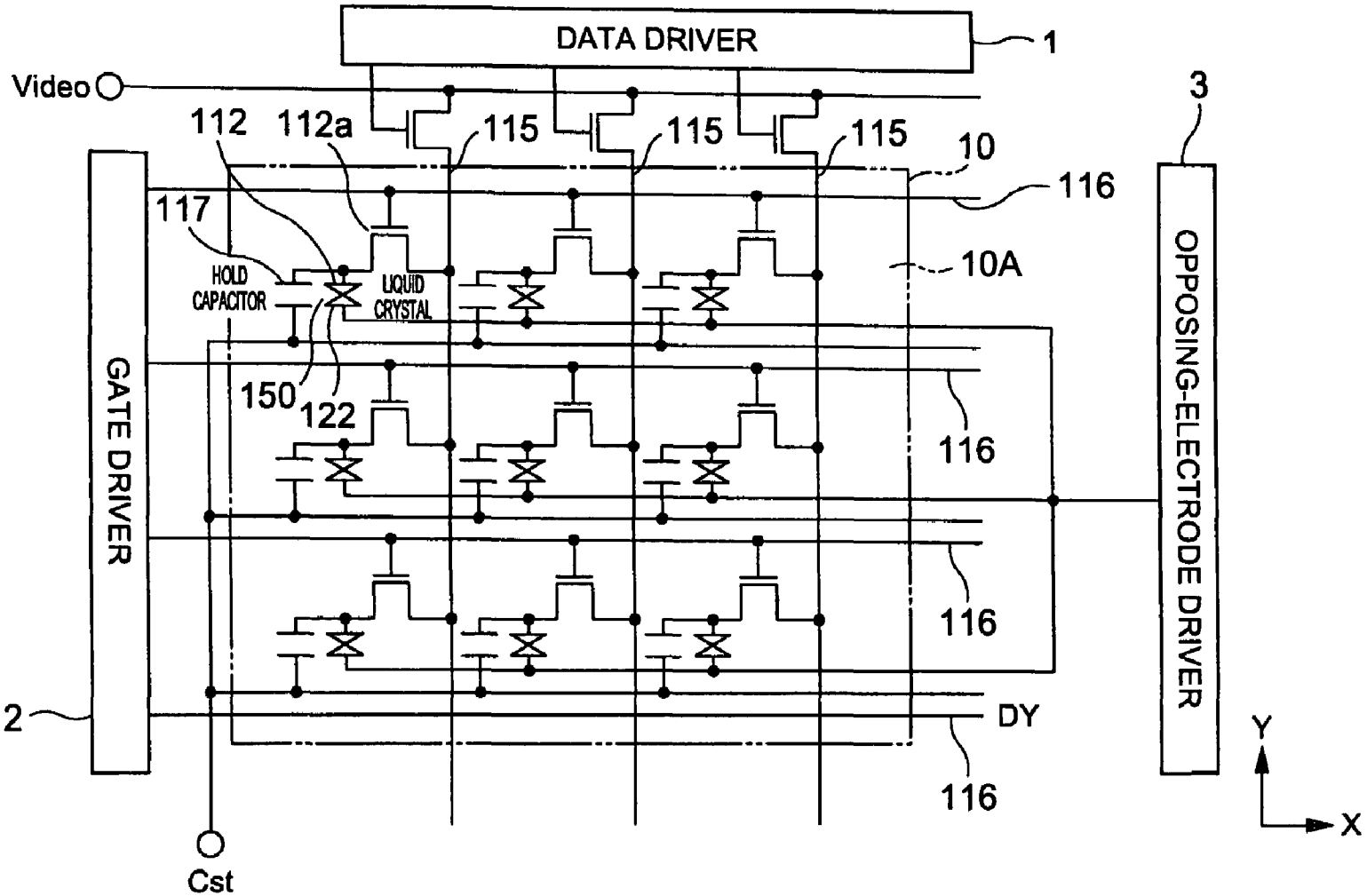
FIG. 1 is a circuit schematic of a display device according to a first exemplary embodiment of the present invention.
Figure 2:
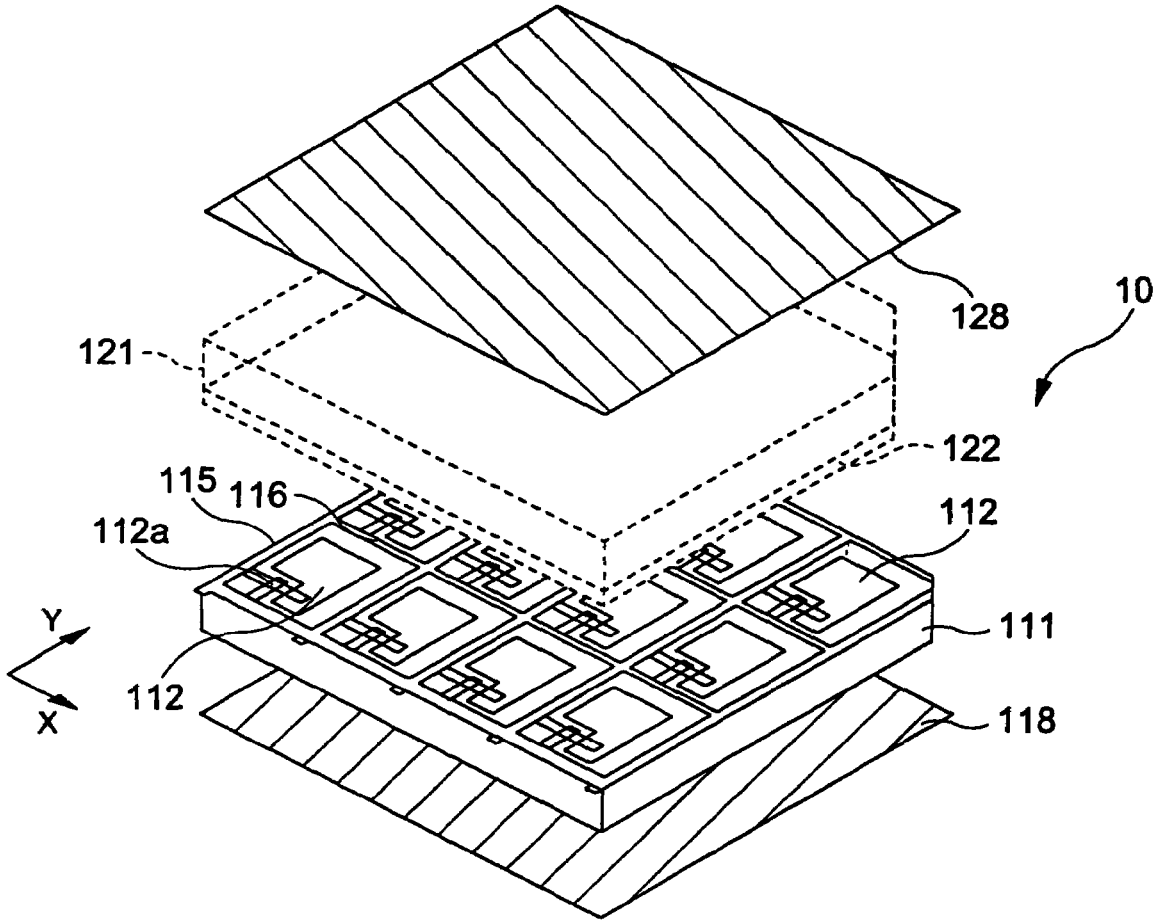
FIG. 2 is a perspective view of the schematic structure of the display device according to the first exemplary embodiment.
Figure 3:
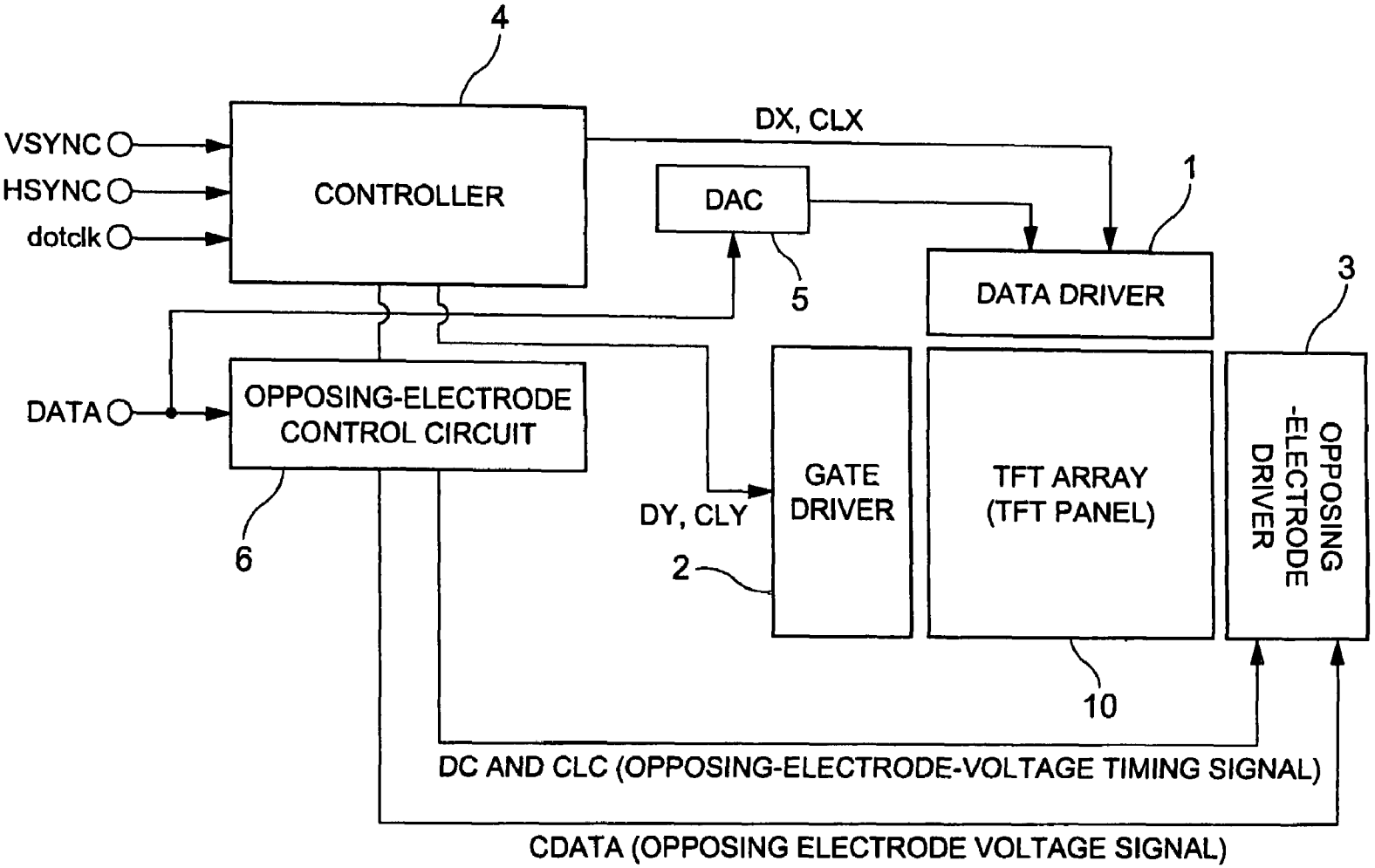
FIG. 3 is a block schematic of the circuit configuration of the display device according to the first exemplary embodiment.
Figure 4:
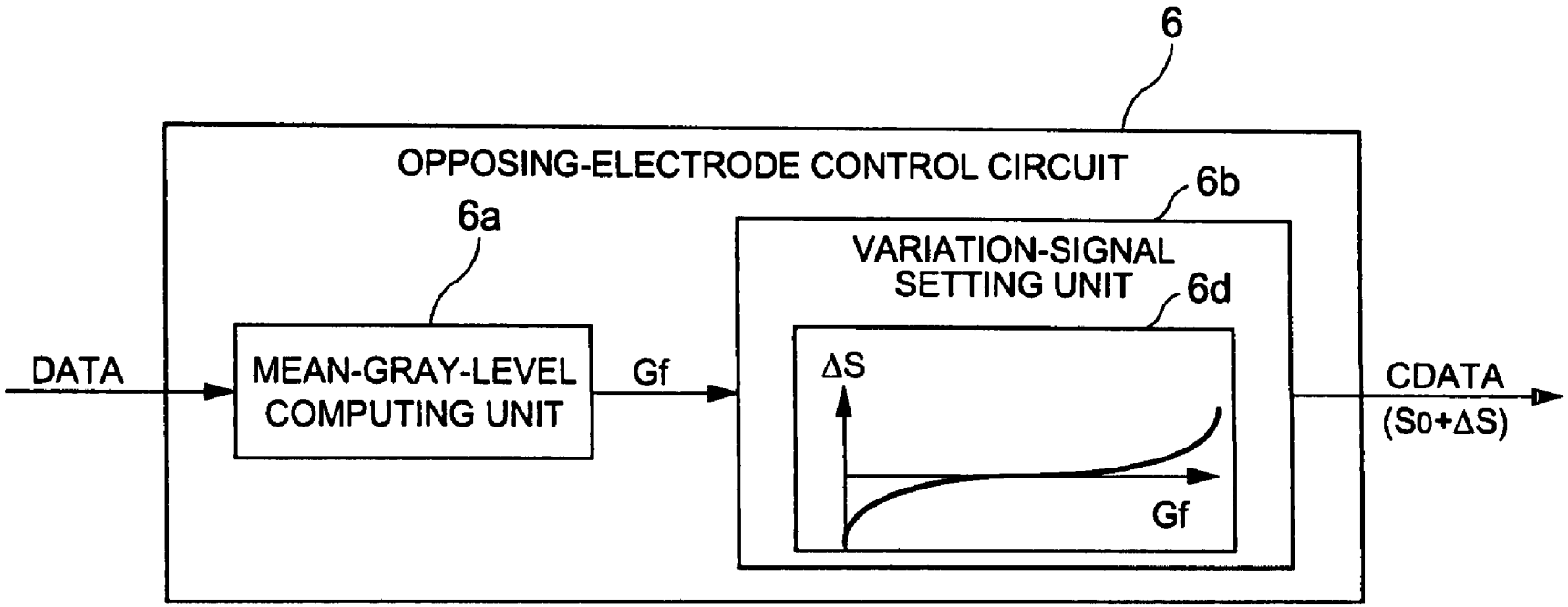
FIG. 4 is a block schematic of the main structure of a drive circuit according to the first exemplary embodiment.
Figure 5:
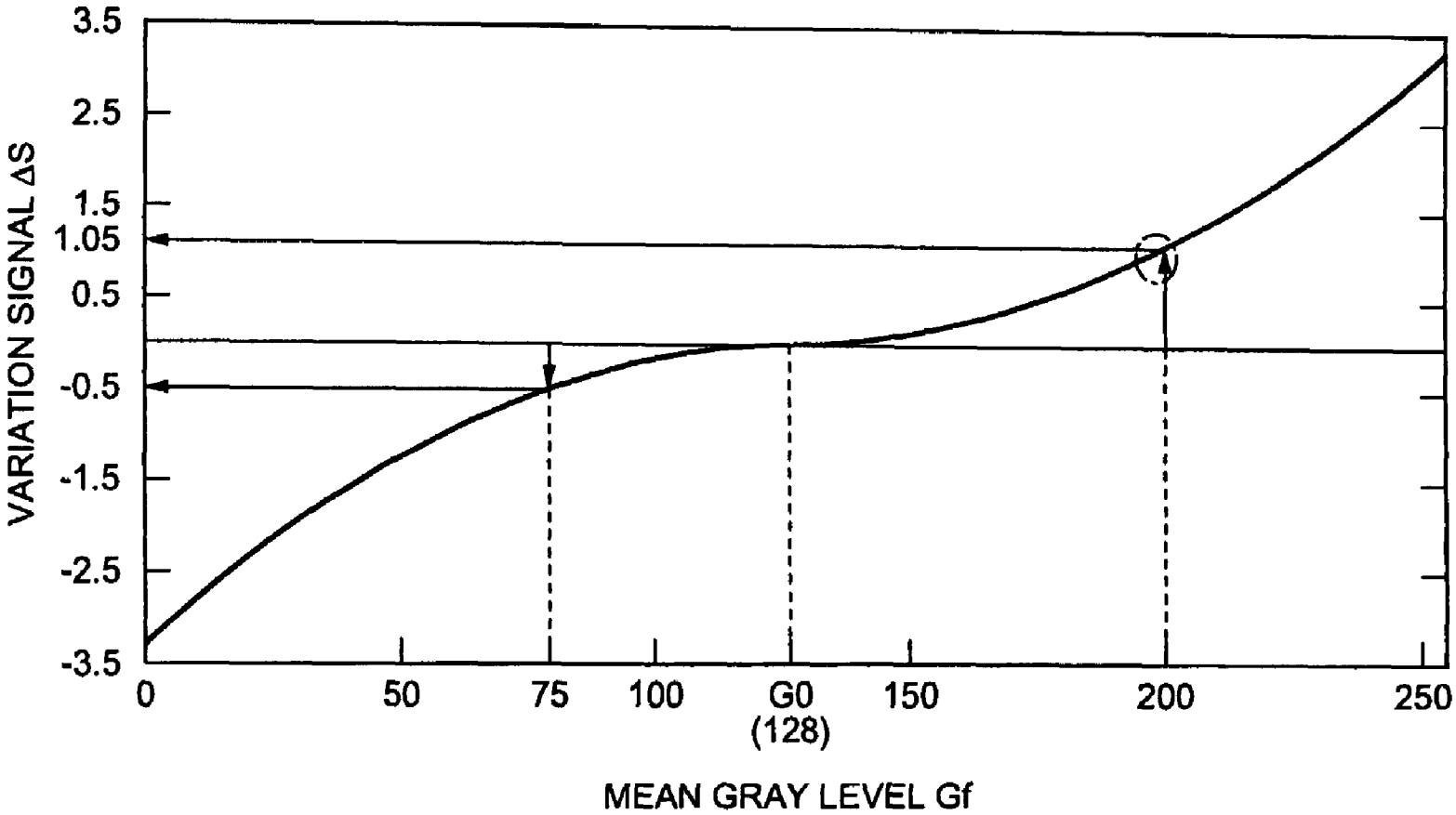
FIG. 5 is a graph describing a drive method according to the first exemplary embodiment.
Figure 6A:
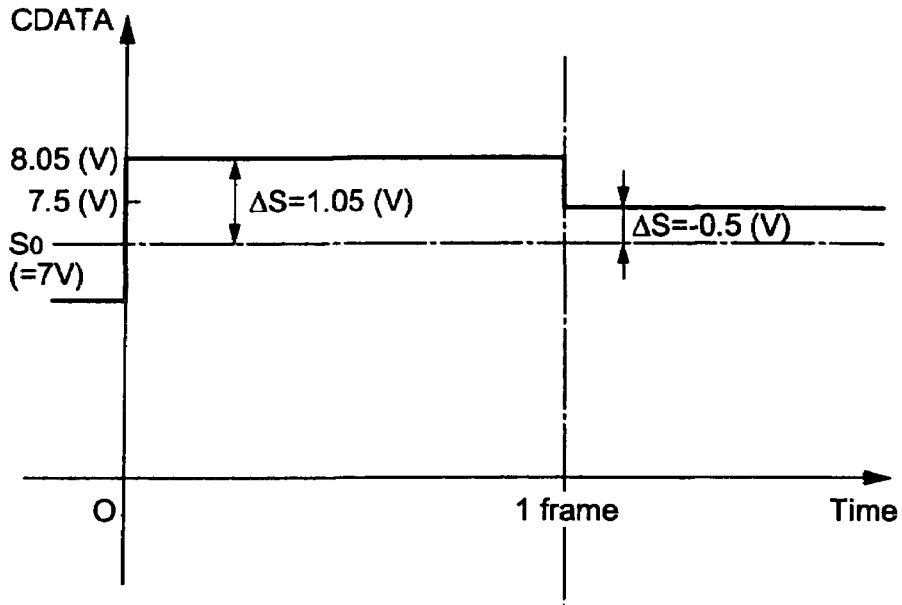
FIGS. 6(A) and 6(B) include schematics describing the drive method according to the first exemplary embodiment.
Figure 6B:
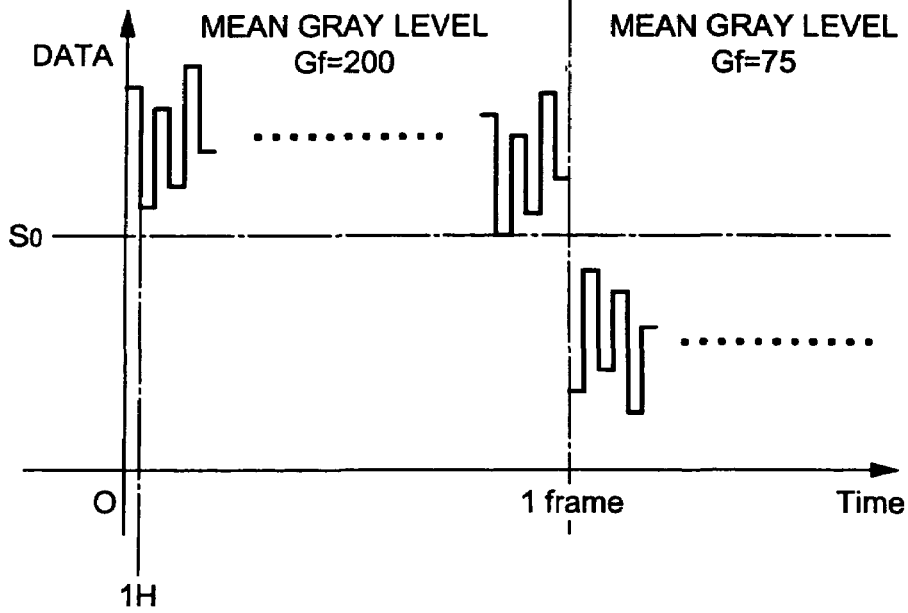
Figure 7:
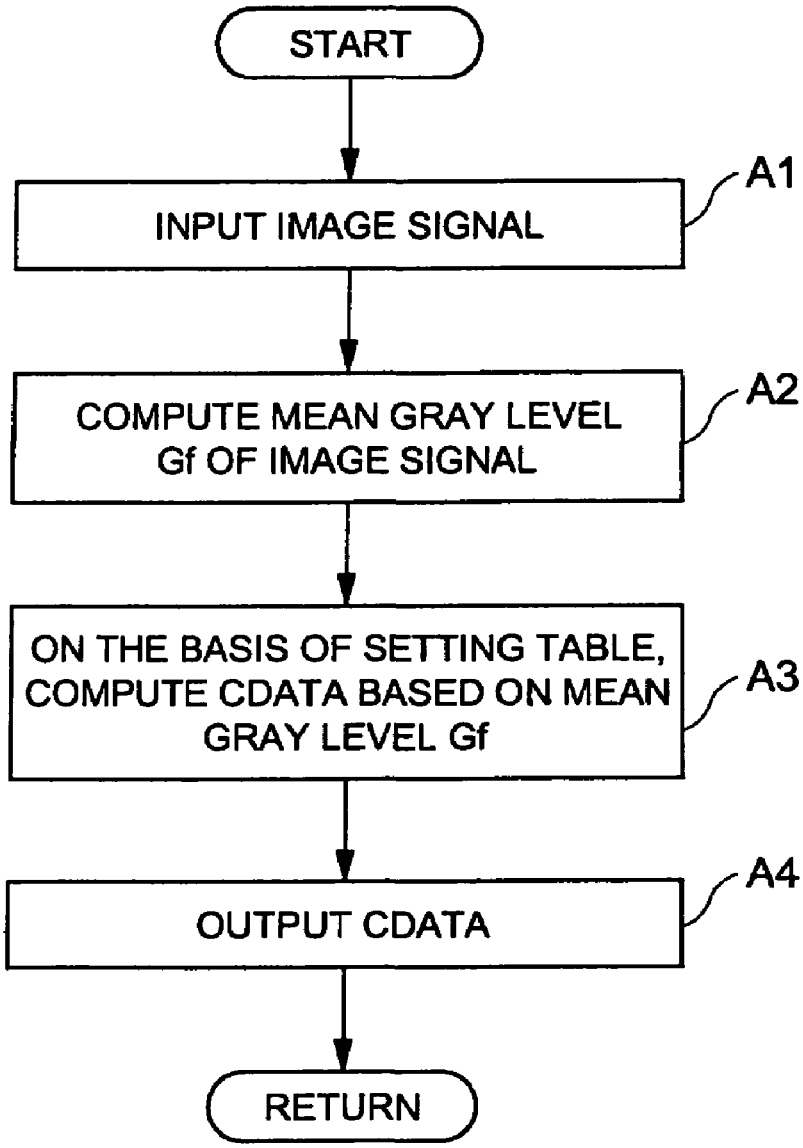
FIG. 7 is a flowchart describing the drive method according to the first exemplary embodiment.

With reference to FIGS. 1 to 7, a display device according to a first exemplary embodiment of the present invention will now be described. FIG. 1 is a circuit schematic of the display device of the first exemplary embodiment. FIG. 2 is a perspective view of the schematic structure of the display device. FIG. 3 is a functional block schematic of the display device. FIG. 4 is a functional block schematic of the main structure of a drive circuit. FIGS. 5 to 7 illustrate a method of driving the display device. In all figures, the film thickness and size ratio of elements are appropriately made different in order to make the figures clearer.

Referring to FIG. 1, the display device of the first exemplary embodiment is an active matrix liquid crystal device including a liquid crystal panel 10 provided with switching elements (thin-film transistors; TFT) 112*a* associated with individual pixels, a data driver 1 and a gate driver 2, which drive these TFTs 112*a*, and an opposing-electrode driver 3.

Referring to FIGS. 1 and 2, the liquid crystal panel 10 includes a liquid crystal layer 150 held between an active matrix substrate 111 and an opposing substrate 121. Polarizers 118 and 128 are disposed on outer surfaces of the substrates 111 and 121, respectively.

A plurality of data lines 115 and a plurality of gate lines 116 are disposed in the X and Y directions, respectively, on the substrate 111. The data driver 1 and the gate driver 2 supply an image signal DATA and a gate signal to the data lines 115 and the gate lines 116 in accordance with synchronization signals CLX and CLY, respectively (see FIG. 3). Areas (pixel areas) defined by the lines 115 and 116 are individually provided with pixel electrodes 112. The TFTs 112*a* disposed near the intersections of the lines 115 and 116 drive the corresponding pixel electrodes 112. The pixel areas are individually provided with hold capacitors 117 having a predetermined capacitance Cst, thereby holding a voltage applied to the liquid crystal layer 150.

The substrate 121, which is made of a transparent material, such as quartz, glass, or plastic, is provided with a transparent opposing electrode 122 made of ITO (indium tin oxide) or the like, which is disposed on the entirety of a display area 10A. The opposing electrode 122 is driven by the opposing-electrode driver 3.

Alignment films (not shown) are disposed on the outermost surfaces of the substrates 111 and 112, thereby defining the alignment of liquid crystal molecules when no voltage is applied. The light transmittance of the liquid crystal panel 10 when no voltage is applied is determined by a combination of the alignment directions of the alignment films and the directions of penetrating axes of the polarizers 118 and 128. In the first exemplary embodiment, for example, the structure of a normally white type is adopted.

Referring to FIG. 3, the data driver 1 is driven by a controller 4 in synchronization with the gate driver 2 and outputs the image signal DATA that has been converted by a DAC (digital-analog converter) 5 into an analog signal sequentially to the data lines 115 in one scanning period (H). By the gate driver 2, this image signal turns on (i.e., supplies a gate signal to) predetermined gate lines 116, thereby being sequentially written to the corresponding pixel electrodes 112.

In contrast, the opposing-electrode driver 3 is driven by an opposingelectrode control circuit 6 in synchronization with the drivers 1 and 2 and supplies the opposing electrode signal CDATA to the opposing electrode 122. On the basis of the signals DATA and CDATA, the liquid crystal layer 150 is driven by an effective voltage signal applied between the electrodes 112 and 122.

To reduce or prevent the liquid crystal layer 150 from degrading, the liquid crystal layer 150 is AC-driven. Various methods may be employed to AC-drive the liquid crystal layer 150. These methods include, for example, an area inversion method of inverting the polarity of the image signal DATA in each frame and a line inversion method of inverting the polarity in each line.

Referring to FIG. 4, the opposing-electrode control circuit 6 is functionally provided with a mean-gray-level computing unit (first detector) 6*a* and a variation-signal setting unit 6*b*. The opposing-electrode control circuit 6 sets the opposing electrode signal CDATA on the basis of the image signal DATA.

The mean-gray-level computing unit 6*a* computes a mean gray level Gf of the image signal DATA per unit time (e.g., one frame in the first embodiment) and detects the brightness of an image displayed in one frame.

The variation-signal setting unit 6*b* has a setting table 6*d* defining the relationship between the mean gray level Gf and a variation signal ΔS. The variation-signal setting unit 6*b* sets the variation signal ΔS on the basis of the mean gray level Gf computed by the mean-gray-level computing unit 6*a*. The variation signal ΔS is added to an initial signal S0 to compute a voltage signal, which in turn is supplied as the opposing electrode signal CDATA to the opposing-electrode driver 3.

In the setting table 6*d*, the gray level of the variation signal is defined so that the gray level of the effective voltage signal (effective signal) generated by modulating the image signal DATA using the variation signal ΔS becomes greater than the gray level of the image signal DATA in accordance with an increase in the gray level Gf. For example, in the setting table 6*d*, as shown in FIG. 5, the median of the maximum displayable gray levels serves as a reference gray level (second gray level) G0. When the mean gray level Gf is greater than the reference gray level G0, the polarity of the variation signal ΔS is set to the same polarity as that of the image signal DATA. When the mean gray level Gf is less than the reference gray level G0, the polarity of the variation signal ΔS is set to the polarity opposite to that of the image signal DATA. It is set so that, the larger the gray level difference ΔG (absolute value) between the mean gray level Gf and the reference gray level G0, the larger the voltage of the variation signal ΔS (absolute value |ΔS|) becomes. FIG. 5 shows, for example, a maximum of 255 gray levels and the median, that is, the 128-th gray level, serving as the reference gray level G0.

When the mean gray level Gf is greater than the reference gray level G0 (i.e., when the brightness of an image in one frame is greater than the reference brightness), the potential of the opposing electrode 122 is changed by |ΔS| toward the same polarity as that of the image signal DATA on the basis of the initial signal S0. As a result, the effective voltage between the electrodes 112 and 122 is reduced, and the image is displayed more brightly. In contrast, when the mean gray level Gf is less than the reference gray level G0 (i.e., when the brightness of an image in one frame is less than the reference brightness), the potential of the opposing electrode 122 is changed by |ΔS| toward the polarity opposite to that of the image signal DATA. As a result, the effective voltage between the electrodes 112 and 122 is increased, and the image is displayed more darkly.

For example, in the setting table 6*d*, the gray level of the variation signal is set so that, when the gray level difference ΔG is positive, the gray level of the effective signal becomes greater than the gray level of the image signal DATA, and, when the gray level difference ΔG is negative, the gray level of the effective signal becomes less than the gray level of the image signal DATA. As a result, a bright image is displayed more brightly, whereas a dark image is displayed more darkly.

Referring to FIGS. 5 to 7, a method of driving the display device will now be described. An example in which the display device is driven by the area inversion method is described below. FIG. 6 shows an example of the waveform of the image signal DATA and an example of the waveform of the opposing electrode signal CDATA.

When the image signal DATA is input from an external device in step A1, the image signal DATA is converted by the DAC 5 into an analog signal, and the analog signal is written via the data driver 1 into the pixel electrodes 112 of the liquid crystal panel 10.

The image signal DATA is also input to the opposing-electrode control circuit 6, and the mean-gray-level computing unit 6*a* computes the mean gray level Gf per frame (step A2).

On the basis of the setting table 6*d*, the variation-signal setting unit 6*b* sets the variation signal ΔS based on the mean gray level Gf and adds the variation signal ΔS to the initial signal S0 to compute a voltage signal serving as the opposing electrode signal CDATA (step A3).

This opposing electrode signal CDATA is supplied via the opposingelectrode driver 3 to the opposing electrode 122 (step A4).

For example, when the mean gray level Gf of the image signal DATA per frame is 200-th gray level (>reference gray level G0) (see the left side of FIG. 6(B)), the variation signal ΔS is set to 1.05 (V) on the basis of the setting table 6*d* (see FIG. 5). The variation-signal setting unit 6*b* adds the variation signal ΔS to the initial signal S0 (e.g., 7 (V)) to compute a voltage signal, which in turn is output as the opposing electrode signal CDATA (e.g., 8.05 (V)) (see the left side of FIG. 6(A)). The potential of the opposing electrode 122 is changed to the same polarity as that of the image signal DATA on the basis of the initial signal S0, thereby reducing the effective voltage between the electrodes 112 and 122. As a result, the entire image is displayed brightly.

Alternatively, when the image signal DATA whose mean gray level Gf is 75-th gray level (<reference gray level G0) is supplied in the subsequent frame (see the right side of FIG. 6(B)), the variation signal ΔS is set to −0.5 (V) on the basis of the setting table 6*d* (see FIG. 5). The variation-signal setting unit 6*b* adds the variation signal ΔS to the initial signal S0 to compute a voltage signal, which in turn is output as the opposing electrode signal CDATA (see the right side of FIG. 6(A)). The potential of the opposing electrode 122 is changed to the polarity opposite to that of the image signal DATA on the basis of the initial signal S0, thereby increasing the effective voltage between the electrodes 112 and 122. As a result, the entire image is displayed darkly. Since the polarity of the image signal DATA is inverted in the subsequent frame, a direction in which the potential of the opposing electrode 122 is changed is opposite to that of the previous frame.

The above-described steps, A1 to A4, are repeated to sequentially display images whose overall brightness has been adjusted.

According to the display device of the first exemplary embodiment, the brightness is adjusted while displaying images in frames, thereby displaying images differing in brightness among frames.

Second Exemplary Embodiment

Figure 8:
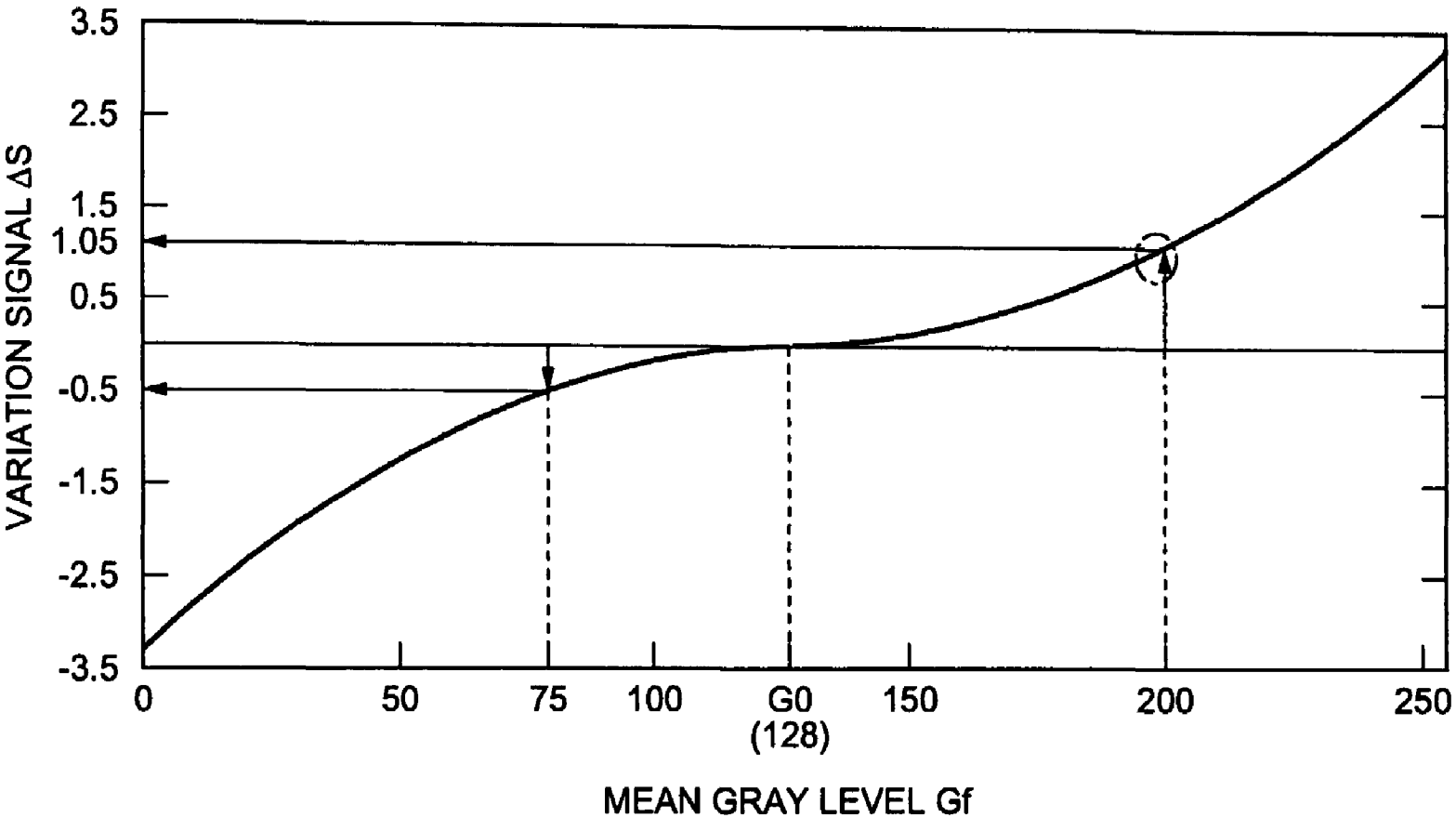
FIG. 8 is a graph describing a drive method according to a second exemplary embodiment of the present invention.
Figure 9A:
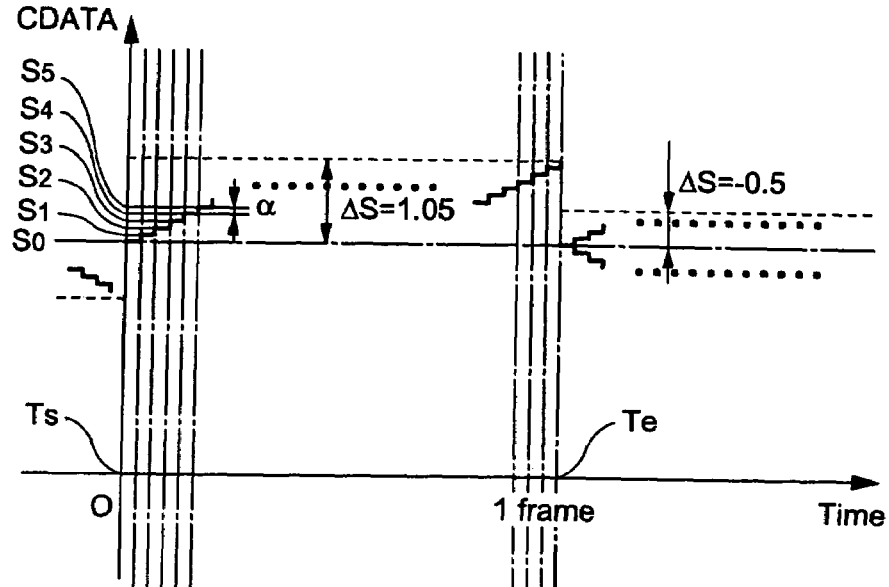
FIGS. 9(A) and 9(B) include schematics describing the drive method according to the second exemplary embodiment.
Figure 9B:
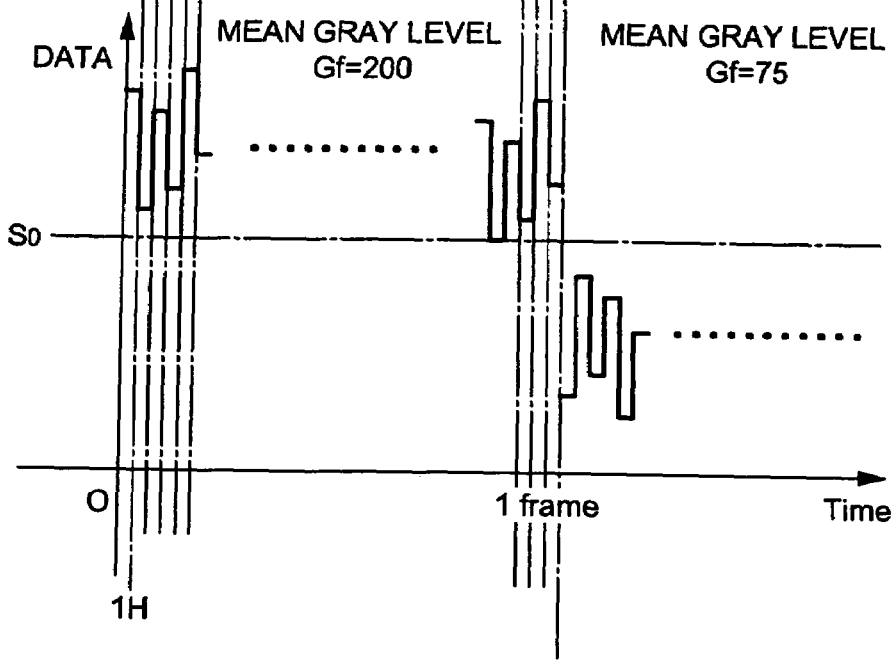
Figure 10:
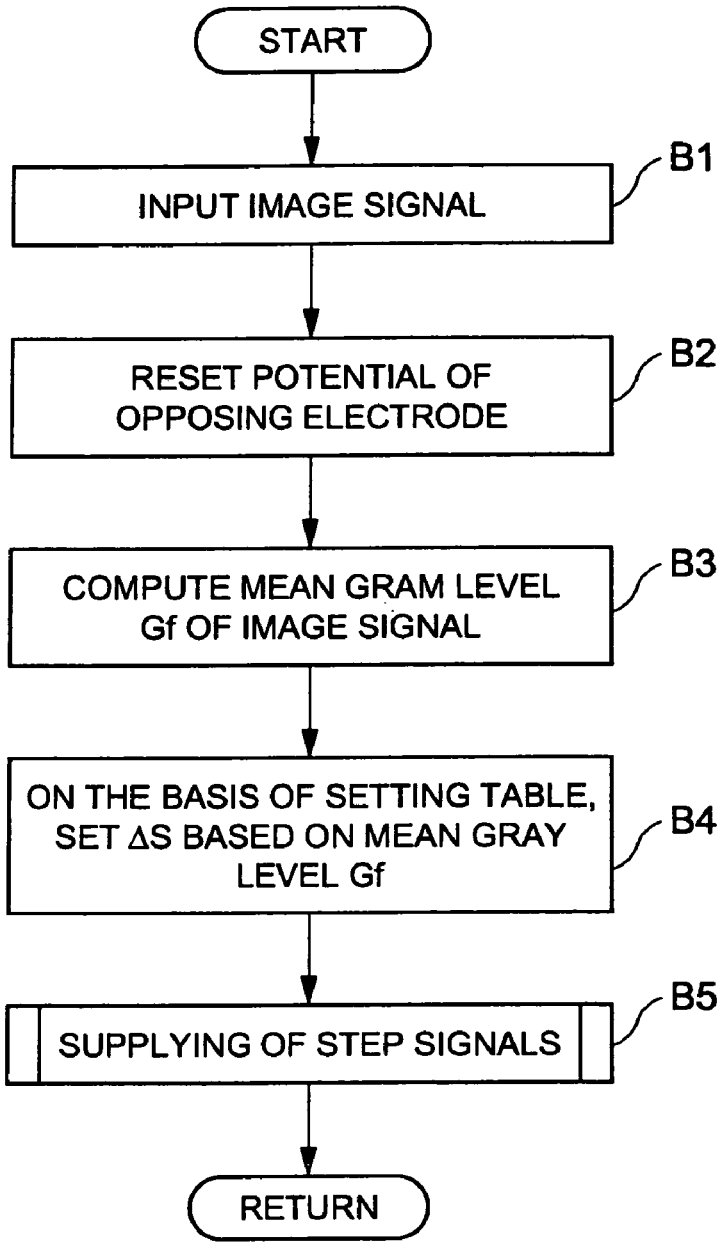
FIG. 10 is a flowchart describing the drive method according to the second exemplary embodiment.
Figure 11:
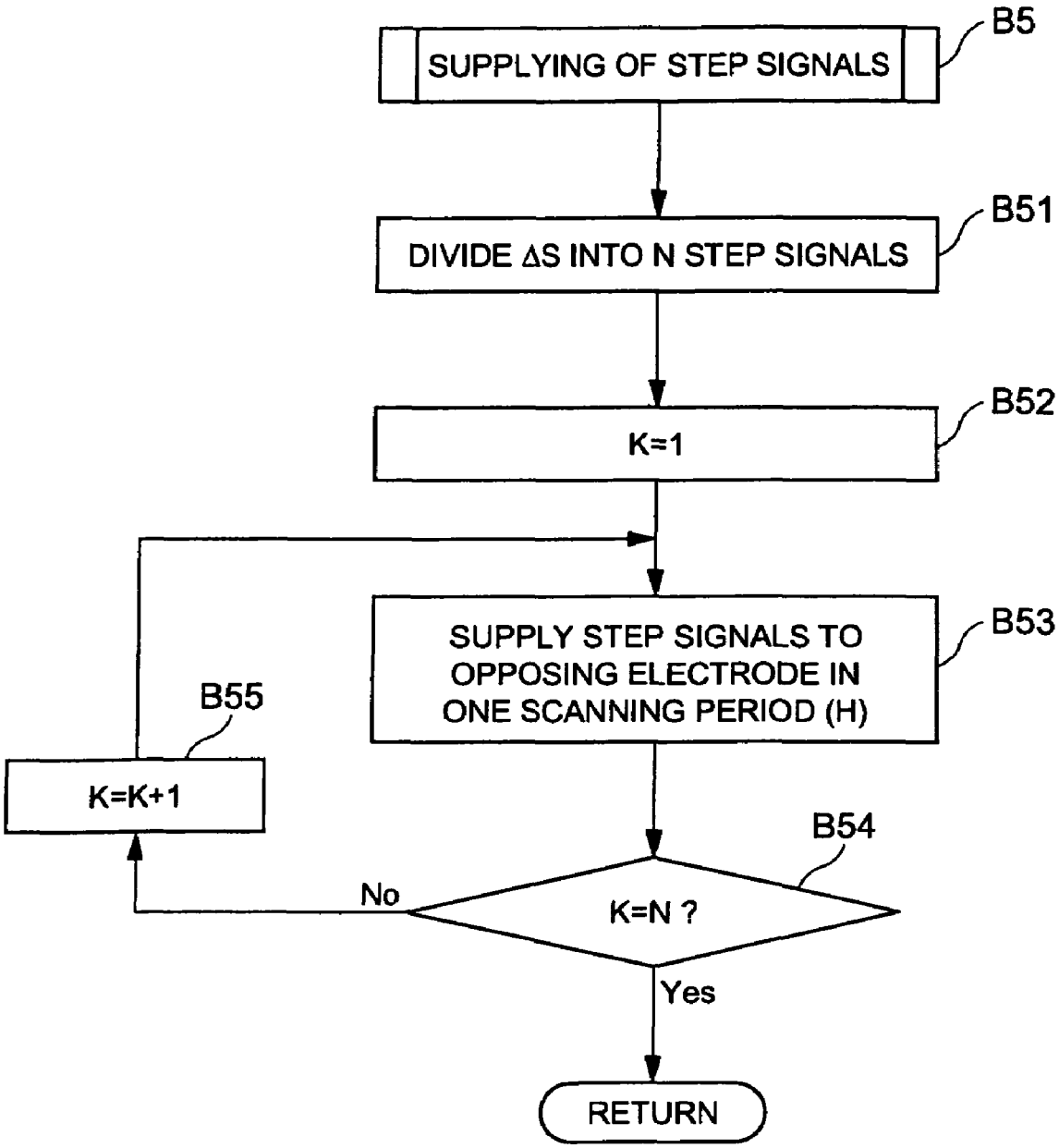
FIG. 11 is a flowchart describing the drive method according to the second exemplary embodiment.

Referring to FIGS. 8 to 10 a display device according to a second exemplary embodiment of the present invention will now be described. Since this display device has the same structure as that of the first exemplary embodiment, FIGS. 1 to 4 are used unchanged, and a description of the structure of the display device is omitted.

The second exemplary embodiment is a modification of the display-device driving method of the first exemplary embodiment. The potential of the opposing electrode 122 is gradually changed within unit time (e.g., one frame period).

Specifically, according to the second exemplary embodiment, when the image signal DATA is input from the external device in step B1, the image signal DATA is converted by the DAC 5 into an analog signal, and the analog signal is written via the data driver 1 into the pixel electrodes 112 of the liquid crystal panel 10.

When the image signal DATA is also input to the opposing-electrode control circuit 6, the potential of the opposing electrode 122 is reset (see step B2), and the initial signal S0 is supplied.

The mean-gray-level computing unit (first detector) 6*a* computes the mean gray level Gf per frame (step B3). On the basis of the setting table 6*d*, the variation-signal setting unit 6*b* sets the variation signal ΔS based on the mean gray level Gf (step B4).

In a step-signal supplying routine (step B5), this variation signal ΔS is divided into a plurality of (e.g., N) step signals (step B51). The step signals are sequentially supplied via the opposing-electrode driver 3 to the opposing electrode 122 at a predetermined time interval (e.g., in each H) (steps B52 to B55).

FIG. 9 shows an example of the waveform of the image signal DATA and an example of the waveform of the opposing electrode signal CDATA. For example, when the mean gray level Gf of the image signal DATA per frame is 200-th gray level (>reference gray level G0) (see the left side of FIG. 9(B)), the variation signal ΔS is set to 1.05 (V) on the basis of the setting table 6*d* (see FIG. 8). This variation signal ΔS is divided by the variation-signal setting unit 6*b* into N step signals α (signal value=ΔS/N), and the step signals α are sequentially supplied to the opposing electrode 122 at a predetermined time interval in one frame period. In FIG. 9, the supply start time Ts of the step signals α is the writing start time of the image signal DATA, and the supply end time Te of the step signals α is the time after unit time (one frame period in the second exemplary embodiment) passes. However, the supply start time Ts and the supply end time Te may be any time within unit time, and the number of segments N of the variation signal ΔS and the supply interval of the step signals α may be arbitrarily set.

Accordingly, the potential of the opposing electrode 122 is changed stepwise to the same polarity as that of the image signal DATA on the basis of the initial signal S0, thereby reducing the effective voltage between the electrodes 112 and 122 by 1.05 (V) in one frame period. As a result, the brightness of an image is gradually increased in one frame period.

When the image signal DATA in the subsequent frame is input, the opposing electrode 122 is reset again, and the initial signal S0 is supplied. The mean-gray-level computing unit 6*a* computes the mean gray level Gf. When this mean gray level Gf is, for example, 75-th gray level (<reference gray level G0) (see the right side of FIG. 9(B)), the variation signal ΔS is set to −0.5 (V) on the basis of the setting table 6*d* (see FIG. 8). This variation signal ΔS is divided by the variation-signal setting unit 6*b* into N step signals α, and the step signals α are sequentially supplied to the opposing electrode 122 at a predetermined time interval in one frame period.

Accordingly, the potential of the opposing electrode 122 is changed stepwise to the polarity opposite to that of the image signal DATA on the basis of the initial signal S0, thereby increasing the effective voltage between the electrodes 112 and 122 by 0.5 (V) in one frame period. As a result, the brightness of an image is gradually reduced in one frame period.

The above-described steps, B1 to B5, are repeated to display images whose overall brightness has been adjusted.

According to the display device of the second exemplary embodiment, the contrast is adjusted while displaying images in frames, thereby displaying images differing in brightness among frames.

According to the display device, since a signal supplying unit stepwise (or continuously) supplies the variation signals to the opposing electrode in unit time, the brightness of an image is adjusted stepwisely. Compared with a case in which the variation signals are supplied at the same time, discontinuity of images when the variation signals are supplied is smoothed, and the images are displayed more naturally.

According to the display device, the potential of the opposing electrode 122 is reset at the time the variation signal is supplied to the opposing electrode 122 (i.e., a series of step signals α is supplied). This facilitates driving. For example, if the opposing electrode 122 is not reset, in order to achieve a desired potential of the opposing electrode 122, for example, the variation signal ΔS set in the previous frame must be stored in a memory, and the difference between this variation signal ΔS and a variation signal ΔS' set in the subsequent frame must be supplied to the opposing electrode 122. In contrast, when the opposing electrode 122 is reset in each frame, the newly computed variation signal ΔS is simply supplied to the opposing electrode 122. The foregoing complicated processing is thus unnecessary.

Third Exemplary Embodiment

Figure 12:
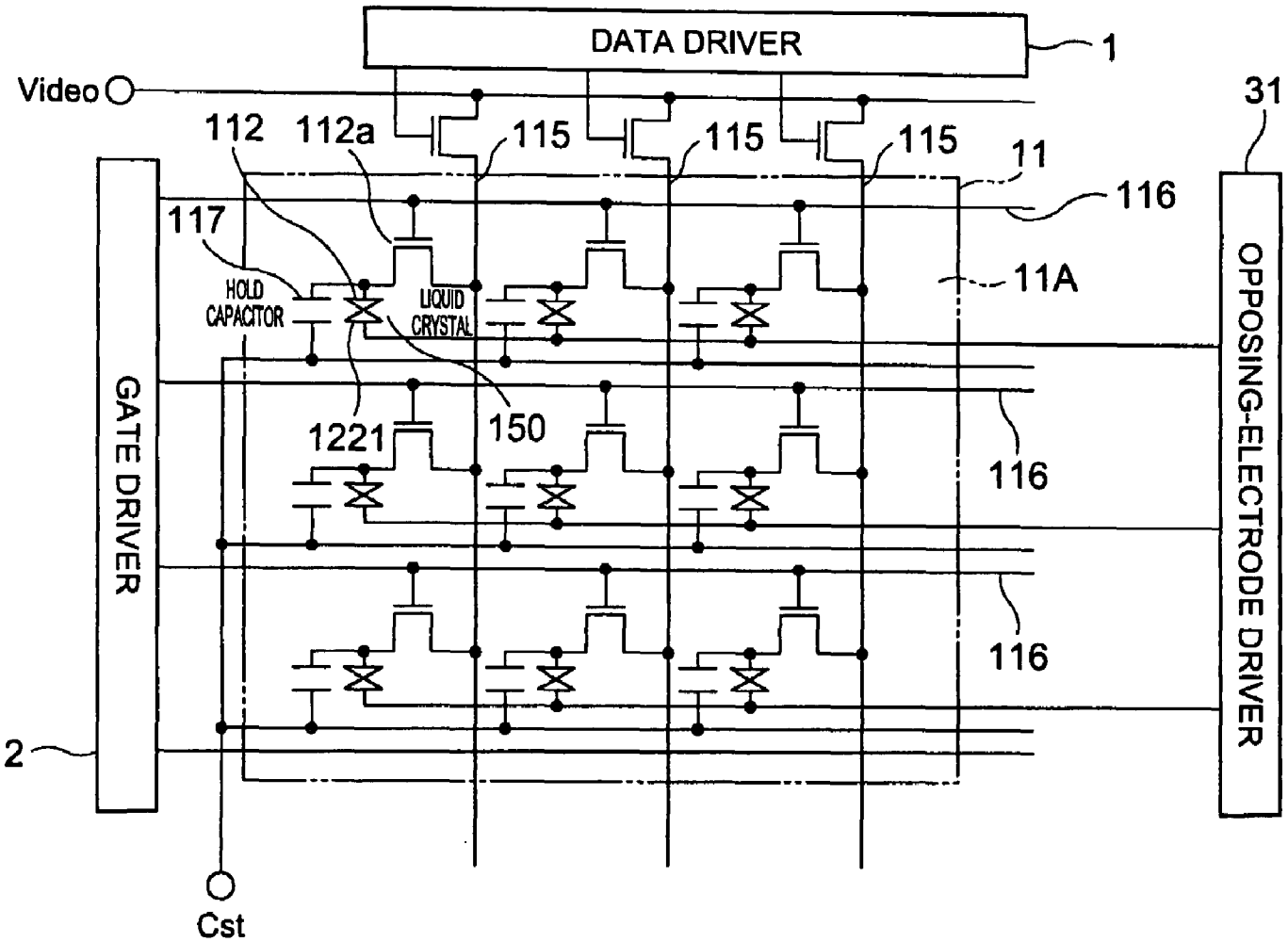
FIG. 12 is a circuit schematic of a display device according to a third exemplary embodiment of the present invention.
Figure 13:
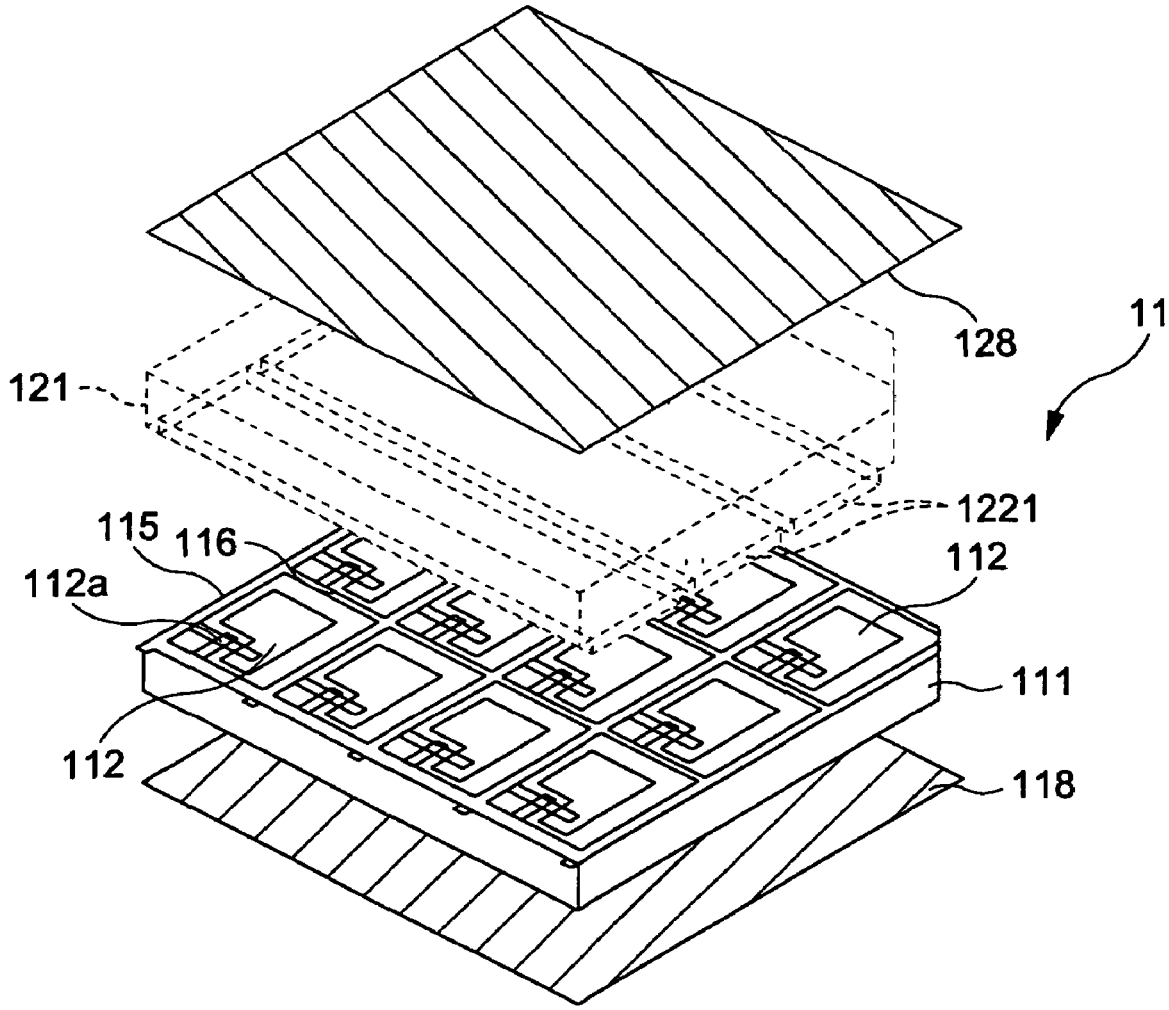
FIG. 13 is a perspective view of the schematic structure of the display device according to the third exemplary embodiment.
Figure 14:
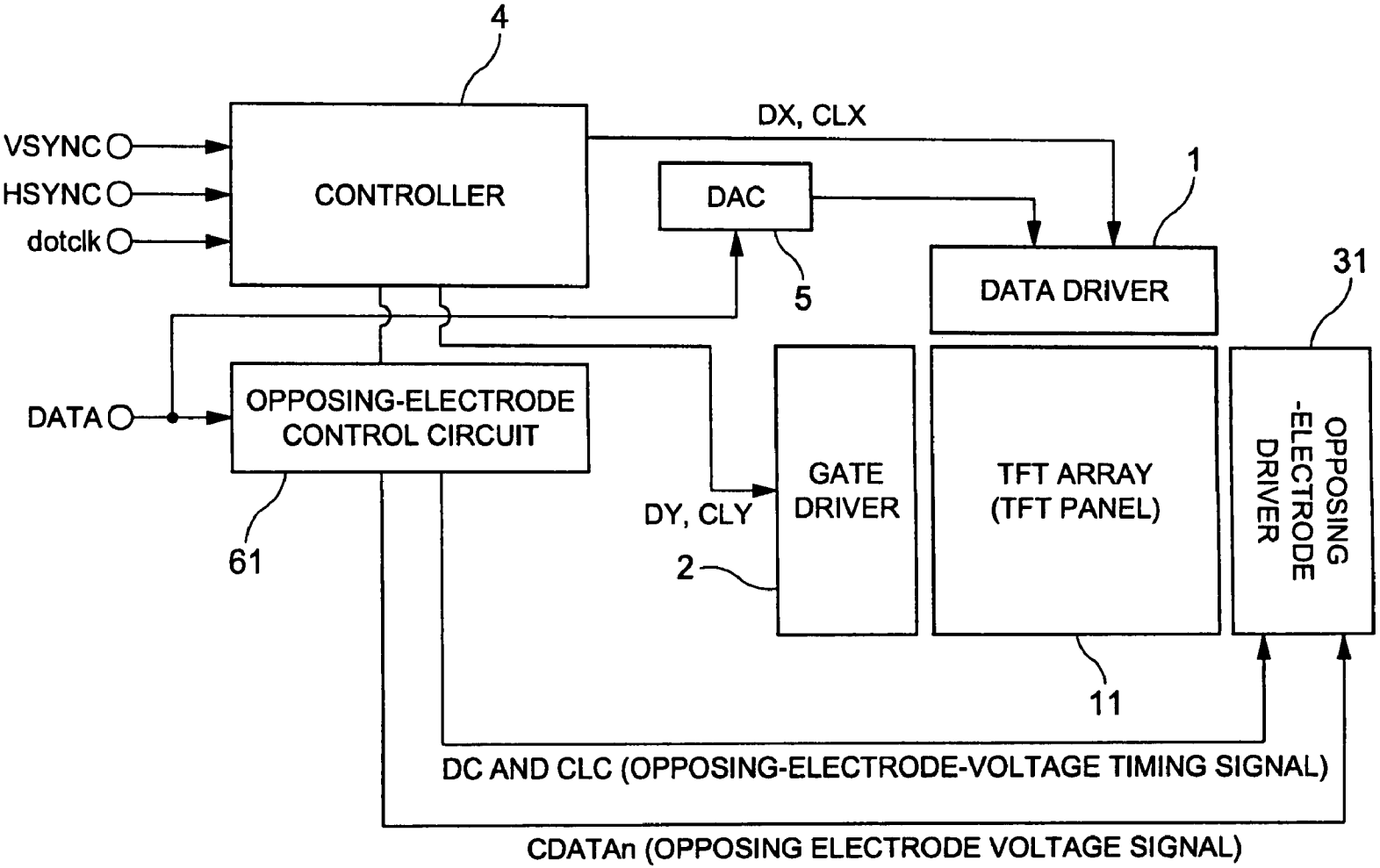
FIG. 14 is a block schematic of the circuit configuration of the display device according to the third exemplary embodiment.
Figure 15:
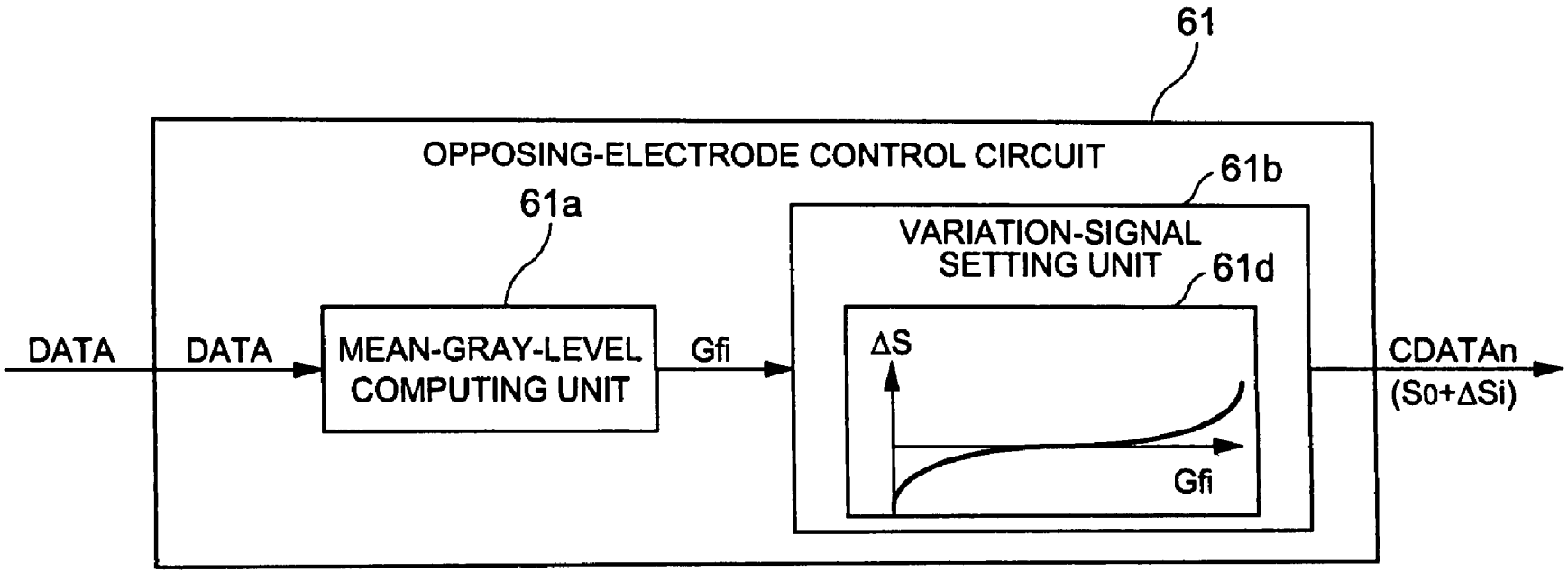
FIG. 15 is a block schematic of the main structure of a drive circuit according to the third exemplary embodiment.
Figure 16:
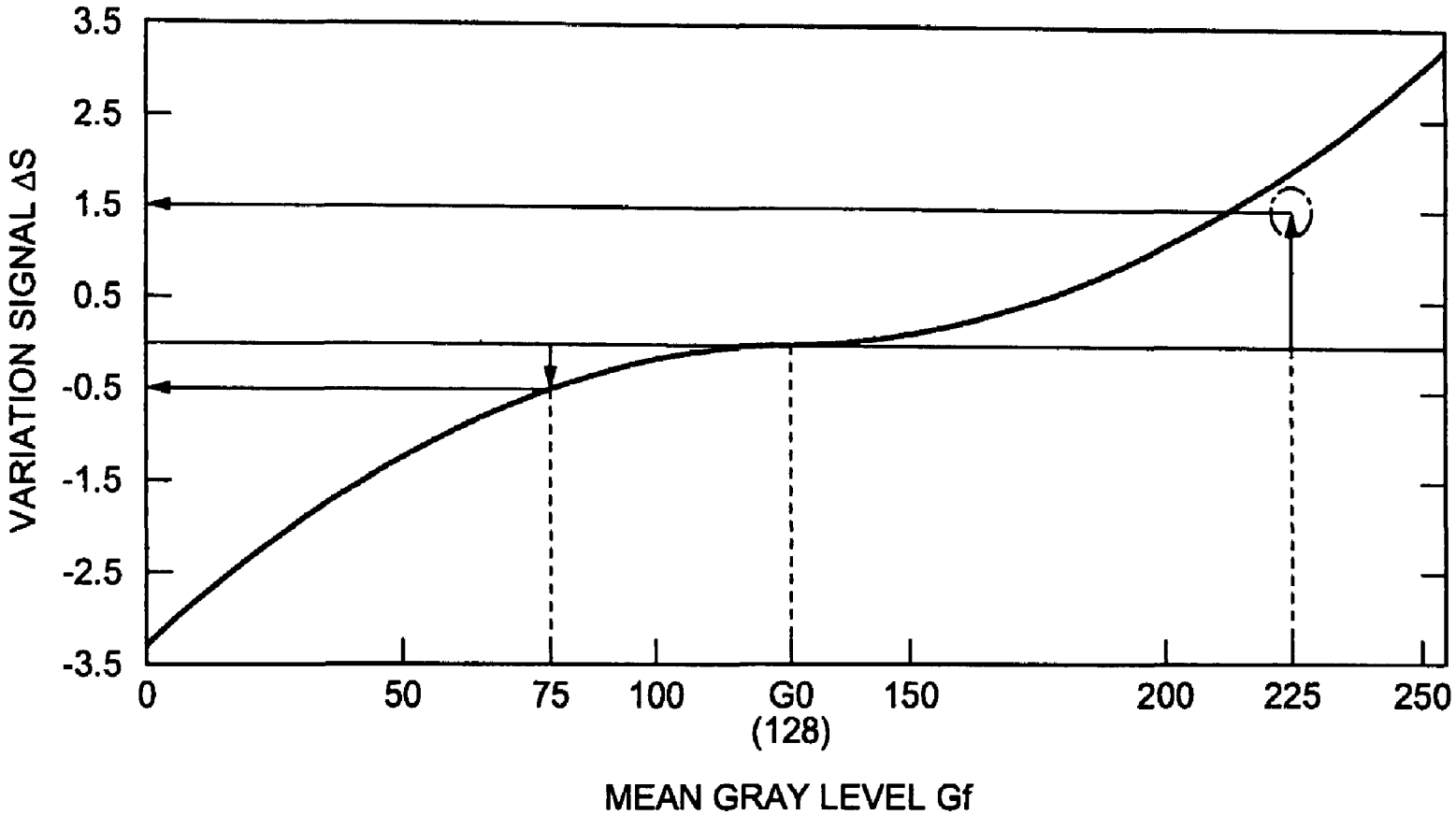
FIG. 16 is a graph describing a drive method according to the third exemplary embodiment.
Figure 17A:
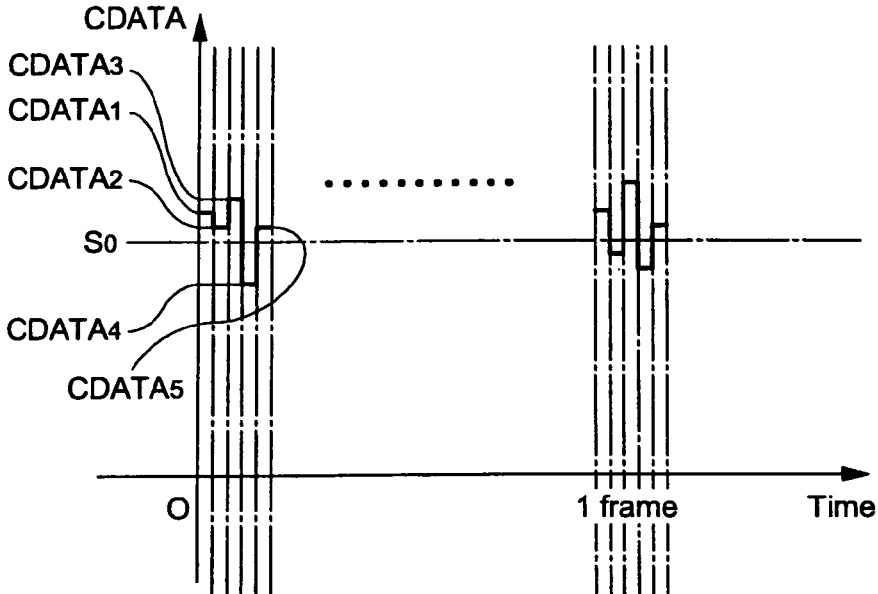
FIGS. 17(A) and 17(B) include schematics describing the drive method according to the third exemplary embodiment.
Figure 17B:
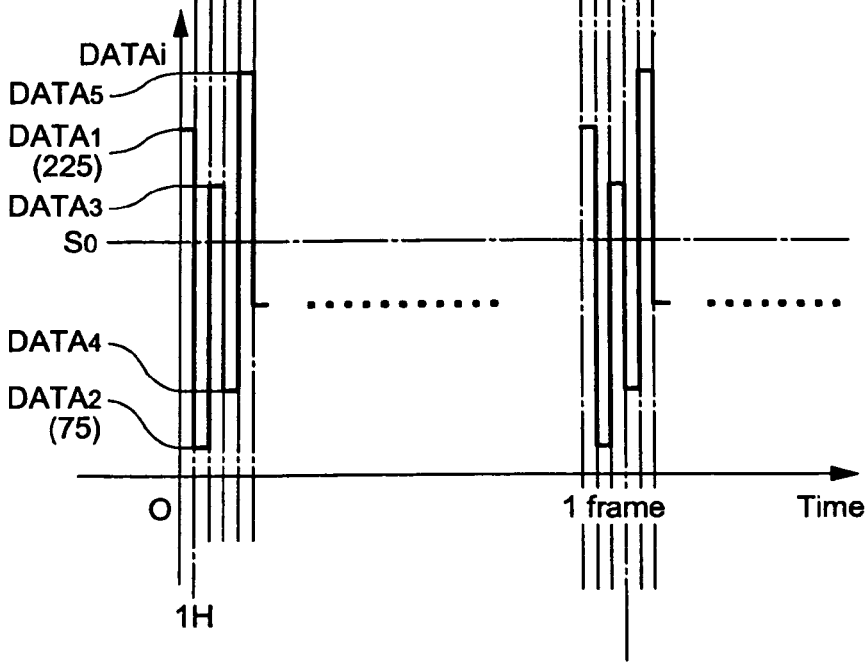
Figure 18:
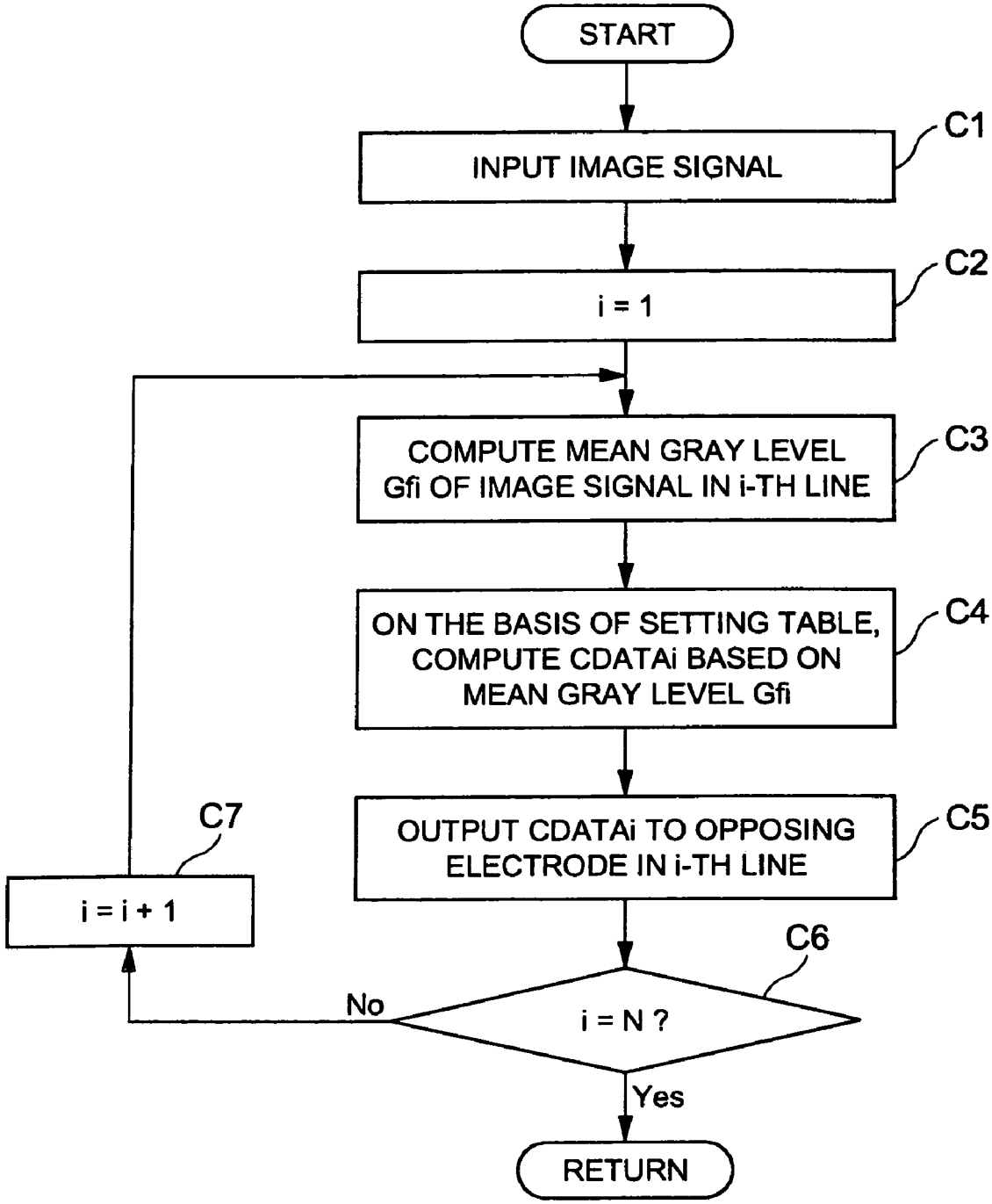
FIG. 18 is a flowchart describing the drive method according to the third exemplary embodiment.

Referring to FIGS. 12 to 18, a display device according to a third exemplary embodiment of the present invention will now be described. FIG. 12 is a circuit schematic of the display device of the third exemplary embodiment. FIG. 13 is a perspective view of the schematic structure of the display device. FIG. 14 is a functional block schematic of the display device. FIG. 15 is a functional block schematic of the main structure of a drive circuit. FIGS. 16 to 18 illustrate a method of driving the display device. The same reference numerals are used to indicate the same parts and members as those of the first exemplary embodiment, and descriptions thereof are omitted.

Referring to FIG. 12, the display device of the third exemplary embodiment is an active matrix liquid crystal device including a liquid crystal panel 11 provided with the switching elements (thin-film transistors; TFT) 112*a* associated with individual pixels, the data driver 1 and the gate driver 2, which drive these TFTs 112*a*, and an opposing-electrode driver 31.

Referring to FIGS. 12 and 13, the liquid crystal panel 11 includes the liquid crystal layer 150 held between the active matrix substrate 111 and the opposing substrate 121. The polarizers, 118 and 128, are disposed on outer surfaces of the substrates, 111 and 121, respectively.

A plurality of transparent opposing electrodes 1221 made of ITO (indium tin oxide) or the like are arranged in stripes on the substrate 121, which is made of a transparent material, such as quartz, glass, or plastic. These opposing electrodes 1221 are disposed corresponding to the lines of the pixel electrodes 112 in a direction parallel to the gate lines 116. The individual opposing electrodes 1221 are driven independently by the opposing-electrode driver 31. The number of opposing electrodes 1221 is arbitrary. In the third exemplary embodiment, for example, the number of opposing electrodes 1221 is the same as the number N of gate lines 116 (the same as the number of lines of the pixel electrodes 112).

The opposing-electrode driver 31 is driven by an opposing-electrode control circuit 61 in synchronization with the drivers 1 and 2 and supplies the opposing electrode signal CDATAi (i=1 to N) to each opposing electrode 1221. The liquid crystal layer 150 is driven by an effective voltage signal applied between the electrodes 112 and 1221 on the basis of the signals DATA and CDATAi (i=1 to N).

Referring to FIG. 15, the opposing-electrode control circuit 61 is functionally provided with a mean-gray-level computing unit (first detector) 61*a* and a variation-signal setting unit 61*b*. The opposing-electrode control circuit 61 sets the opposing electrode signal CDATAi (i=1 to N) for each opposing electrode 1221 on the basis of the image signal DATA.

The mean-gray-level computing unit 61*a* computes the mean gray level Gfi (i=1 to N) of the image signal DATAi (i=1 to N) supplied to the pixel electrodes 112 in each line per unit time (e.g., one frame in the third embodiment) and detects the brightness of an image in each line.

The variation-signal setting unit 61*b* has a setting table 61*d* defining the relationship between the mean gray level Gf and the variation signal ΔS. The variation-signal setting unit 61*b* sets variation signal ΔSi (i=1 to N) in each line on the basis of the mean gray level Gfi computed by the mean-gray-level computing unit 61*a*. The variation signal ΔSi is added to the initial signal S0 to compute a voltage signal, which in turn is supplied as the opposing electrode signal CDATAi (i=1 to N) in each line to the opposing-electrode driver 31.

In the setting table 61*d*, as in the first exemplary embodiment, the median of the maximum displayable gray levels serves as the reference gray level (second gray level) G0. When the mean gray level Gfi is greater than the reference gray level G0, the polarity of the variation signal ΔSi is set to the same polarity as that of the image signal DATA. When the mean gray level Gfi is less than the reference gray level G0, the polarity of the variation signal ΔSi is set to the polarity opposite to that of the image signal DATA. It is set so that, the larger the gray level difference ΔG (absolute value |ΔGi|) between the mean gray level Gfi and the reference gray level G0, the larger the voltage of the variation signal ΔSi (absolute value |ΔSi|) becomes (see FIG. 17).

Since portions excluding this part are arranged in the same manner as those of the first exemplary embodiment, descriptions thereof are omitted.

Referring to FIGS. 16 to 18, a method of driving the display device will now be described. An example in which the display device is driven by the line inversion method is described below. FIG. 17 shows an example of the waveform of the image signal DATA and an example of the waveform of the opposing electrode signal CDATA. FIG. 17(B) shows the waveform of the mean gray level Gfi of the image signal DATAi (i=1 to N) supplied to the pixel electrodes 112 in each line in one scanning period.

When the image signal DATA is input from the external device in step C1, the image signal DATA is converted by the DAC 5 into an analog signal, and the analog signal is written via the data driver 1 into the pixel electrodes 112 of the liquid crystal panel 11.

When the image signal DATA is also input to the opposing-electrode control circuit 61, the mean-gray-level computing unit 61*a* computes the mean gray level Gfi (i=1 to N) of the image signal DATAi (i=1 to N) in each line per frame (step C3).

On the basis of the setting table 61*d*, the variation-signal setting unit 61*b* sets the variation signal ΔSi (i=1 to N) in each line based on the mean gray level Gfi (i=1 to N) and adds the variation signal ΔSi to the initial signal S0 to compute a voltage signal serving as the opposing electrode signal CDATAi (i=1 to N) in each line (step C4).

The opposing electrode signal CDATAi is supplied via the opposing-electrode driver 31 to the corresponding opposing electrode 1221 (step C5).

The above-described steps C3 to C5 are sequentially performed on the image signal DATAi (i=1 to N) in each line to adjust the brightness of an image in each line.

For example, when the mean gray level Gf1 of the image signal DATA1 in the first line is 225-th gray level (>reference gray level G0) (see the first line of FIG. 17(B)), the variation signal ΔS1 is set to 1.5 (V) on the basis of the setting table 61*d* (see FIG. 16). The variation-signal setting unit 61*b* adds the variation signal ΔS to the initial signal S0 (e.g., 7 (V)) to compute a voltage signal, which in turn is output as the opposing electrode signal CDATA1 (e.g., 8.5 (V)) in the first line (see the first line of FIG. 17(A)). The potential of the opposing electrode 1221 in the first line is changed to the same polarity as that of the image signal DATA1 on the basis of the initial signal S0, thereby reducing the effective voltage between the pixel electrodes 112 in the first line and the opposing electrode 1221 in the first line. As a result, the image in the first line is displayed brightly.

At the same time, when the mean gray level Gf2 of the image signal DATA2 in the second line is 75-th gray level (<reference gray level G0) (see the second line of FIG. 17(B)), the variation signal ΔS2 is set to −0.5 (V) on the basis of the setting table 61*d* (see FIG. 16). The variation-signal setting unit 61*b* adds the variation signal ΔS2 to the initial signal S0 to compute a voltage signal, which in turn is output as the opposing electrode signal CDATA2 in the second line. The potential of the opposing electrode 1221 in the second line is changed to the polarity opposite to that of the image signal DATA2 in the second line on the basis of the initial signal S0, thereby increasing the effective voltage between the pixel electrodes 112 in the second line and the opposing electrode 1221 in the second line. As a result, the image in the second line is displayed darkly. Since the polarity of the image signal DATA2 in the second line is inverted, a direction in which the potential of the opposing electrode 1221 is changed is opposite to that of the previous line.

The above-described steps, C1 to C7, are repeated to sequentially display frame images whose brightness in each line has been adjusted.

According to the display device of the third exemplary embodiment, the brightness in each line is adjusted. Therefore, the contrast of a portion of an image can be adjusted, and an image whose portions differ in brightness can be displayed.

Fourth Exemplary Embodiment

Referring to FIGS. 19 to 22, a display device according to a fourth exemplary embodiment of the present invention will now be described. Where necessary, FIGS. 12 and 14 are used unchanged in the following description.

The fourth exemplary embodiment is a modification of the driving method of the third exemplary embodiment. The variation signal ΔS is defined on the basis of the gray level difference between the mean gray level Gf of the image signal DATA per unit time and the mean gray level Gfi (i=1 to N) of the image signal DATAi (i=1 to N) in each line.

Figure 19:
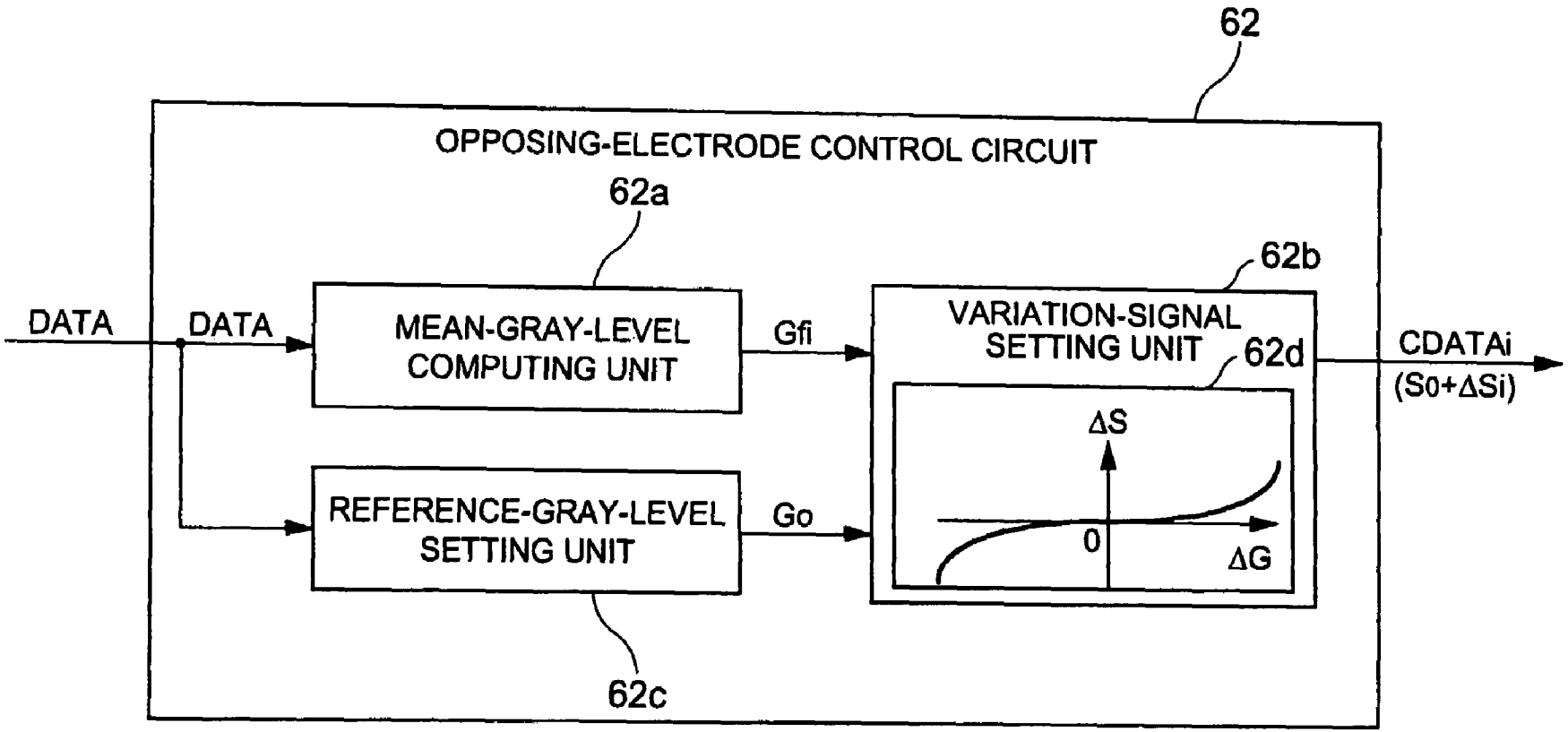
FIG. 19 is a block schematic of the main structure of a drive circuit according to a fourth exemplary embodiment of the present invention.

Specifically, referring to FIG. 19, an opposing-electrode control circuit 62 of the fourth exemplary embodiment is functionally provided with a mean-gray-level computing unit (first detector) 62*a*, a variation-signal setting unit 62*b*, and a reference-gray-level setting unit (second detector) 62*c*. The opposing-electrode control circuit 62 sets the opposing electrode signal CDATAi (i=1 to N) for the corresponding opposing electrode 1221 on the basis of the image signal DATA.

The mean-gray-level computing unit 62*a* computes the mean gray level Gfi (i=1 to N) of the image signal DATAi (i=1 to N) supplied to the pixel electrodes 112 in each line per unit time (e.g., one frame in the fourth exemplary embodiment) and detects the brightness of an image in each line.

The reference-gray-level setting unit 62*c* computes the mean gray level Gf of the image signal DATA per unit time described above and outputs the mean gray level Gf serving as the reference gray level (second gray level) G0.

The variation-signal setting unit 62*b* has a setting table 62*d* defining the relationship of the gray level difference ΔG between the mean gray level Gfi (i=1 to N) in each line and the reference gray level G0 with the variation signal ΔS. On the basis of the mean gray level Gfi computed by the mean-gray-level computing unit 62*a*, the variation-signal setting unit 62*b* sets the variation signal ΔSi (i=1 to N) in each line. The variation signal ΔSi is added to the initial signal S0 to compute a voltage signal, which in turn is supplied as the opposing electrode signal CDATAi (i=1 to N) in each line to the opposingelectrode driver 31.

Figure 20:
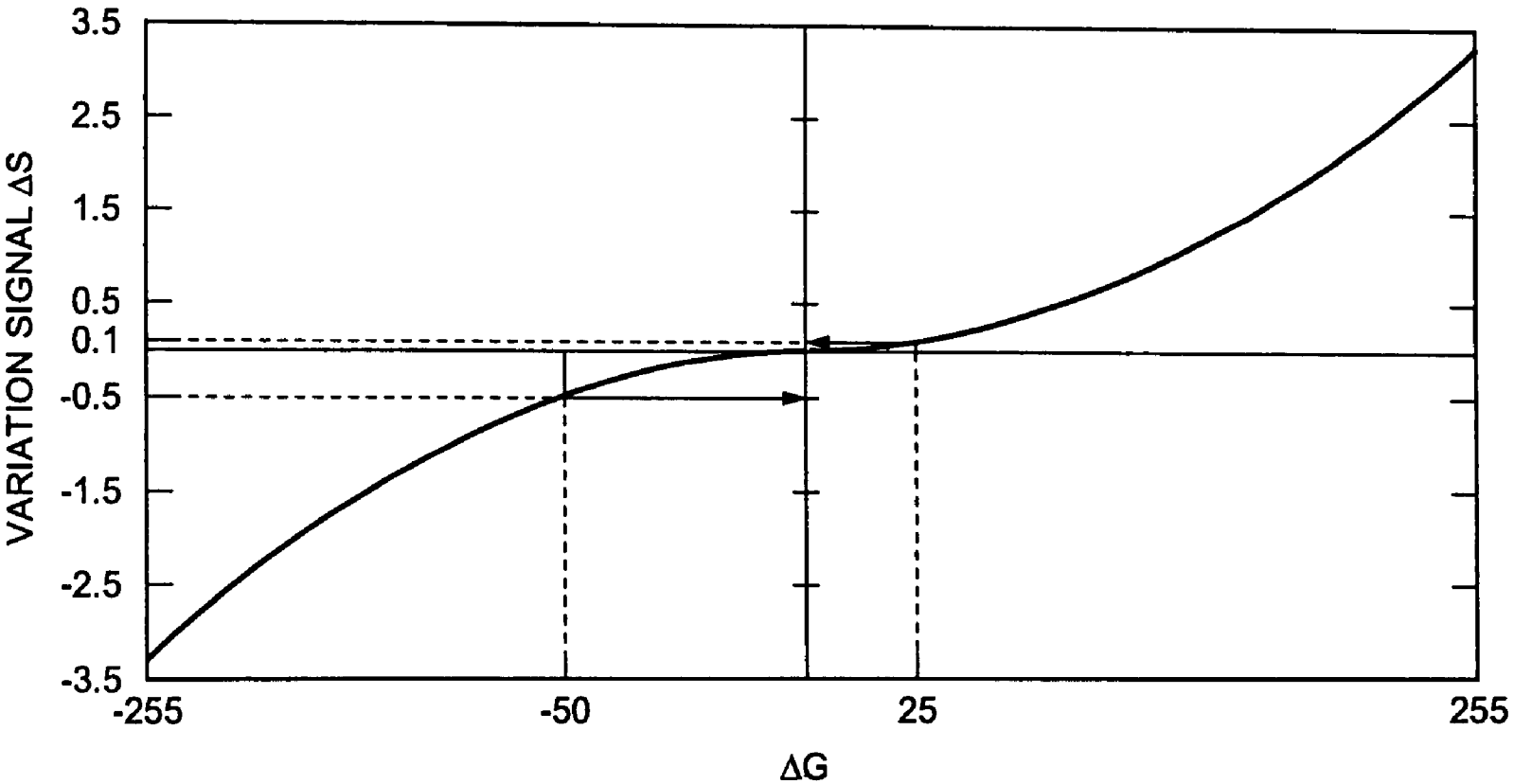
FIG. 20 is a graph describing a drive method according to the fourth exemplary embodiment.

In the setting table 62*d*, the gray level of the variation signal is defined so that the gray level of the effective voltage signal (effective signal) generated by modulating the image signal DATAi using the variation signal ΔSi becomes greater than the gray level of the image signal DATA in accordance with an increase in the mean gray level Gfi. For example, in the setting table 62*d*, as shown in FIG. 20, when ΔG is positive (i.e., when the mean gray level Gfi is greater than the reference gray level G0), the polarity of the variation signal ΔSi is set to the same polarity as that of the image signal DATAi. When ΔG is negative (i.e., when the mean gray level Gfi is less than the reference gray level G0), the polarity of the variation signal ΔSi is set to the polarity opposite to that of the image signal DATAi. It is set so that, the larger the gray level difference ΔG (absolute value), the larger the voltage of the variation signal ΔSi (absolute value |ΔS|) becomes.

When the mean gray level Gfi is greater than the reference gray level G0 (i.e., when the brightness of an image in each line is greater than the average brightness of the image), the potential of the opposing electrode 1221 is changed by |ΔS| toward the same polarity as that of the image signal DATAi on the basis of the initial signal S0. As a result, the effective voltage between the electrodes 112 and 1221 is reduced, and the image in that line is displayed more brightly. In contrast, when the mean gray level Gfi is less than the reference gray level G0 (i.e., when the brightness of an image in each line is less than the average brightness of the image), the potential of the opposing electrode 1221 is changed by |ΔS| toward the polarity opposite to that of the image signal DATAi. As a result, the effective voltage between the electrodes 112 and 1221 is increased, and the image is displayed more darkly.

For example, in the setting table 62*d*, the gray level of the variation signal is set so that, when the gray level difference ΔG is positive, the gray level of the effective signal becomes greater than the gray level of the image signal DATA, and, when the gray level difference ΔG is negative, the gray level of the effective signal becomes less than the gray level of the image signal DATA. As a result, a bright portion (line) of the image is displayed more brightly, whereas a dark portion (line) of the image is displayed more darkly.

Since the fourth exemplary embodiment has the same structure as that of the third exemplary embodiment except for the foregoing difference, a description of common portions is omitted.

Figure 21A:
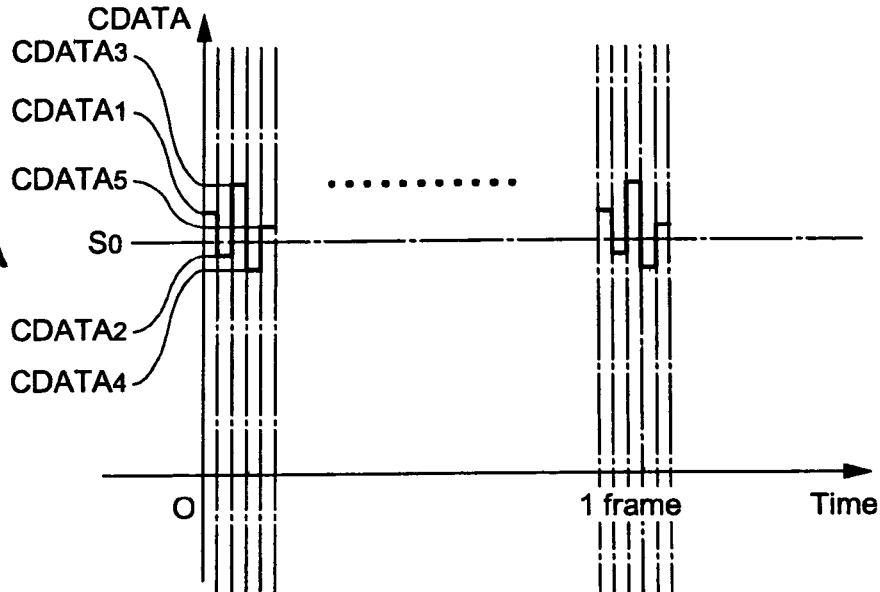
FIGS. 21(A) and 21(B) includes schematics describing the drive method according to the fourth exemplary embodiment.
Figure 21B:
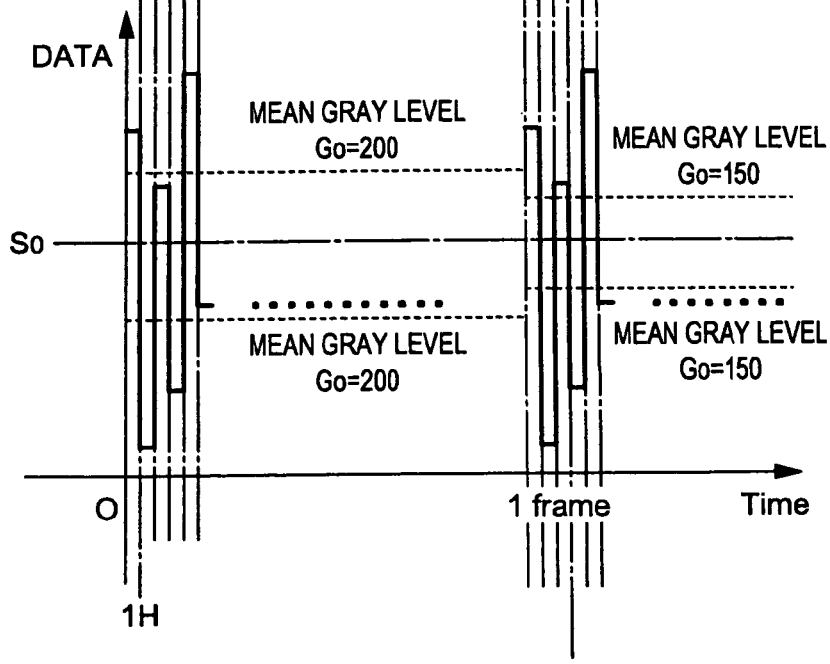
Figure 22:
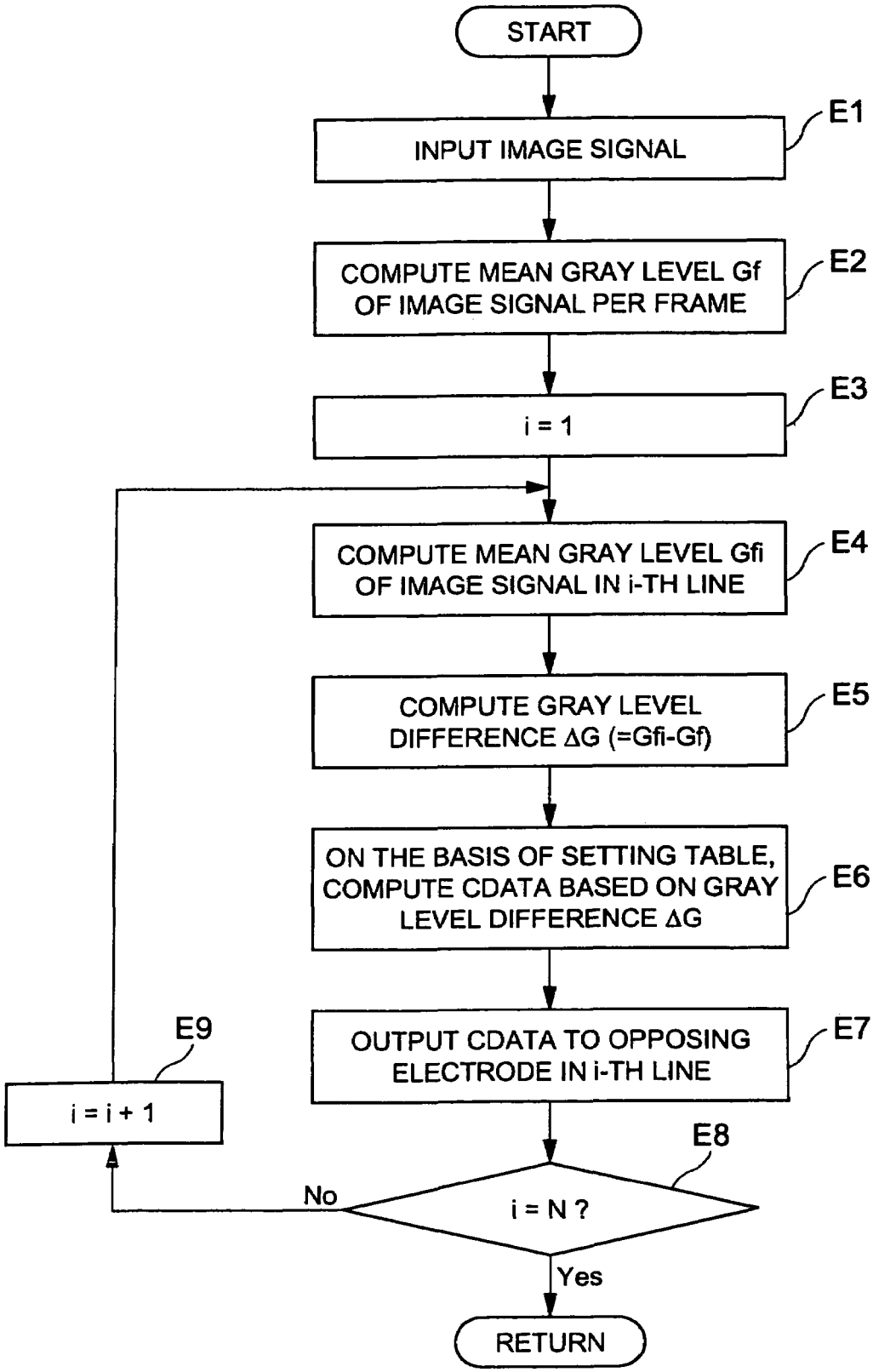
FIG. 22 is a flowchart describing the drive method according to the fourth exemplary embodiment.
Figure 23:
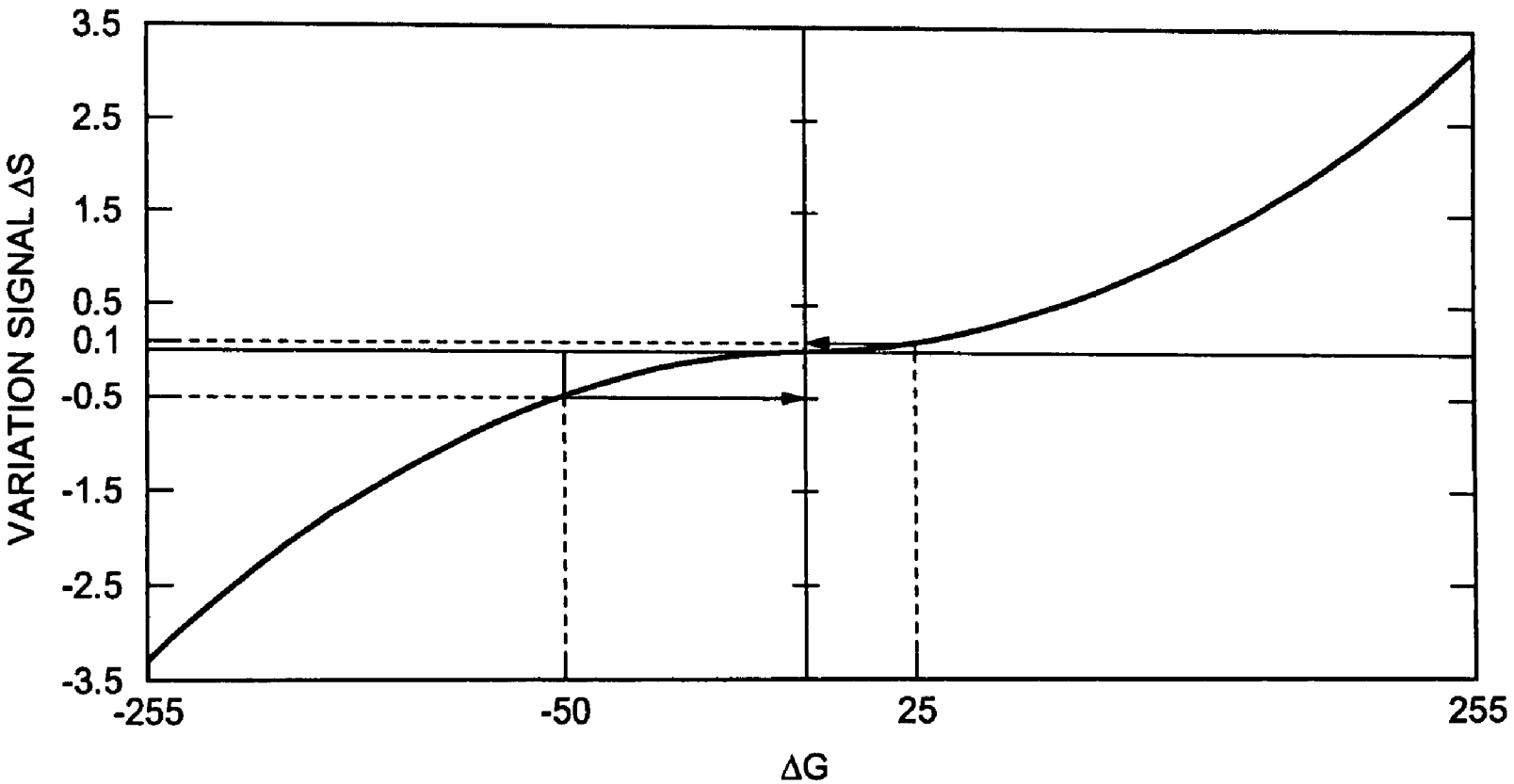
FIG. 23 is a graph describing a drive method according to a fifth exemplary embodiment of the present invention.

Referring to FIGS. 20 to 22, a method of driving the display device will now be described. An example in which the display device is driven by the line inversion method is described below. FIG. 21 shows an example of the waveform of the image signal DATA and an example of the waveform of the opposing electrode signal CDATA. FIG. 21(B) shows the waveform of the mean gray level Gfi of the image signal DATAi (i=1 to N) supplied to the pixel electrodes 112 in each line in one scanning period.

When the image signal DATA is input from the external device in step E1, the image signal DATA is converted by the DAC 5 into an analog signal, and the analog signal is written via the data driver 1 into the pixel electrodes 112 of the liquid crystal panel 11.

When the image signal DATA is also input to the opposing-electrode control circuit 62, the reference-gray-level setting unit 62*c* computes the mean gray level Gf of the image signal DATA per frame and outputs the mean gray level Gf serving as the reference gray level G0 to the variation-signal setting unit 62*b* (step E2).

The mean-gray-level computing unit 62*a l computes the mean gray level Gfi (i*=1 to N) of the image signal DATAi (i=1 to N) in each line per frame (step E4). On the basis of the setting table 62*d*, the variation-signal setting unit 62*b* sets the variation signal ΔSi (i=1 to N) in each line on the basis of the gray level difference between the mean gray level Gfi and the reference gray level G0 (steps E5 and E6). The variation signal ΔSi is added to the initial signal S0 to compute a voltage signal serving as the opposing electrode signal CDATAi (i=1 to N) in each line (step E6).

This opposing electrode signal CDATAi is supplied via the opposing-electrode driver 31 to the corresponding opposing electrode 1221 (step E7).

The above-described steps E4 to E7 are sequentially performed on the image signal DATAi in each line to adjust the brightness of the image in each line.

For example, in a case in which the image signal DATA whose mean gray level Gf (G0) is 200-th gray level is input in the first frame, when the mean gray level Gf1 of the image signal DATA1 in the first line is 225-th gray level (>reference gray level G0) (see the first line of FIG. 21(B)), the variation signal ΔS1 is set to 0.1 (V) on the basis of the setting table 62*d* (see FIG. 20). The variation-signal setting unit 62*b* adds the variation signal ΔS1 to the initial signal S0 (e.g., 7 (V)) to compute a voltage signal, which in turn is output as the opposing electrode signal CDATA1 (e.g., 7.1 (V)) in the first line (see the first line of FIG. 21(A)). The potential of the opposing electrode 1221 in the first line is changed to the same polarity as that of the image signal DATA1 on the basis of the initial signal SO, thereby reducing the effective voltage between the pixel electrodes 112 in the first line and the opposing electrode 1221 in the first line. As a result, an image in the first line is displayed brightly.

When the mean gray level Gf2 of the image signal DATA2 in the second line is 150-th gray level (<reference gray level G0) (see the second line of FIG. 21(B)), the variation signal ΔS2 is set to −0.5 (V) on the basis of the setting table 62*d* (see FIG. 20).

The variation-signal setting unit 61*b* adds the variation signal ΔS2 to the initial signal S0 to compute a voltage signal, which in turn is output as the opposing electrode signal CDATA2 in the second line. The potential of the opposing electrode 1221 in the second line is changed to the polarity opposite to that of the image signal DATA2 on the basis of the initial signal S0, thereby increasing the effective voltage between the pixel electrodes 112 in the second line and the opposing electrode 1221 in the second line. As a result, the image in the second line is displayed darkly. Since the polarity of the image signal DATA2 is inverted in the second line, a direction in which the potential of the opposing electrode 1221 is changed is opposite to that of the previous line.

When the image signal DATA whose mean gray level Gf (G0) is 150-th gray level is input in the second frame, the brightness of the image in each line is adjusted similarly by setting the variation signal ΔSi on the basis of the reference gray level G0 in the second frame.

The above-described steps, E1 to E9, are repeated to sequentially display frame images whose brightness has been adjusted in each line.

According to the display device of the fourth exemplary embodiment, the brightness of an image is adjusted in each line. Therefore, the contrast of a portion of an image can be adjusted, and an image whose portions differ in brightness can be displayed.

Since the adjustment is based on the mean gray level Gf in a frame, an image whose portions differ in brightness can be displayed. In other words, for example, according to the third exemplary embodiment, the variation range is determined on the basis of a prepared table. The third embodiment is less advantageous than the fourth exemplary embodiment in increasing the contrast of an image.

Fifth Exemplary Embodiment

Referring to FIGS. 23 to 26, a display device according to a fifth exemplary embodiment of the present invention will now be described. Since the structure of the display device is similar to that of the fourth exemplary embodiment, FIGS. 12, 14, and 19 are used unchanged in the following description, and a description of the structure of the display device is omitted.

The fifth exemplary embodiment is a modification of the driving method of the fourth exemplary embodiment. The potential of each opposing electrode 1221 is gradually changed within per unit time (e.g., one frame period in the fifth exemplary embodiment).

When the image signal DATA is input from the external device into the opposing-electrode control circuit 62 in step F1, the reference-gray-level setting unit (second detector) 62*c* computes the mean gray level Gf of the image signal DATA per frame and outputs the mean gray level Gf serving as the reference gray level (second gray level) G0 to the variation-signal setting unit 62*b* (step F2).

The corresponding image signal DATAi is written to the pixel electrodes 112 in the predetermined line; and the potential of the opposing electrode 1221 is reset, and the initial signal S0 is supplied (step F4).

The mean-gray-level computing unit (first detector) 62*a* computes the mean gray level Gf1 (i=1 to N) of the image signal DATAi (i=1 to N) in each line per frame (step F5). On the basis of the setting table 62*d*, the variation-signal setting unit 62*b* sets the variation signal ΔSi in each line using the gray level difference between the mean gray level Gfi and the reference gray level G0 (steps F6 and F7).

In a step-signal supplying routine (step F8), this variation signal ΔSi is divided into a plurality of (e.g., N) step signals (step B81). The step signals are sequentially supplied via the opposing-electrode driver 31 to the corresponding opposing electrode 1221 at a predetermined time interval (e.g., in each H) (steps F82 to F85).

Figure 24:
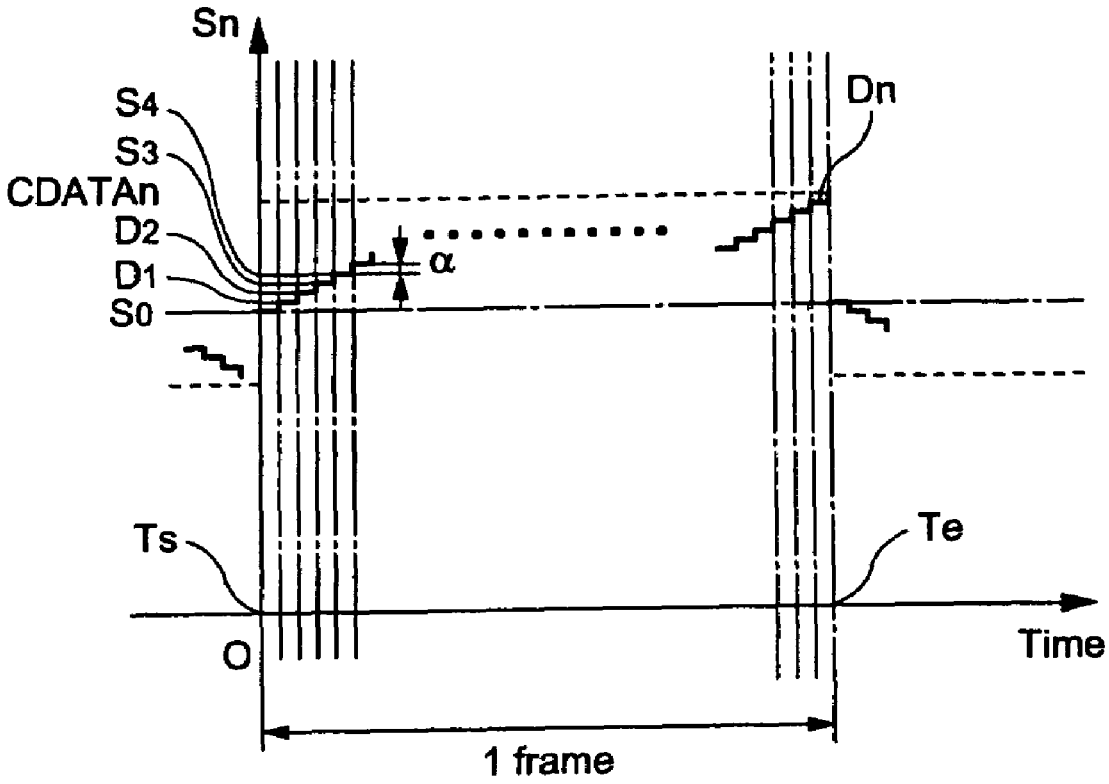
FIG. 24 is a schematic describing the drive method according to the fifth exemplary embodiment.
Figure 25:
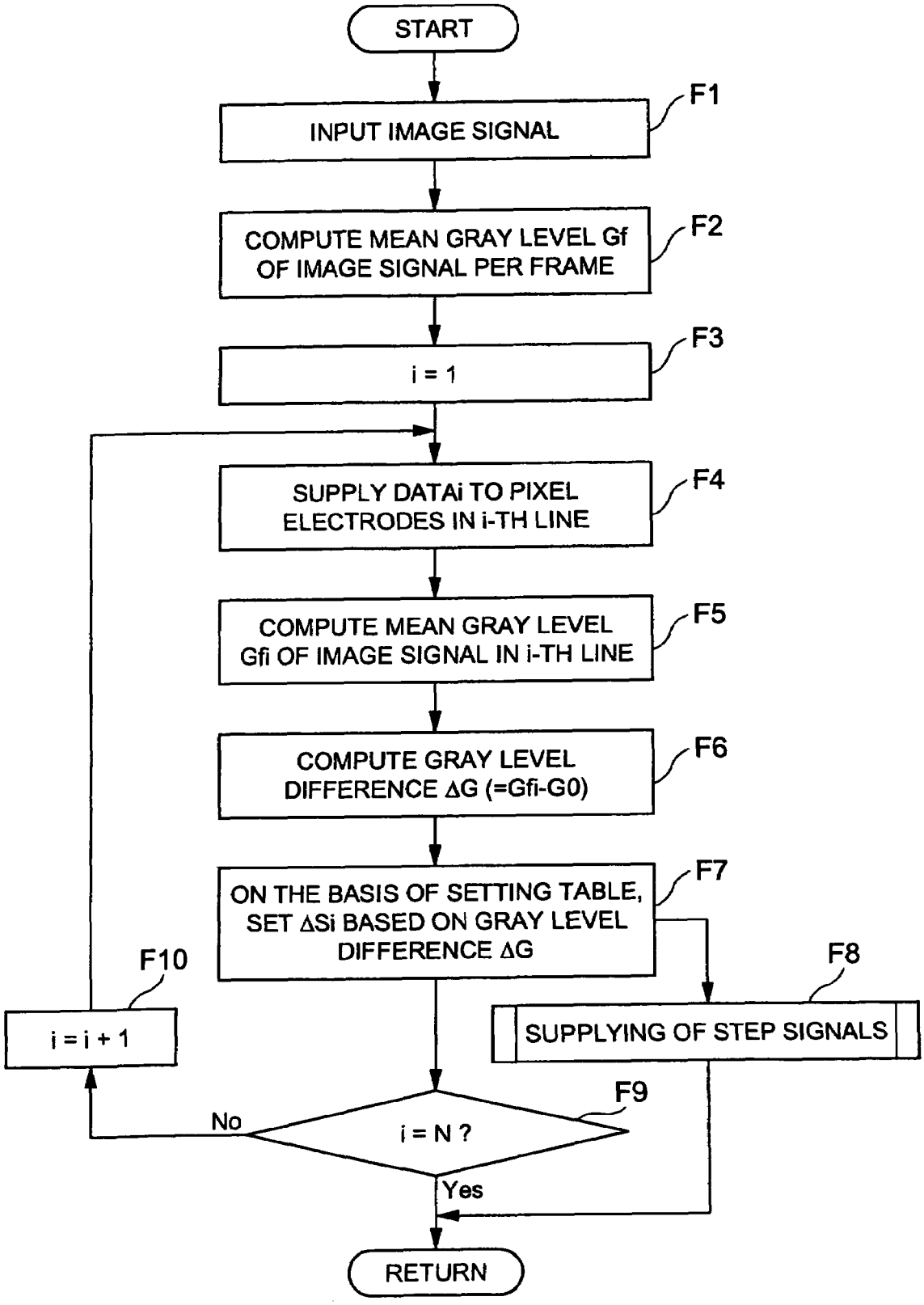
FIG. 25 is a flowchart describing the drive method according to the fifth exemplary embodiment.
Figure 26:
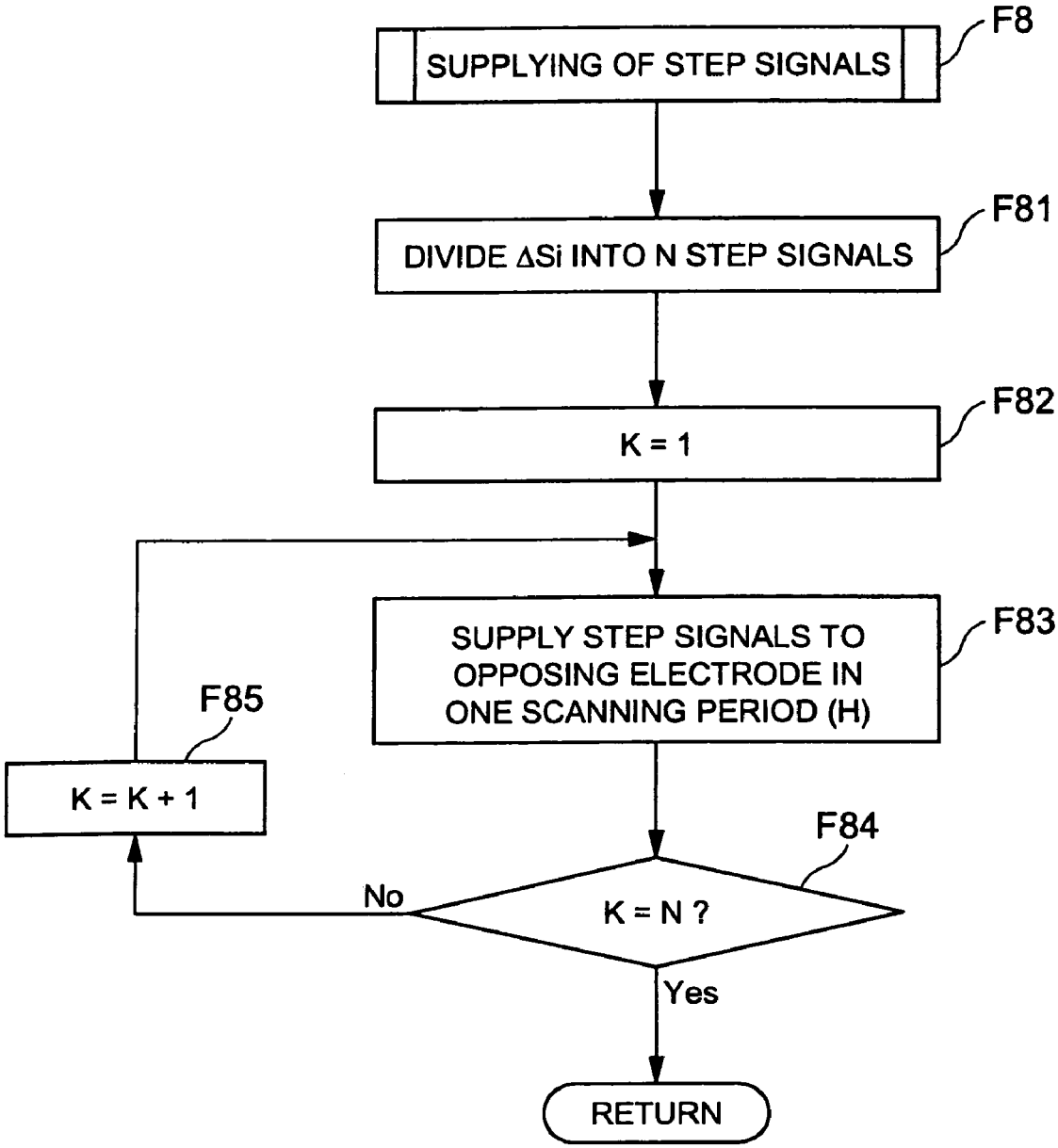
FIG. 26 is a flowchart describing the drive method according to the fifth exemplary embodiment.

FIG. 24 shows an example of variations in the potential of the opposing electrode 1221 in the i-th line over time. For example, in a case in which the image signal DATA whose mean gray level Gf (G0) is 200-th gray level is input in the first frame, when the mean gray level Gfi of the image signal DATAi in the i-th line is 225-th gray level (>reference gray level G0), the variation signal ΔSi is set to 0.1 (V) on the basis of the setting table 62*d* (see FIG. 23). This variation signal ΔSi is divided by the variation-signal setting unit 62*b* into N step signals α (signal value=ΔSi/N), and the N step signals α are sequentially supplied to the opposing electrode 1221 in the i-th line at a predetermined time interval within one frame period.

In FIG. 24, the supply start time Ts of the step signals α is the time at which the image signal DATAi is supplied to the pixel electrodes 112 in the i-th line, the supply end time Te of the step signals α is the time immediately before an image signal in the subsequent frame is supplied to the pixel electrodes 112 in the i-th line, and the supply period of the step signals (Te-Ts) is one frame. However, the supply start time Ts and the supply end time Te of the step signals α may be any time within a period between the writing of the image signal to the pixel electrodes 112 in the i-th line and the writing of the image signal in the subsequent frame to the pixel electrodes 112 in the i-th line, and the supply interval of the step signals α can be set to an arbitrary interval. Also, the number of segments N of the variation signal ΔSi can be set to an arbitrary number.

Accordingly, the potential of the opposing electrode 1221 in the i-th line is changed stepwise to the same polarity as that of the image signal DATAi on the basis of the initial signal S0, thereby reducing the effective voltage between the electrodes 112 and 1221 by 0.1 (V) in one frame period. As a result, the brightness of an image in the i-th line is gradually increased in one frame period.

When the image signal DATA(i+1) is written into the pixel electrodes 112 in the (i+1)-th line while the potential of the pixel electrode 1221 in the i-th line is changed stepwisely, the potential of the opposing electrode 1221 in the (i+1)-th line is reset, and the initial signal S0 is supplied to the opposing electrode 1221. In steps F5 to F8, the potential of the opposing electrode 1221 in the (i+1)-th line is changed stepwise.

The above-described steps, F4 to F8, are sequentially performed on the image signal DATAi in each line to adjust the brightness of the image in each line.

The above-described steps, F1 to F8, are repeated to sequentially display frame images whose brightness has been adjusted in each line.

According to the display device of the fifth exemplary embodiment, the brightness of an image is adjusted in each line. Therefore, the contrast of a portion of an image can be adjusted, and an image whose portions differ in brightness can be displayed.

According to the display device, since a signal supplying unit stepwise (or continuously) supplies the variation signals to the hold capacitors in unit time, the brightness of an image is adjusted stepwise. Compared with a case in which the variation signals are supplied at the same time, discontinuity of images when the variation signals are supplied is smoothed, and the images are displayed more naturally.

Sixth Exemplary Embodiment

Figure 27:
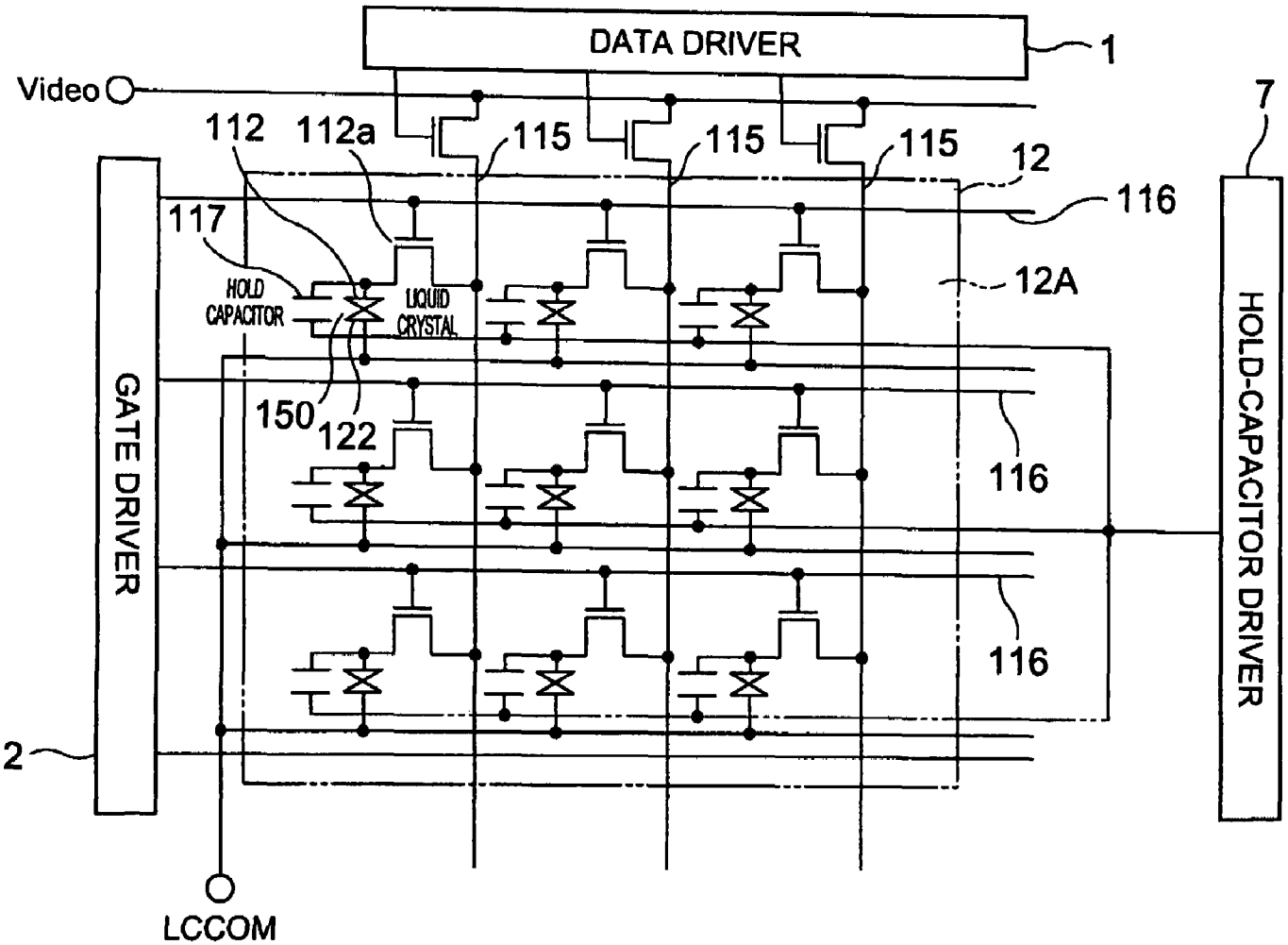
FIG. 27 is a circuit schematic of a display device according to a sixth exemplary embodiment of the present invention.
Figure 28:
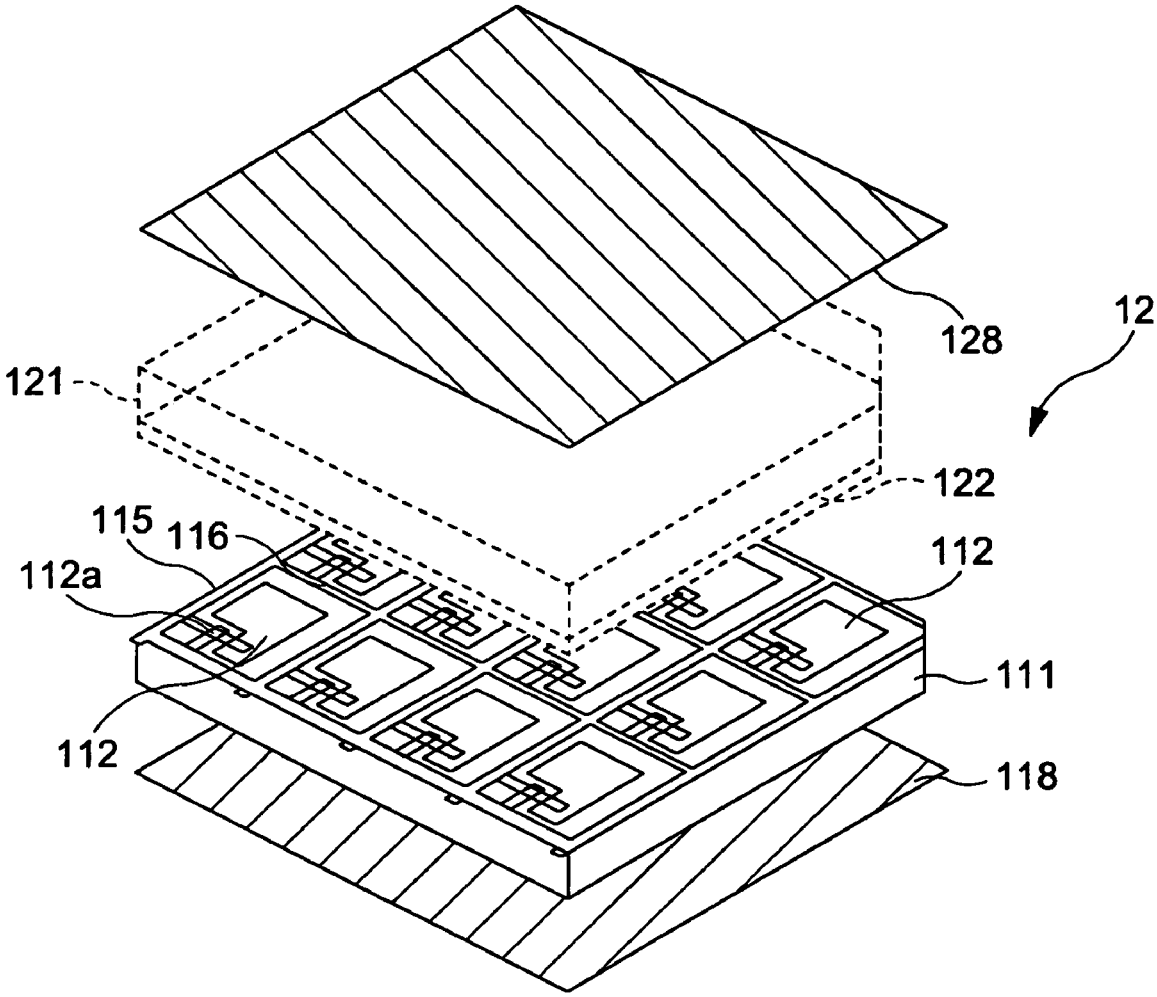
FIG. 28 is a perspective view of the schematic structure of the display device according to the sixth exemplary embodiment.
Figure 29:
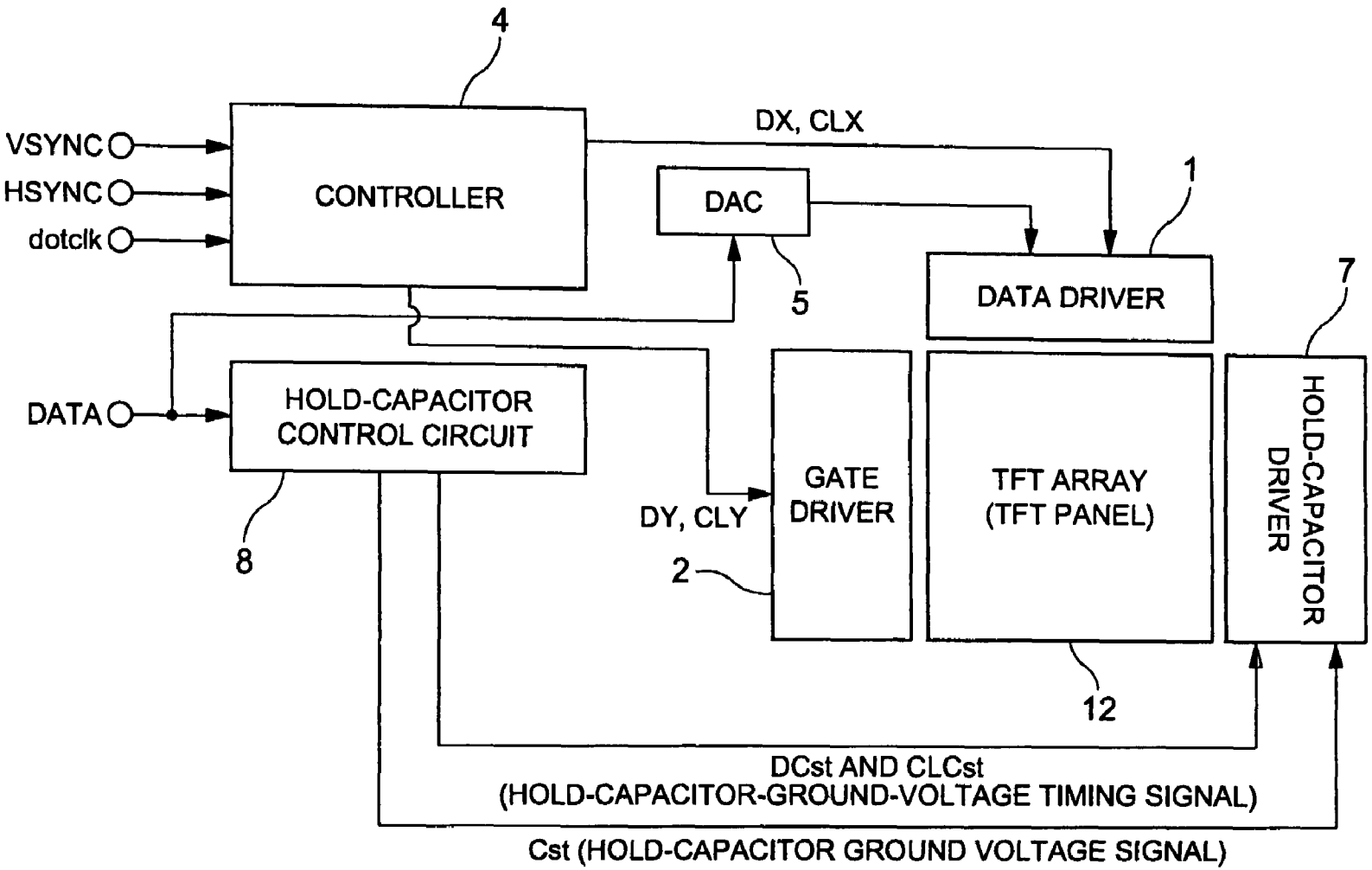
FIG. 29 is a block schematic of the circuit configuration of the display device according to the sixth exemplary embodiment.
Figure 30:
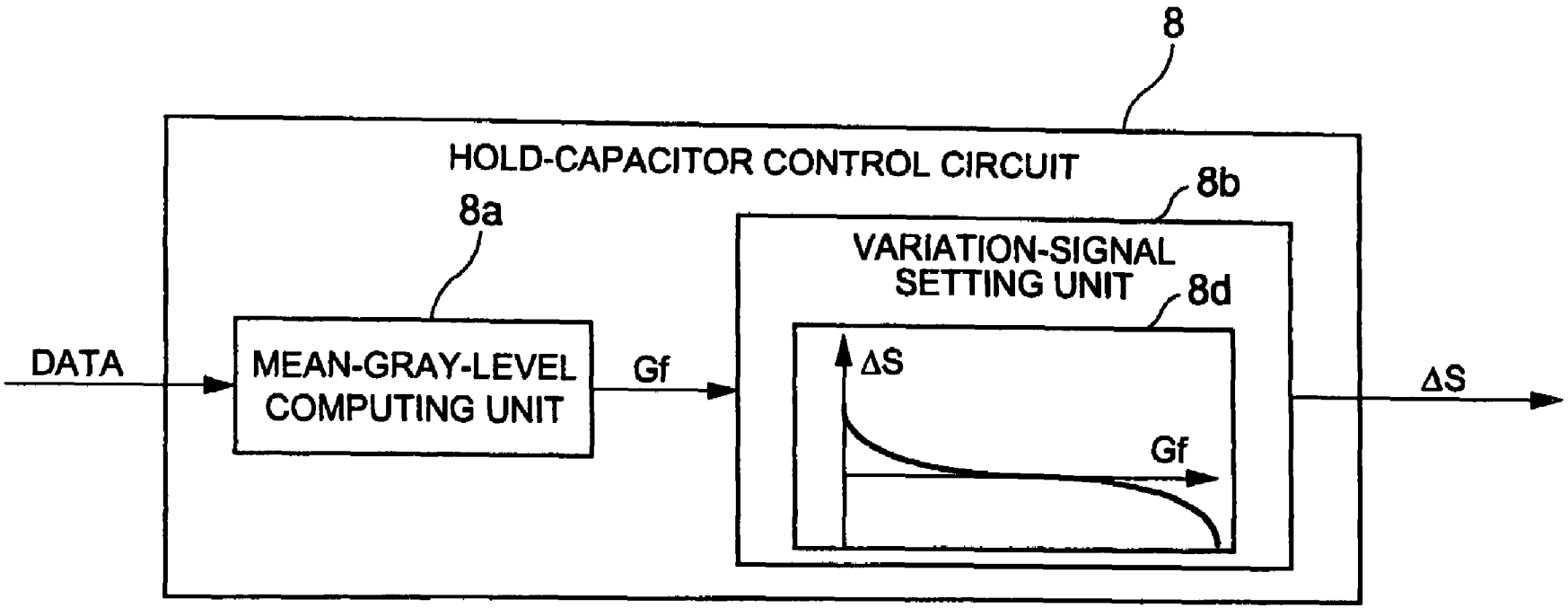
FIG. 30 is a block schematic of the main structure of a drive circuit according to the sixth exemplary embodiment.
Figure 31:
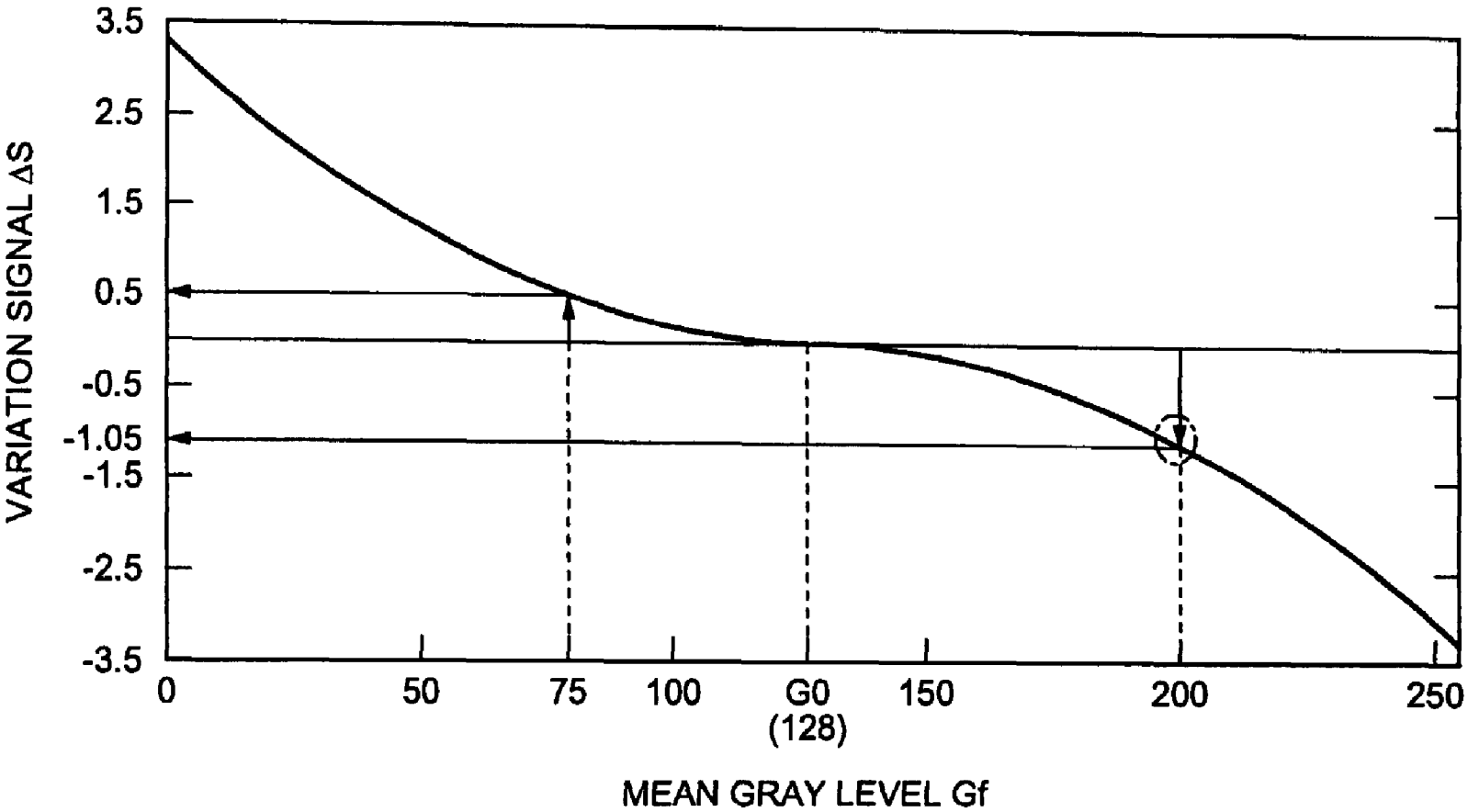
FIG. 31 is a graph describing a drive method according to the sixth exemplary embodiment.
Figure 32A:
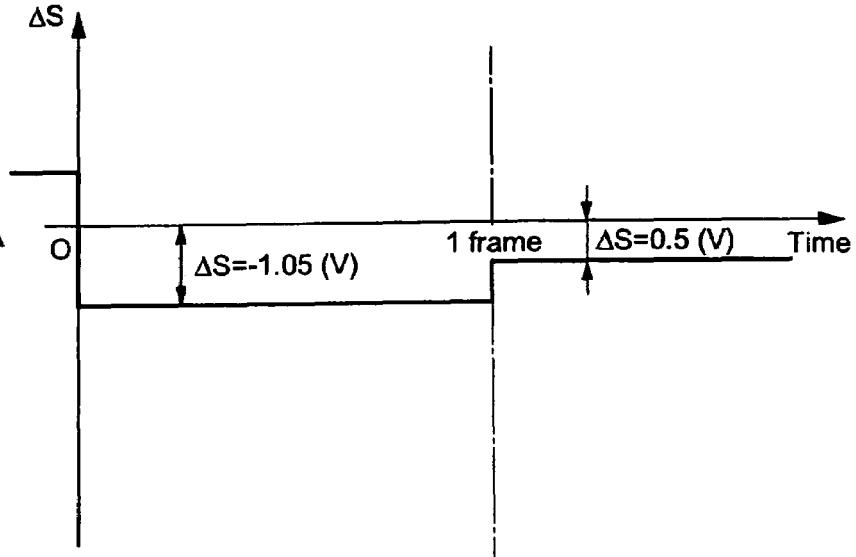
FIG. 32 includes schematics describing the drive method according to the sixth exemplary embodiment.
Figure 32B:
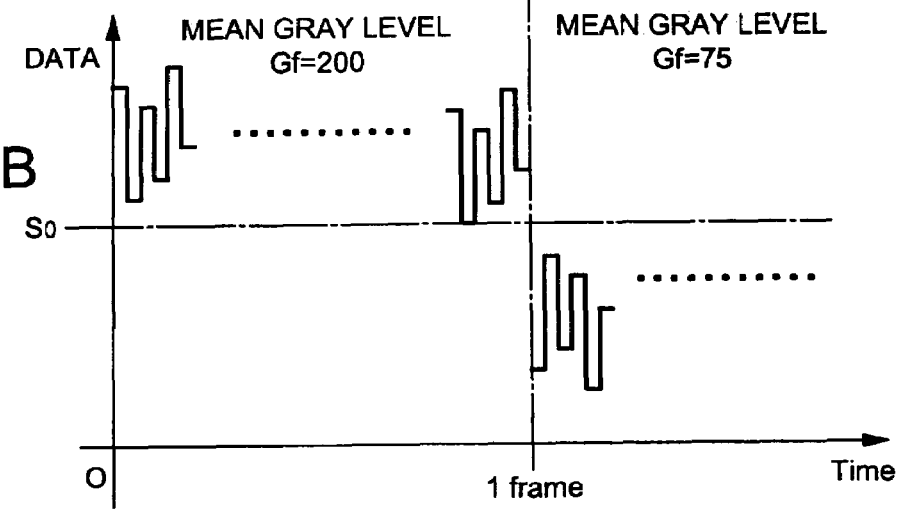
Figure 33:
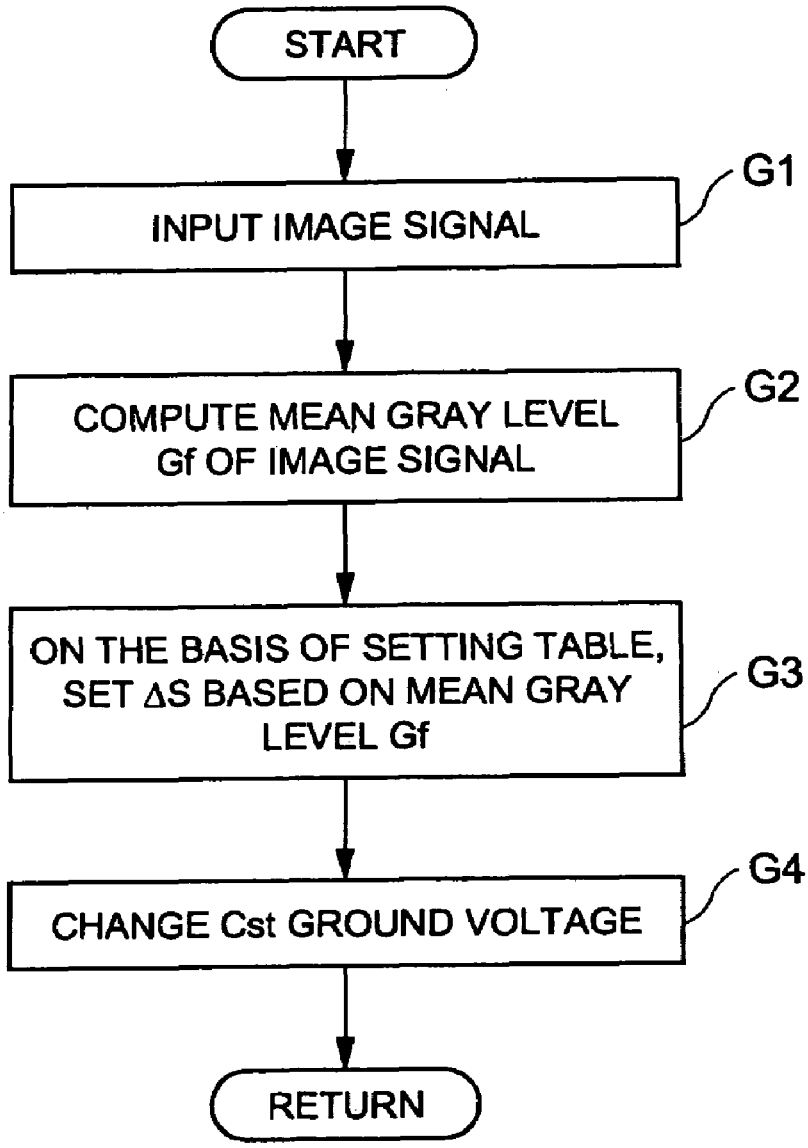
FIG. 33 is a flowchart describing the drive method according to the sixth exemplary embodiment.
Figure 34:
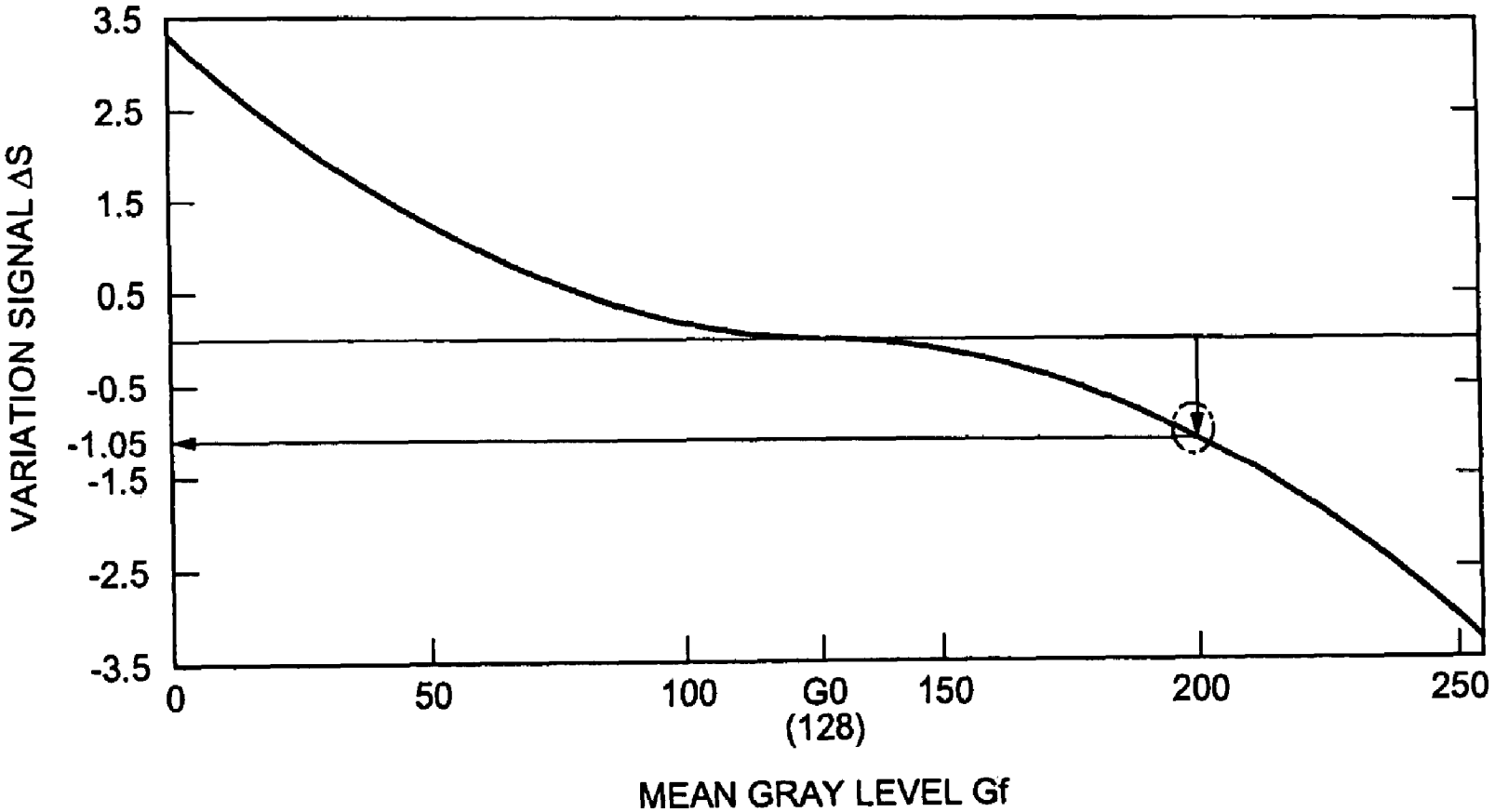
FIG. 34 is a graph describing a drive method according to a seventh exemplary embodiment of the present invention.

Referring to FIGS. 27 to 33, a display device according to a sixth exemplary embodiment of the present invention will now be described. FIG. 27 is a circuit schematic of the display device of the sixth exemplary embodiment. FIG. 28 is a perspective view of the schematic structure of the display device. FIG. 29 is a functional block schematic of the display device. FIG. 30 is a functional block schematic of the main structure of a drive circuit. FIGS. 31 to 33 illustrate a method of driving the display device. The same reference numerals are used to indicate the same parts and members as those of the first exemplary embodiment. In all figures, the film thickness and size ratio of elements are appropriately made different in order to make the figures clearer.

Referring to FIG. 27, the display device of the sixth exemplary embodiment is an active matrix liquid crystal device including a liquid crystal panel 12 provided with the switching elements (thin-film transistors; TFT) 112*a* associated with individual pixels, the data driver 1 and the gate driver 2, which drive these TFTs 112*a*, and a hold-capacitor driver 7.

Referring to FIGS. 27 and 28, the liquid crystal panel 12 includes the liquid crystal layer 150 held between the active matrix substrate 111 and the opposing substrate 121. The polarizers 118 and 128 are disposed on outer surfaces of the substrates 111 and 121, respectively.

A plurality of data lines 115 and a plurality of gate lines 116 are disposed in the X and Y directions, respectively, on the substrate 111. The data driver 1 and the gate driver 2 supply an image signal DATA and a gate signal to the data lines 115 and the gate lines 116, respectively, in accordance with synchronization signals CLX and CLY (see FIG. 29). Areas (pixel areas) defined by the lines 115 and 116 are individually provided with the pixel electrodes 112. The TFTs 112*a* disposed near the intersections of the lines 115 and 116 drive the corresponding pixel electrodes 112. The pixel areas are individually provided with hold capacitors 117 for holding the pixel electrodes 112 at a predetermined potential. These hold capacitors 117 are driven by the hold-capacitor driver 7 and adjust the potential of the pixel electrodes 112 by changing the voltage held.

The substrate 121, which is made of a transparent material, such as quartz, glass, or plastic, is provided with a transparent opposing electrode 122 made of ITO (indium tin oxide) or the like, and disposed on the entirety of a display area 12A.

Alignment films (not shown) are disposed on the outermost surfaces of the substrates 111 and 112, thereby defining the alignment of liquid crystal molecules when no voltage is applied. The light transmittance of the liquid crystal panel 12 when no voltage is applied is determined by a combination of the alignment directions of the alignment films and the directions of penetrating axes of the polarizers 118 and 128. In the sixth exemplary embodiment, for example, the structure of a normally white type is adopted.

Referring to FIG. 29, the data driver 1 is driven by the controller 4 in synchronization with the gate driver 2 and outputs the image signal DATA that has been converted by the DAC (digital-analog converter) 5 into an analog signal sequentially to the data lines 115 in one scanning period (H). By the gate driver 2, this image signal turns on (i.e., supplies a gate signal to) predetermined gate lines 116, thereby being sequentially written to the corresponding pixel electrodes 112.

In contrast, the hold-capacitor driver 7 is driven by a hold-capacitor control circuit 8 in synchronization with the drivers 1 and 2 and changes the ground voltage of the hold capacitors 117. The hold-capacitor driver 7 drives the liquid crystal layer 150 using the image signal DATA modulated by the hold capacitors 117.

To reduce or prevent the liquid crystal layer 150 from degrading, the liquid crystal layer 150 is AC-driven. Various methods may be employed to AC-drive the liquid crystal layer 150. These methods include, for example, an area inversion method of inverting the polarity of the image signal DATA in each frame and a line inversion method of inverting the polarity in each line.

Referring to FIG. 30, the hold-capacitor control circuit 8 is functionally provided with a mean-gray-level computing unit (first detector) 8*a* and a variation-signal setting unit 8*b*.

The mean-gray-level computing unit 8*a* computes the mean gray level Gf of the image signal DATA per unit time (e.g., one frame in the sixth exemplary embodiment) and detects the brightness of an image displayed in one frame.

The variation-signal setting unit 8*b* has a setting table 8*d* defining the relationship between the mean gray level Gf and the variation signal (the amount of change in the ground voltage of the hold capacitors 117) ΔS. The variation-signal setting unit 8*b* sets the variation signal ΔS on the basis of the mean gray level Gf computed by the mean-gray-level computing unit 8*a*. The variation signal ΔS is output via the hold-capacitor driver 7 to the hold capacitors 117.

In the setting table 8*d*, the gray level of the variation signal ΔS is defined so that the gray level of the effective voltage signal (effective signal) generated by modulating the image signal DATA using the variation signal ΔS becomes greater than the gray level of the image signal DATA. For example, in the setting table 8*d*, as shown in FIG. 31, the median of the maximum displayable gray levels serves as a reference gray level (second gray level) G0. When the mean gray level Gf is greater than the reference gray level G0, the polarity of the variation signal ΔS is set to the polarity opposite to that of the image signal DATA. When the mean gray level Gf is less than the reference gray level G0, the polarity of the variation signal ΔS is set to the same polarity as that of the image signal DATA. It is set so that, the larger the gray level difference ΔG (absolute value) between the mean gray level Gf and the reference gray level G0, the larger the voltage of the variation signal ΔS (absolute value |ΔS|) becomes. FIG. 31 shows, for example, a maximum of 255 gray levels and the median, that is, the 128-th gray level, serving as the reference gray level G0.

When the mean gray level Gf is greater than the reference gray level G0 (i.e., when the brightness of an image in one frame is greater than the reference brightness), the potential of each pixel electrode 112 is changed by |ΔS| toward the polarity opposite to that of the input image signal DATA, and the image is displayed more brightly. In contrast, when the mean gray level Gf is less than the reference gray level G0 (i.e., when the brightness of an image in one frame is less than the reference brightness), the potential of each pixel electrode 112 is changed by |ΔS| toward the same polarity as that of the image signal DATA, and the image is displayed more darkly. In other words, in the setting table 8*d*, the gray level of the variation signal is set so that, when the gray level difference ΔG is positive, the gray level of the effective signal becomes greater than the gray level of the image signal, and, when the gray level difference ΔG is negative, the gray level of the effective signal becomes less than the gray level of the image signal. As a result, a bright image is displayed more brightly, whereas a dark image is displayed more darkly.

Referring to FIGS. 31 to 33, a method of driving the display device will now be described. An example in which the display device is driven by the area inversion method is described below. FIG. 32 shows an example of the waveform of the image signal DATA and an example of the waveform of the variation signal ΔS.

When the image signal DATA is input from the external device in step G1, the image signal DATA is converted by the DAC 5 into an analog signal, and the analog signal is written via the data driver 1 into the pixel electrodes 112 of the liquid crystal panel 12.

The image signal DATA is also input to the hold-capacitor control circuit 8, and the mean-gray-level computing unit 8*a* computes the mean gray level Gf per frame (step G2).

On the basis of the setting table 8*d*, the variation signal ΔS is set on the basis of the mean gray level Gf (step G3), and the ground voltage of the hold capacitors 117 is changed by the variation signal ΔS by the hold-capacitor driver 7 (step G4).

For example, when the mean gray level Gf of the image signal DATA per frame is 200-th gray level (>reference gray level G0) (see the left side of FIG. 32(B)), the variation signal ΔS is set to −1.05 (V) on the basis of the setting table 8*d* (see FIG. 31). The hold-capacitor driver 7 changes the ground voltage of the hold capacitors 117 by 1.05 (V) toward the polarity opposite to that of the image signal DATA (see the left side of FIG. 31(A)). Accordingly, the effective voltage between the electrodes 112 and 122 is reduced, thereby displaying the entire image brightly.

When the image signal DATA whose mean gray level Gf is 75-th gray level (<reference gray level G0) is supplied in the subsequent frame (see the right side of FIG. 32(B)), the variation signal ΔS is set to 0.5 (V) on the basis of the setting table 8*d* (see FIG. 31). The hold-capacitor driver 7 changes the ground voltage of the hold capacitors 117 by 0.5 (V) to the same polarity as that of the image signal DATA (see the right side of FIG. 32(A)). Accordingly, the effective voltage between the electrodes 112 and 122 is increased, thereby displaying the entire image darkly. Since the polarity of the image signal DATA is inverted in the subsequent frame, a direction in which the holding voltage is changed is opposite to that of the previous frame.

The above-described steps, G1 to G4, are repeated to sequentially display images whose overall brightness has been adjusted.

According to the display device of the sixth exemplary embodiment, the brightness is adjusted while displaying images in frames, thereby displaying high contrast images in frames (i.e., images differing in brightness).

According to the sixth exemplary embodiment, since the hold capacitors 117 disposed on the active matrix substrate 111 are driven, the driver 7 is disposed on the active matrix substrate 111. The fabrication is simplified, and the cost is reduced. According to the structures of the foregoing first to fifth exemplary embodiments, in which each opposing electrode 122 (1221) is driven, a second signal supplying unit that supplies variation signals to each opposing electrode 122 must be disposed on the opposing substrate 121. Since drive circuits (first and second signal supplying units) are disposed on both the active matrix substrate and the opposing substrate, the manufacturing cost may be increased. In contrast, according to the present structure, since the drive circuits may be collectively disposed on the active matrix, the present structure is advantageous in terms of cost.

Seventh Exemplary Embodiment

Referring to FIGS. 34 to 37, a display device according to a seventh exemplary embodiment of the present invention will now be described. Since this display device has the same structure as that of the sixth exemplary embodiment, FIGS. 27 to 30 are used unchanged, and a description of the structure of the display device is omitted.

The seventh exemplary embodiment is a modification of the display-device driving method of the sixth exemplary embodiment. The holding voltage of each hold capacitor 117 is gradually changed within unit time (e.g., one frame period).

Specifically, according to the seventh exemplary embodiment, when the image signal DATA is input from the external device in step H1, the image signal DATA is converted by the DAC 5 into an analog signal, and the analog signal is written via the data driver 1 into the pixel electrodes 112 of the liquid crystal panel 12.

When the image signal DATA is also input to the hold-capacitor control circuit 8, the ground voltage of the hold capacitors 117 is reset (step H2).

The mean-gray-level computing unit (first detector) 8*a* computes the mean gray level Gf per frame (step H3). On the basis of the setting table 8*d*, the variation-signal setting unit 8*b* sets the variation signal ΔS based on the mean gray level Gf (step H4).

In a step-signal supplying routine (step H5), this variation signal ΔS is divided into a plurality of (e.g., N) step signals (step H51). The step signals are sequentially supplied via the hold-capacitor driver 7 to the hold capacitors 117 at a predetermined time interval (e.g., in each H) (steps H52 to H55).

Figures 35A, 35B:
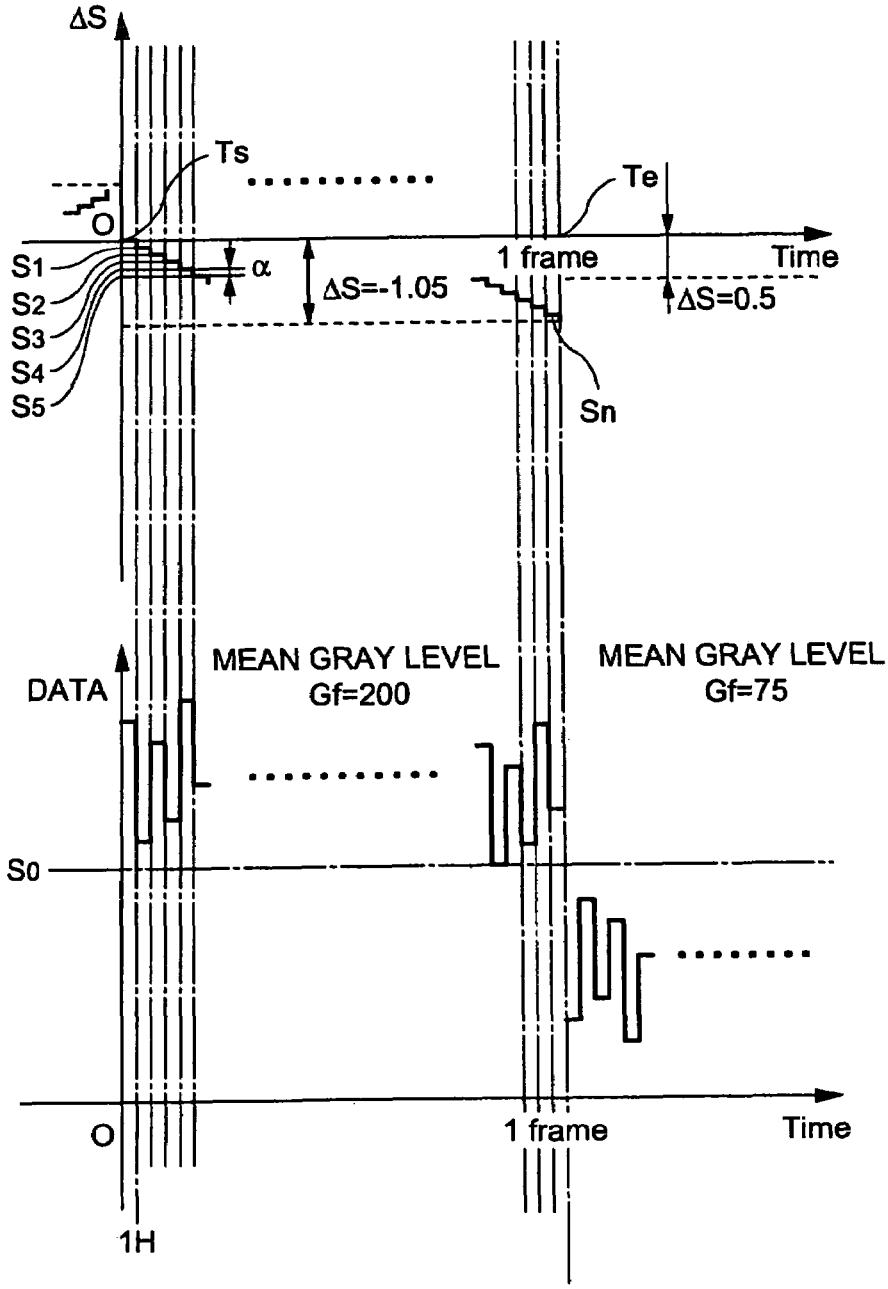
FIG. 35 includes schematics describing the drive method according to the seventh exemplary embodiment.
Figure 36:
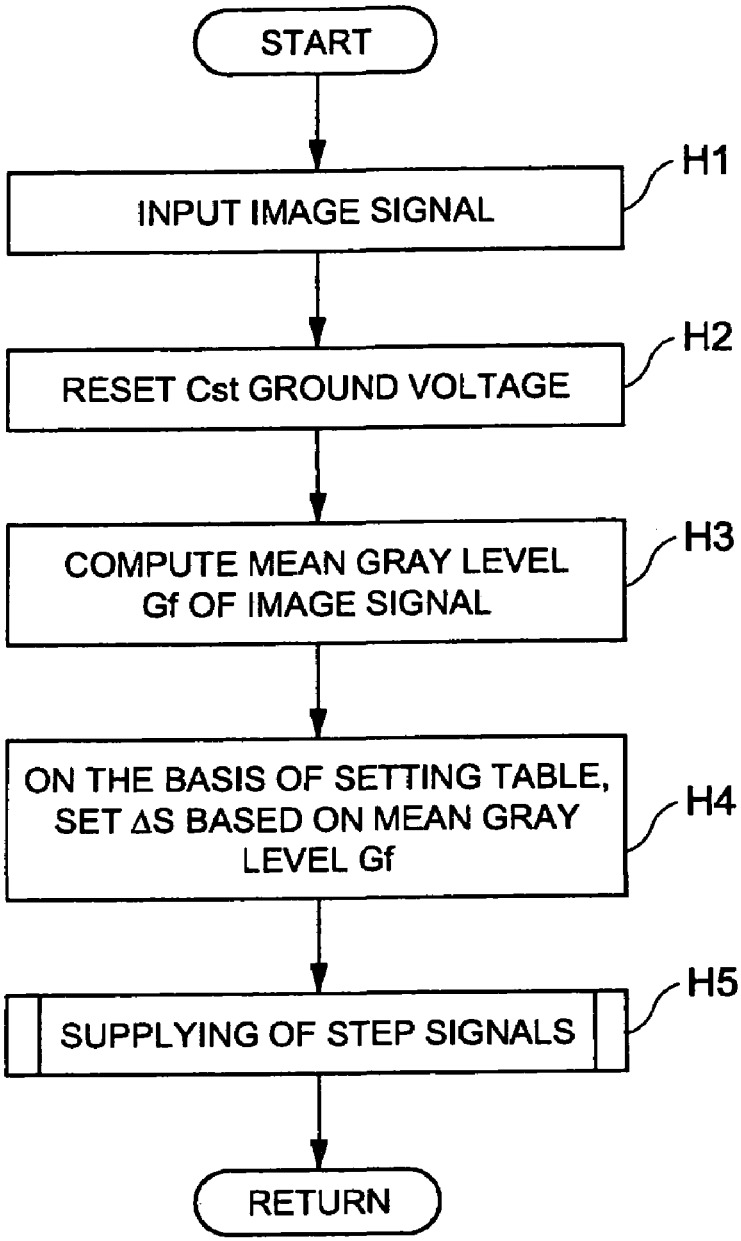
FIG. 36 is a flowchart describing the drive method according to the seventh exemplary embodiment.
Figure 37:
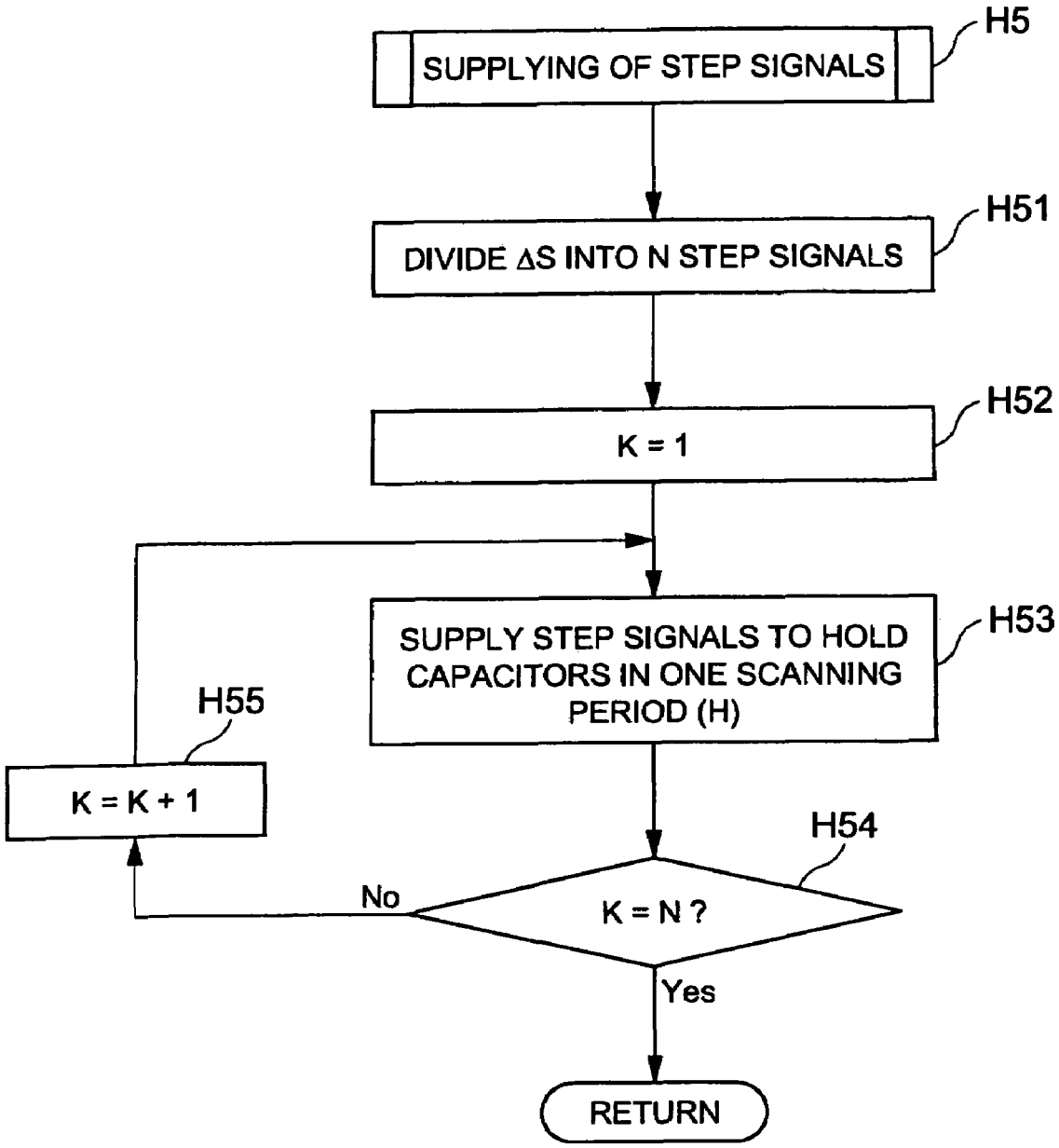
FIG. 37 is a flowchart describing the drive method according to the seventh exemplary embodiment.

FIG. 35 shows an example of the waveform of the image signal DATA and an example of the waveform of the variation signal ΔS. For example, when the mean gray level Gf of the image signal DATA per frame is 200-th gray level (>reference gray level G0) (see the left side of FIG. 35(B)), the variation signal ΔS is set to −1.05 (V) on the basis of the setting table 8*d* (see FIG. 34). This variation signal ΔS is divided by the variation-signal setting unit 8*b* into N step signals α (signal value=ΔS/N), and the step signals α are sequentially supplied to the hold capacitors 117 at a predetermined time interval within one frame period.

In FIG. 35, the supply start time Ts of the step signals α is the writing start time of the image signal DATA, and the supply end time Te of the step signals α is the time after unit time (one frame period in the seventh exemplary embodiment) passes. However, the supply start time Ts and the supply end time Te may be any time within unit time, and the number of segments N of the variation signal ΔS and the supply interval of the step signals α may be arbitrarily set. Accordingly, the effective voltage between the electrodes 112 and 122 is reduced by 1.05 (V) within one frame period, and the brightness of an image is gradually increased in one frame period.

When the image signal DATA in the subsequent frame is input, the holding voltage is reset again. The mean-gray-level computing unit 8*a* computes the mean gray level Gf. When this mean gray level Gf is, for example, 75-th gray level (<reference gray level G0) (see the right side of FIG. 35(B)), the variation signal ΔS is set to 0.5 (V) on the basis of the setting table 8*d* (see FIG. 34). This variation signal ΔS is divided by the variation-signal setting unit 8*b* into N step signals α, and the step signals α are sequentially supplied to the hold capacitors 117 at a predetermined time interval in one frame period. Accordingly, the effective voltage between the electrodes 112 and 122 is increased by 0.5 (V) within one frame period, and the brightness of an image is gradually reduced in one frame period.

The above-described steps, H1 to H5, are repeated to sequentially display images whose overall brightness has been adjusted.

According to the display device of the seventh exemplary embodiment, the contrast is adjusted while displaying images in frames, thereby displaying images differing in brightness among frames.

According to the display device, the brightness of an image is adjusted stepwise. Compared with a case in which the variation signals are supplied at the same time to suddenly change the display, discontinuity of images when the variation signals are supplied is smoothed, and the images are displayed more naturally.

According to the display device, the ground voltage of the hold capacitors 117 is reset at the time the variation signal is supplied to the hold capacitors 117 (i.e., a series of step signals α is supplied). This facilitates driving. If the hold capacitors 117 are not reset, in order to achieve a desired holding voltage, for example, the variation signal ΔS set in the previous frame must be stored in a memory, and the difference between this variation signal ΔS and the variation signal ΔS' set in the subsequent frame must be supplied to the hold capacitors 117. However, when the holding voltage is reset in each frame, the newly computed variation signal ΔS is simply supplied to the hold capacitors 117. The foregoing complicated processing is thus unnecessary.

Eighth Exemplary Embodiment

Figure 38:
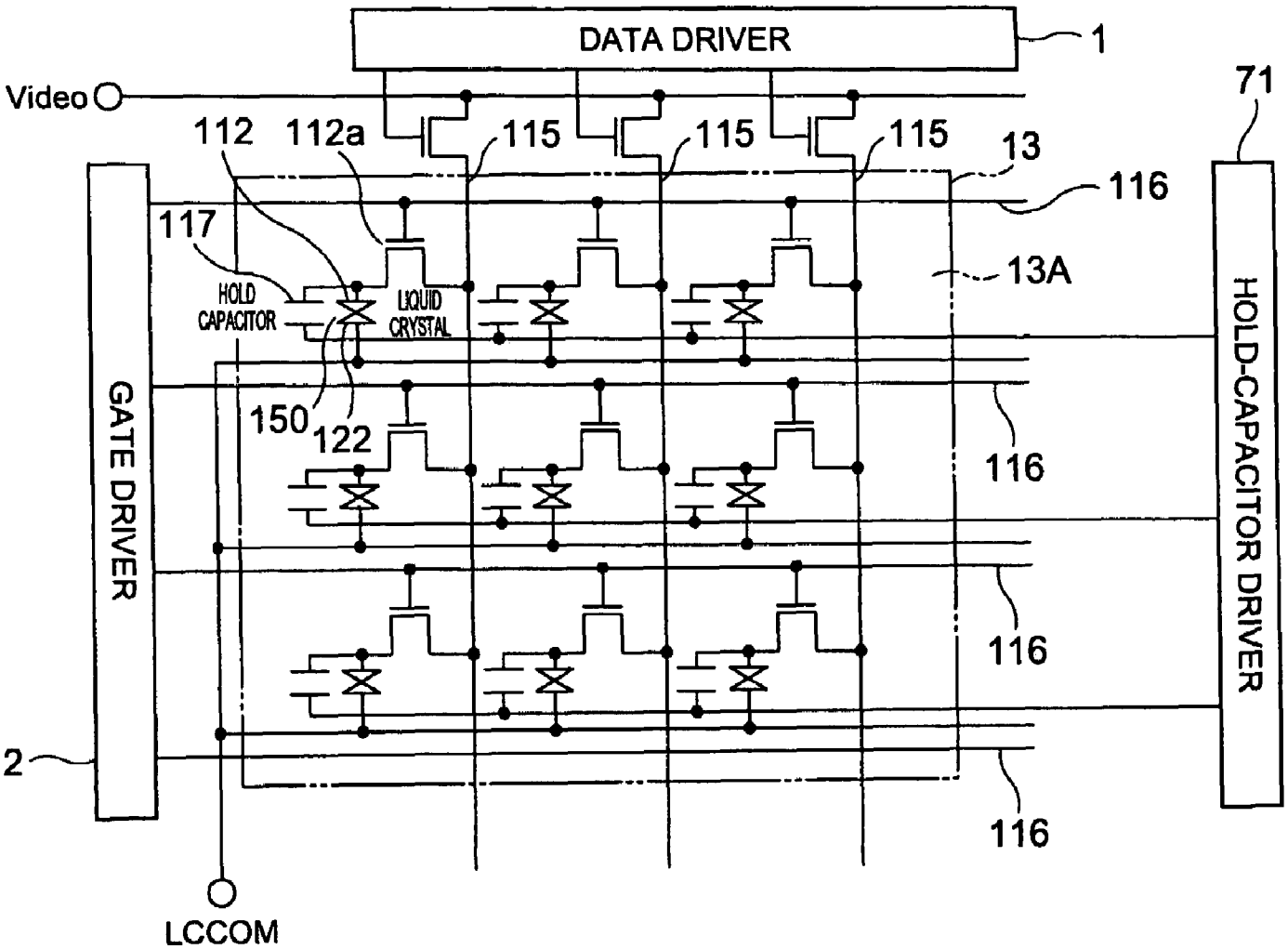
FIG. 38 is a circuit schematic of a display device according to an eighth exemplary embodiment of the present invention.
Figure 39:
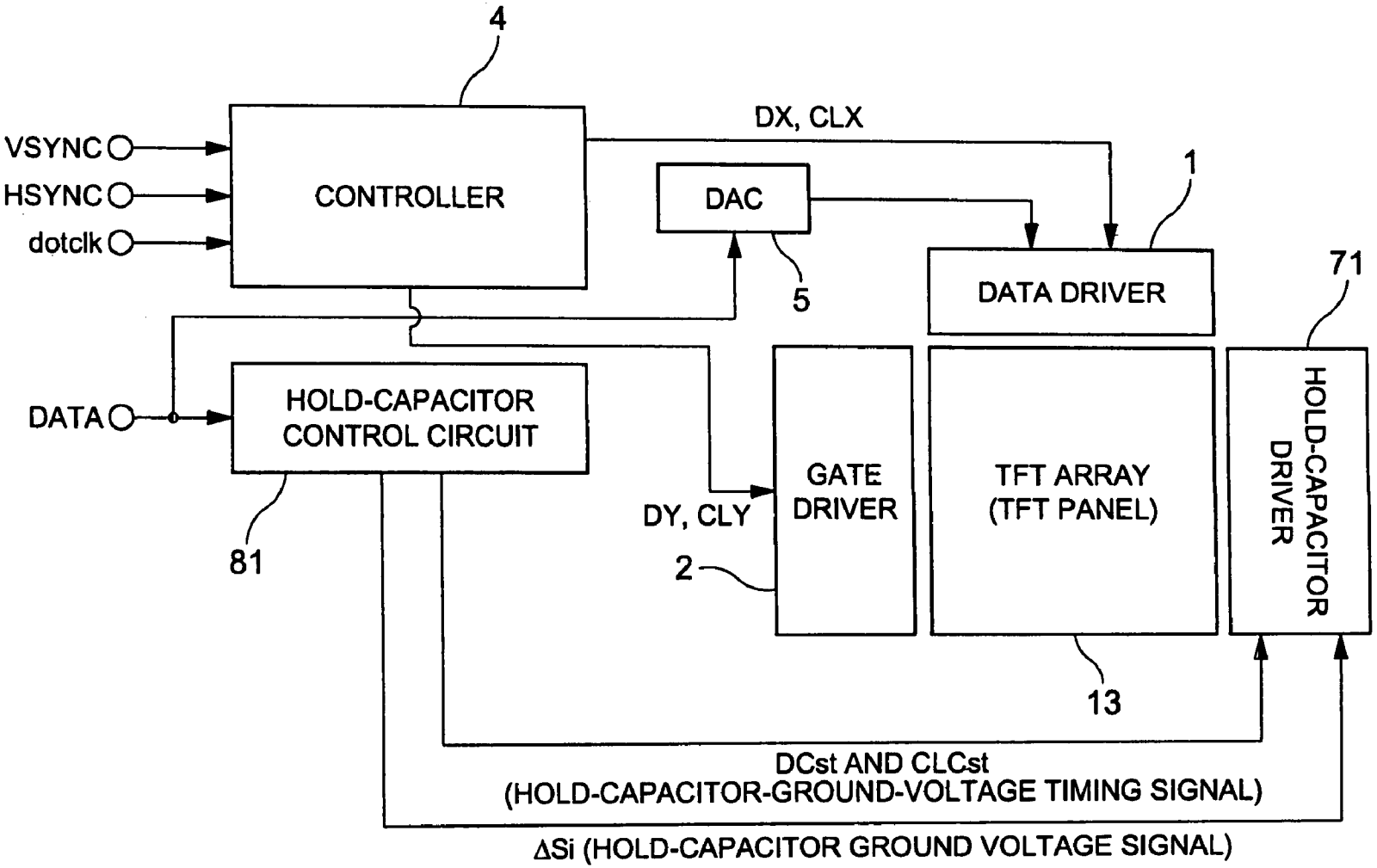
FIG. 39 is a block schematic of the circuit configuration of the display device according to the eighth exemplary embodiment.
Figure 40:
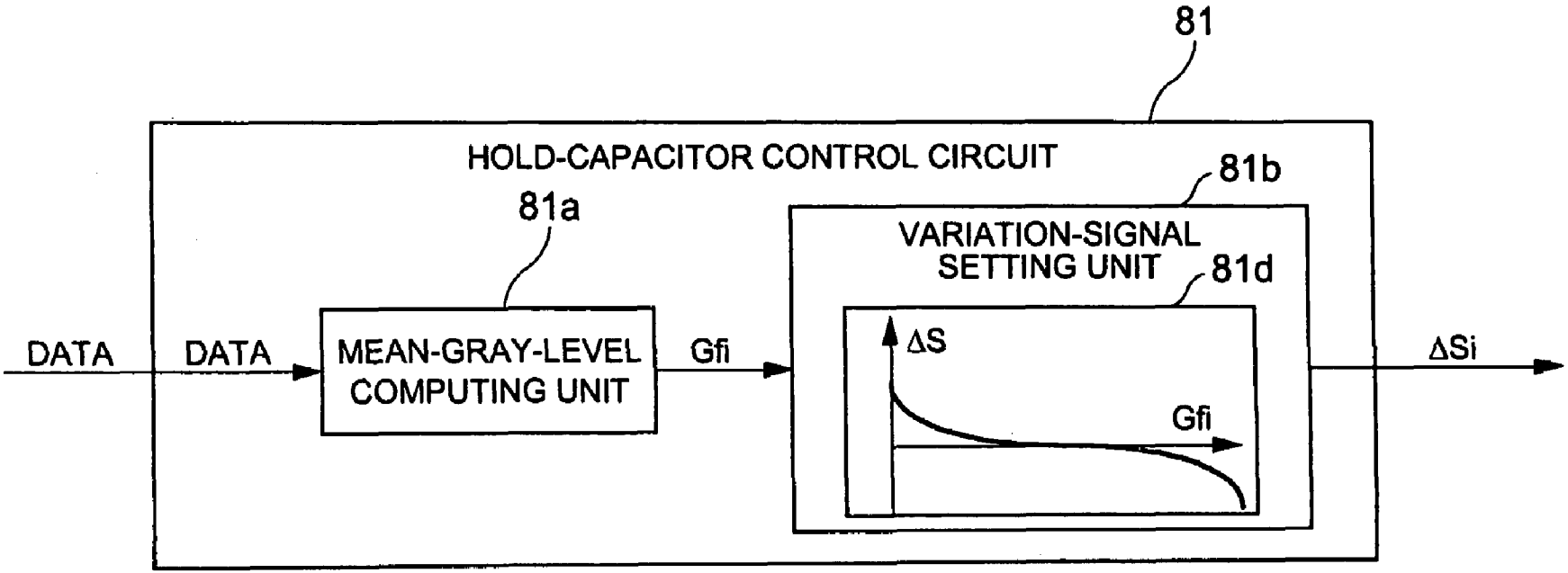
FIG. 40 is a block schematic of the main structure of a drive circuit according to the eighth exemplary embodiment.
Figure 41:
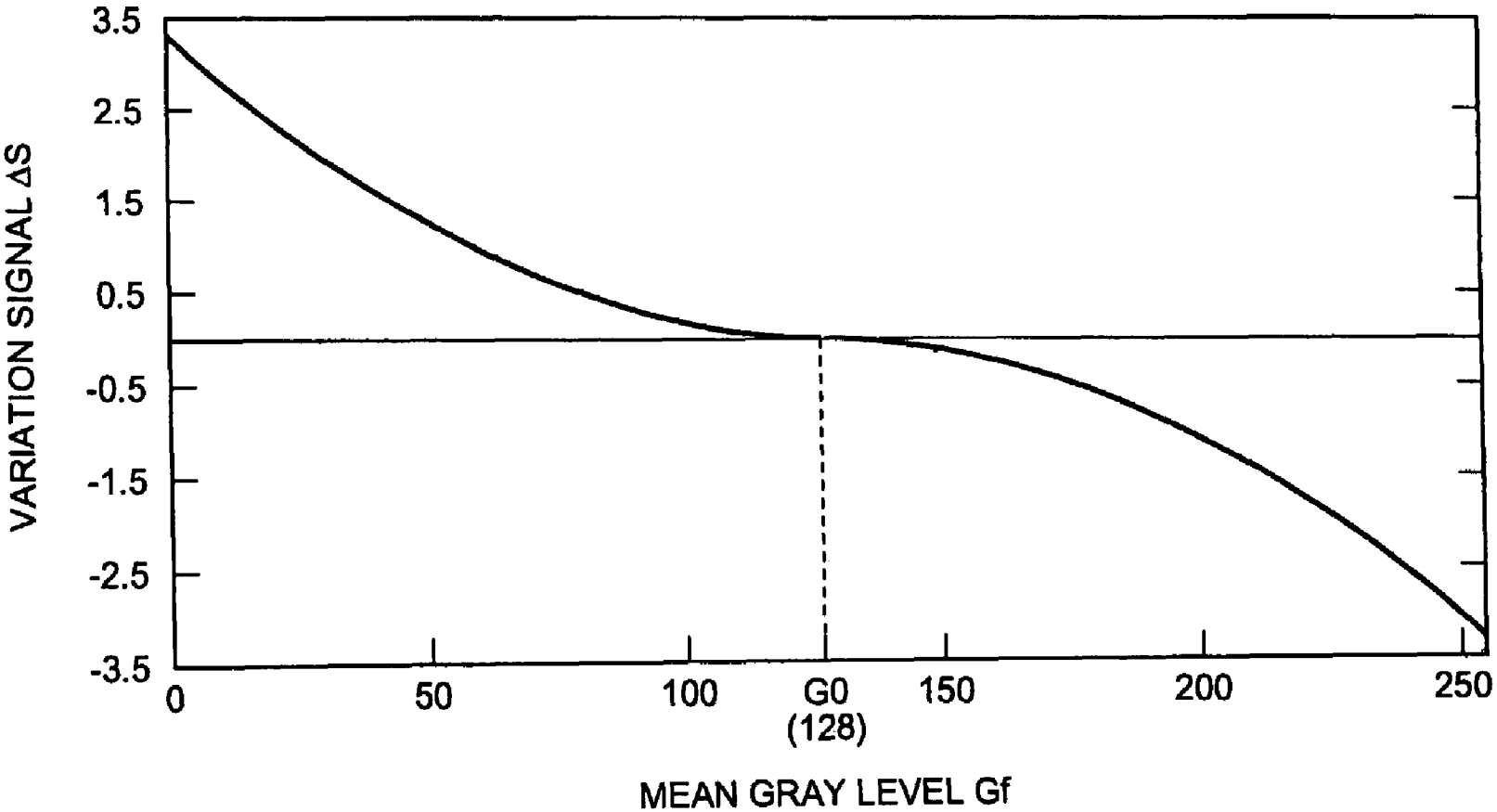
FIG. 41 is a graph describing a drive method according to the eighth exemplary embodiment.
Figures 42A, 42B:
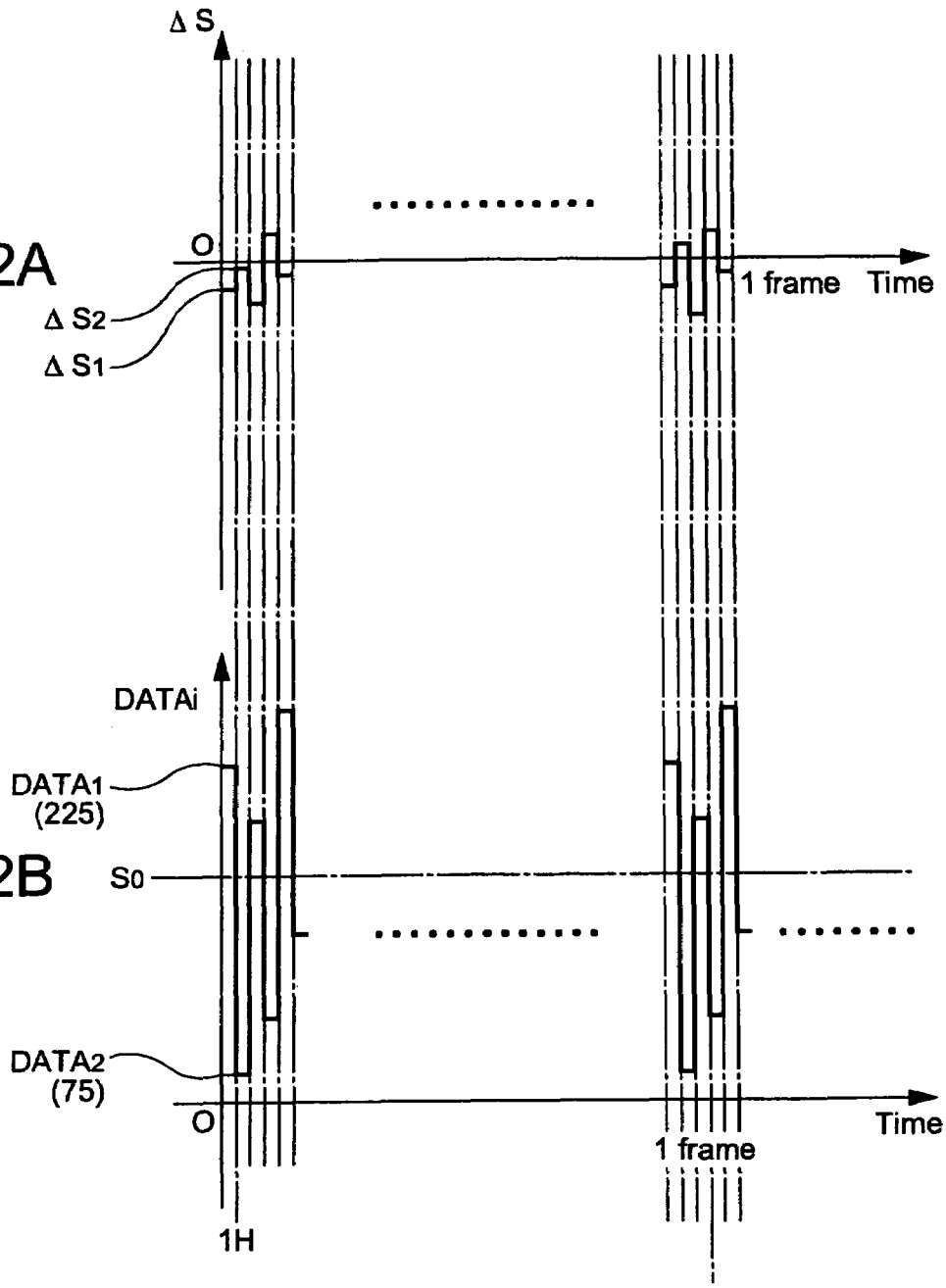
FIGS. 42(A) and 42(B) includes schematics describing the drive method according to the eighth exemplary embodiment.
Figure 43:
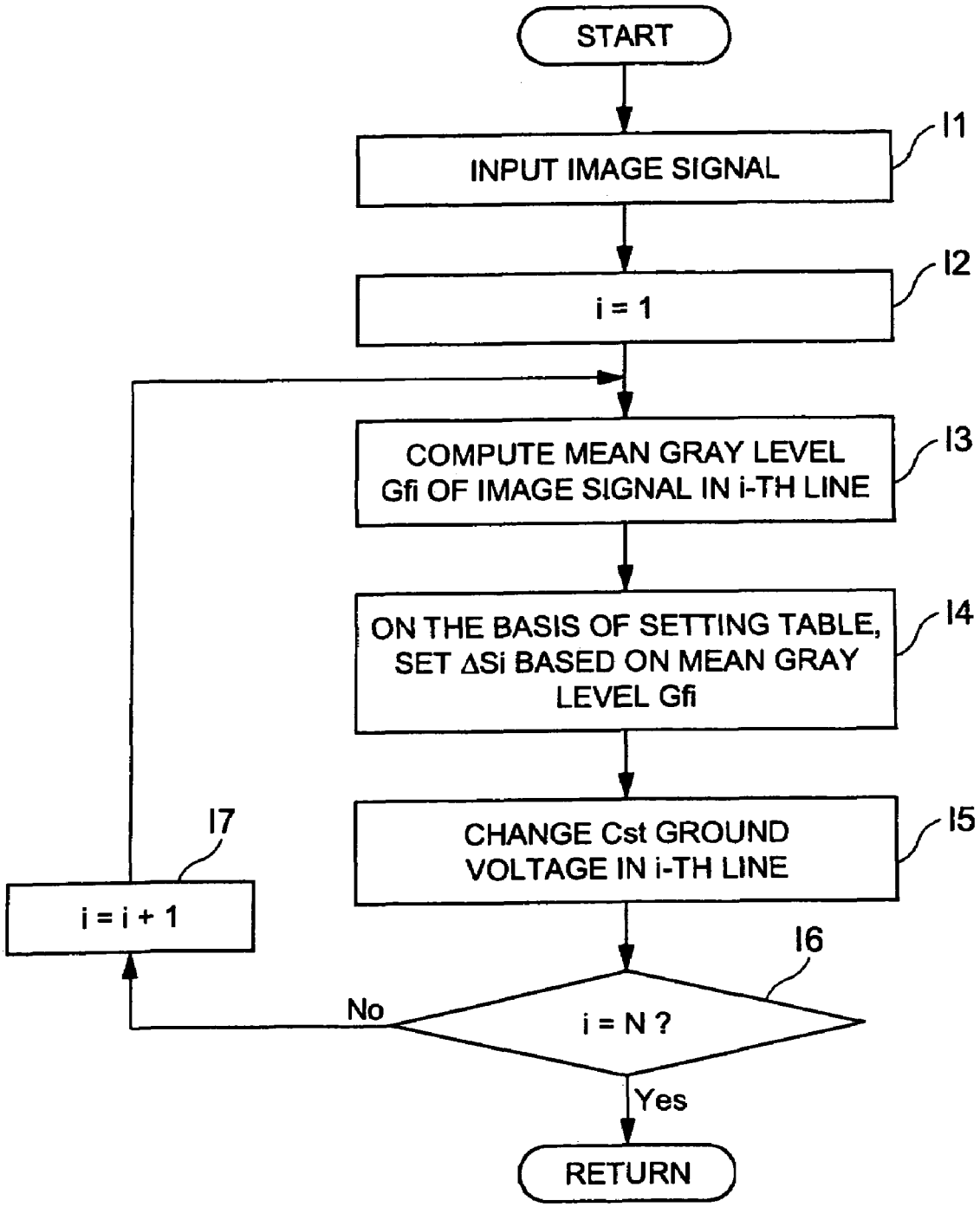
FIG. 43 is a flowchart describing the drive method according to the eighth exemplary embodiment.

Referring to FIGS. 38 to 43, a display device according to an eighth exemplary embodiment of the present invention will now be described. FIG. 38 is a circuit schematic of the display device of the eighth exemplary embodiment. FIG. 39 is a functional block schematic of the display device. FIG. 40 is a functional block schematic of the main structure of a drive circuit. FIGS. 41 to 43 illustrate a method of driving the display device. The same reference numerals are used to indicate the same parts and members as those of the sixth exemplary embodiment, and descriptions thereof are omitted. FIG. 27 is used unchanged.

Referring to FIG. 38, the display device of the eighth exemplary embodiment is an active matrix liquid crystal device including a liquid crystal panel 13 provided with the switching elements (thin-film transistors; TFT) 112*a* associated with individual pixels, the data driver 1 and the gate driver 2, which drive these TFTs 112*a*, and a hold-capacitor driver 71.

Referring to FIGS. 38 and 28, the liquid crystal panel 13 includes the liquid crystal layer 150 held between the active matrix substrate 111 and the opposing substrate 121. The polarizers, 118 and 128, are disposed on outer surfaces of the substrates 111 and 121, respectively.

A plurality of data lines 115 and a plurality of gate lines 116 are disposed in the X and Y directions, respectively, on the substrate 111. The data driver 1 and the gate driver 2 supply an image signal DATA and a gate signal to the data lines 115 and the gate lines 116, respectively, in accordance with synchronization signals CLX and CLY (see FIG. 39). Areas (pixel areas) defined by the lines 115 and 116 are individually provided with the pixel electrodes 112. The TFTs 112*a* disposed near the intersections of the lines 115 and 116 drive the corresponding pixel electrodes 112.

The pixel areas are individually provided with hold capacitors 1171 for holding the pixel electrodes 112 at a predetermined potential. The hold capacitors 1171 arranged in a matrix are divided into a plurality of blocks. These blocks of hold capacitors 1171 are driven independently. The hold capacitors 1171 belonging to each block are set to a common holding voltage. According to the eighth exemplary embodiment, for example, one block consists of the hold capacitors 1171 in one line along the gate line 116. The blocks, the number of which is the same as the number of gate lines 116 N, are driven independently by the hold-capacitor driver 71.

The hold-capacitor driver 71 is driven by a hold-capacitor control circuit 81 in synchronization with the drivers 1 and 2 and supplies the variation signal ΔSi (i=1 to N) to the hold capacitors 1171 in each line. The liquid crystal layer 150 is driven by the image signal DATAi (i=1 to N) modulated by the hold capacitors 1171.

Referring to FIG. 40, the hold-capacitor control circuit 81 is functionally provided with a mean-gray-level computing unit (first detector) 81*a* and a variation-signal setting unit 8*b*.

The mean-gray-level computing unit 81*a* computes the mean gray level Gfi (i=1 to N) of the image signal DATAi (i=1 to N) supplied to the pixel electrodes 112 in each line per unit time (e.g., one frame in the eighth embodiment) and detects the brightness of an image in each line.

The variation-signal setting unit 81*b* has a setting table 81*d* defining the relationship between the mean gray level Gf and the variation signal ΔS. The variation-signal setting unit 81*b* sets the variation signal ΔSi (i=1 to N) in each line on the basis of the mean gray level Gfi computed by the mean-gray-level computing unit 81*a*. The variation signal ΔSi is output via the hold-capacitor driver 71 to the hold capacitors 1171 in the corresponding line.

In the setting table 81*d*, as in the sixth exemplary embodiment, the median of the maximum displayable gray levels serves as a reference gray level (second gray level) G0. When the mean gray level Gf is greater than the reference gray level G0, the polarity of the variation signal ΔS is set to the polarity opposite to that of the image signal DATA. When the mean gray level Gf is less than the reference gray level G0, the polarity of the variation signal ΔS is set to the same polarity as that of the image signal DATA. It is set that, the larger the gray level difference ΔG (absolute value) between the mean gray level Gf and the reference gray level G0, the larger the voltage of the variation signal ΔS (absolute value |ΔS|) becomes (see FIG. 42).

Since portions excluding this part are arranged in the same manner as those of the sixth exemplary embodiment, descriptions thereof are omitted.

Referring to FIGS. 41 to 43, a method of driving the display device will now be described. An example in which the display device is driven by the line inversion method is described below. FIG. 42 shows an example of the waveform of the image signal DATA and an example of the waveform of the opposing electrode signals CDATA. FIG. 42(B) shows the waveform of the mean gray level Gfi of the image signal DATAi (i=1 to N) supplied to the pixel electrodes 112 in each line in one scanning period.

When the image signal DATA is input from the external device in step I1, the image signal DATA is converted by the DAC 5 into an analog signal, and the analog signal is written via the data driver 1 into the pixel electrodes 112 of the liquid crystal panel 13.

When the image signal DATA is also input to the hold-capacitor control circuit 81, the mean-gray-level computing unit 81*a* computes the mean gray level Gfi (i=1 to N) of the image signal DATAi (i=1 to N) in each line per frame (step I3).

On the basis of the setting table 81*d*, the variation signal ΔSi (i=1 to N) in each line is set on the basis of the mean gray level Gfi (i=1 to N) (step I4). The hold-capacitor driver 71 changes the ground voltage of the hold capacitors 1171 in the corresponding block (i.e., in the i-th line) (step I5).

The above-described steps I3 to I5 are sequentially performed on the image signal DATAi (i=1 to N) in each line, thereby adjusting the brightness of an image in each line.

For example, when the mean gray level Gf1 of the image signal DATA1 in the first line is 225-th gray level (>reference gray level G0) (see the first line of FIG. 42(B)), the variation signal ΔS1 is set to −1.5 (V) on the basis of the setting table 81*d* (see FIG. 41). The hold-capacitor driver 71 changes the ground voltage of the hold capacitors 1171 in the first line by 1.5 (V) toward the polarity opposite to that of the image signal DATA (see the first line of FIG. 42(A)). Accordingly, the effective voltage between the electrodes, 112 and 122, is reduced, thereby brightly displaying an image in the first line.

At the same time, when the mean gray level Gf2 of the image signal DATA2 in the second line is 75-th gray level (<reference gray level G0) (see the second line of FIG. 42(B)), the variation signal ΔS2 is set to 0.5 (V) on the basis of the setting table 81*d* (see FIG. 41). The hold-capacitor driver 71 changes the ground voltage of the hold capacitors 1171 in the second line by 0.5 (V) to the same polarity as that of the image signal DATA (see the second line of FIG. 42(A)). Accordingly, the effective voltage between the electrodes 112 and 122 in the second line is increased, thereby darkly displaying an image in the second line. Since the polarity of the image signal DATA2 is inverted in the second line, a direction in which the holding voltage is changed is opposite to that of the previous line.

The above-described steps I1 to I7 are repeated to sequentially display frame images whose brightness in each line has been adjusted.

According to the display device of the eighth exemplary embodiment, the brightness of an image in each line is adjusted. Therefore, the contrast of a portion of an image can be adjusted, and an image whose portions differ in brightness can be displayed.

Ninth Exemplary Embodiment

Referring to FIGS. 44 to 47, a display device according to a ninth exemplary embodiment of the present invention will now be described. In the following description, where necessary, FIGS. 38 and 39 are used unchanged.

The ninth exemplary embodiment is a modification of the drive method of the eighth exemplary embodiment. The variation signal ΔS is defined on the basis of the gray level difference ΔG between the mean gray level Gf of the image signal DATA per unit time and the mean gray level Gfi (i=1 to N) of the image signal DATAi (i=1 to N) in each line.

Figure 44:
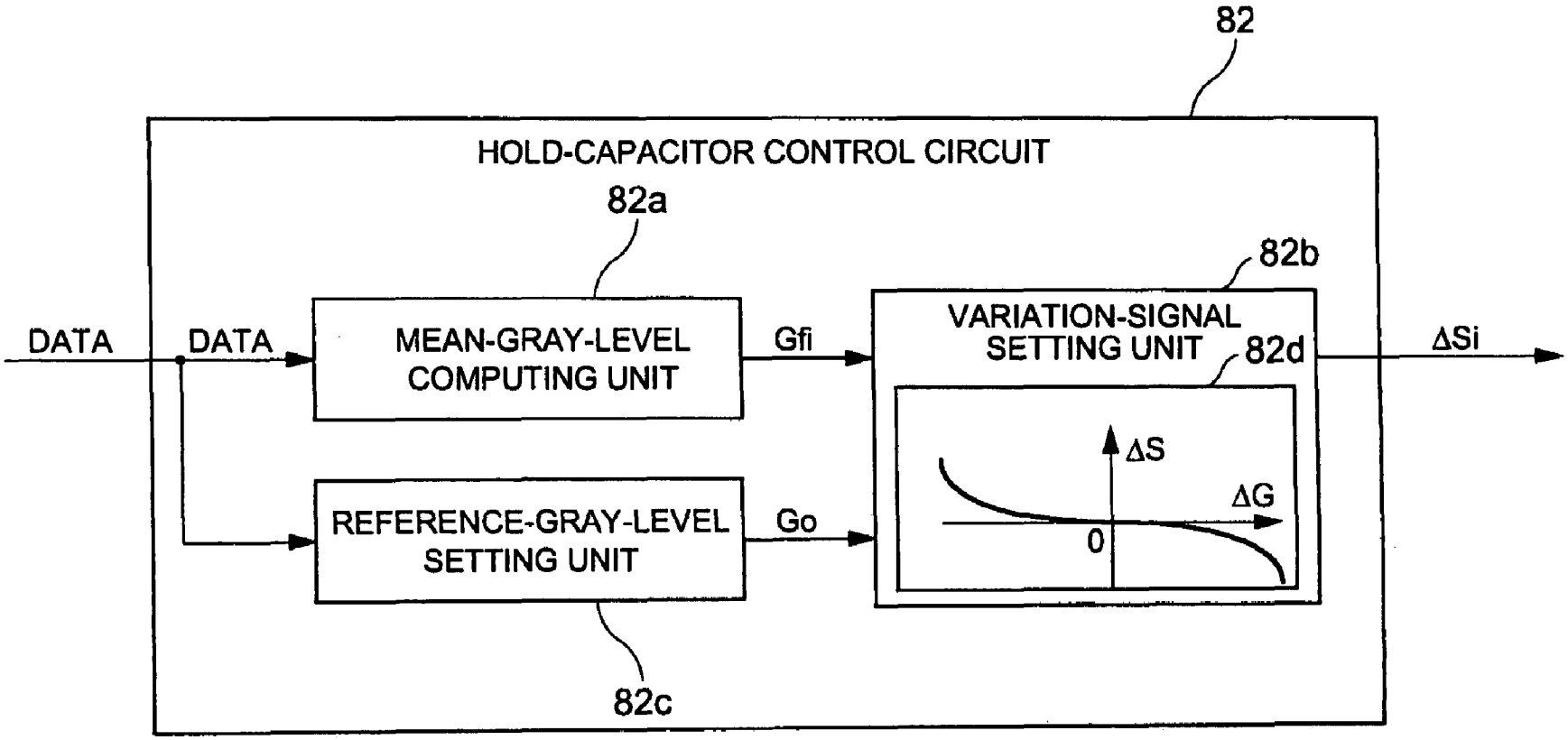
FIG. 44 is a block schematic of the main structure of a drive circuit according to a ninth exemplary embodiment of the present invention.

Referring to FIG. 44, a hold-capacitor control circuit 82 in this embodiment is functionally provided with a mean-gray-level computing unit (first detector) 82*a*, a variation-signal setting unit 82*b*, and a reference-gray-level setting unit (second detector) 82*c*.

The mean-gray-level computing unit 82*a* computes the mean gray level Gfi (i=1 to N) of the image signal DATAi (i=1 to N) supplied to the pixel electrodes 112 in each line per unit time (e.g., one frame in the ninth exemplary embodiment) and detects the brightness of an image in each line.

The reference-gray-level setting unit 82*c* computes the mean gray level Gf of the image signal DATA per unit time and outputs the mean gray level Gf serving as a reference gray level (second gray level) G0.

The variation-signal setting unit 82*b* has a setting table 82*d* defining the relationship of the gray level difference ΔG between the mean gray level Gfi (i=1 to N) in each line and the reference gray level G0 with the variation signal ΔS. On the basis of the mean gray level Gfi computed by the mean-gray-level computing unit 82*a*, the variation-signal setting unit 82*b* sets the variation signal ΔSi (i=1 to N) in each line. The variation signal ΔSi is output via the hold-capacitor driver 71 to the hold capacitors 1171 in the corresponding block (i.e., in the i-th line).

Figure 45:
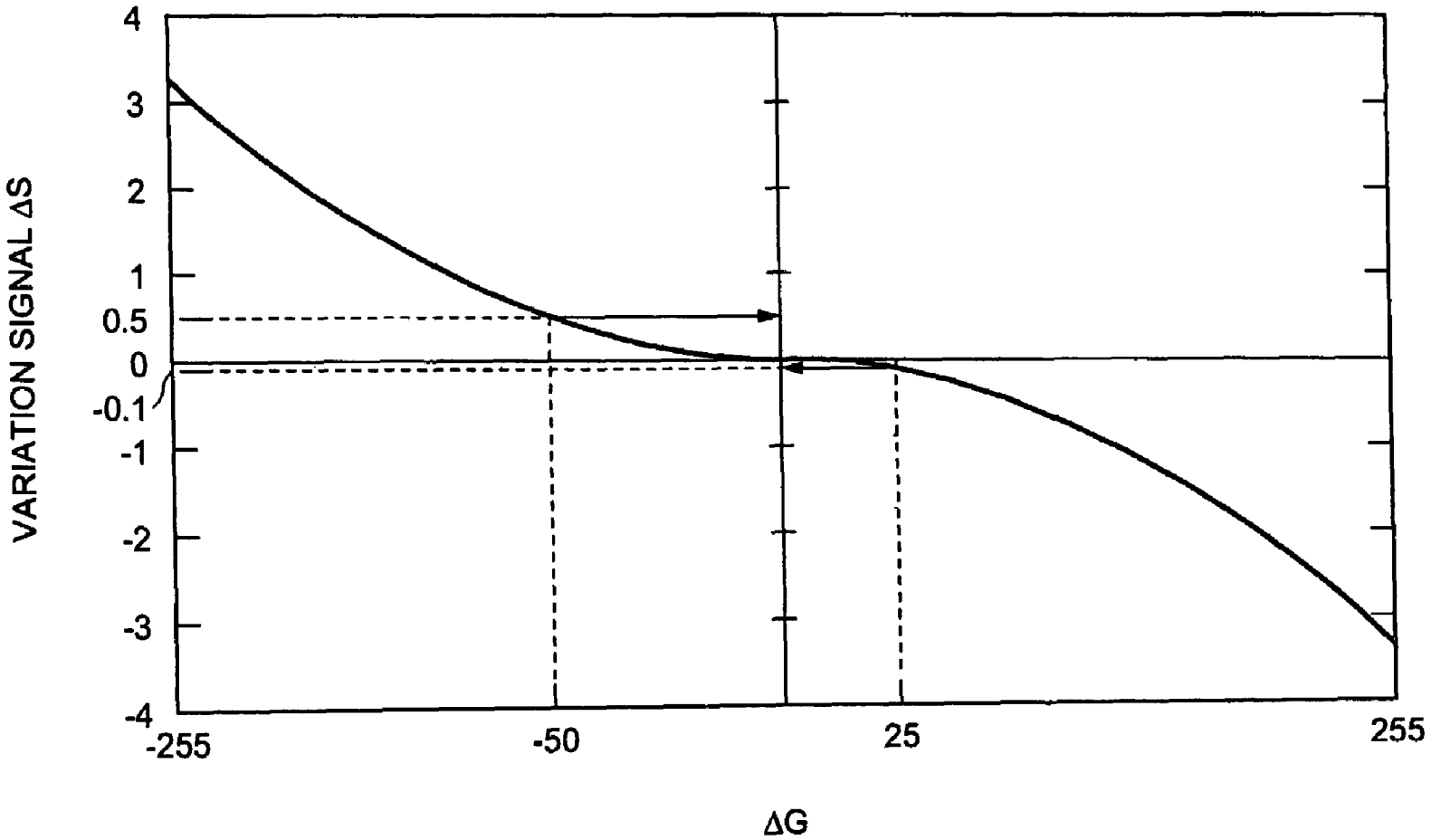
FIG. 45 is a graph describing a drive method according to the ninth exemplary embodiment.

In the setting table 82*d*, the gray level of the variation signal ΔSi is defined so that the gray level of the effective voltage signal generated by modulating the image signal DATAi using the variation signal ΔSi becomes greater than the gray level of the image signal DATA in accordance with an increase in the mean gray level Gfi. For example, in the setting table 82*d*, as shown in FIG. 45, when ΔG is positive (i.e., when the mean gray level Gfi is greater than the reference gray level G0), the polarity of the variation signal ΔSi is set to the polarity opposite to that of the image signal DATAi. When ΔG is negative (i.e., when the mean gray level Gfi is less than the reference gray level G0), the polarity of the variation signal ΔSi is set to the same polarity as that of the image signal DATAi. It is set so that, the larger the gray level difference |ΔG|, the larger the voltage of the variation signal ΔSi (absolute value |ΔS|) becomes.

When the mean gray level Gfi is greater than the reference gray level G0 (i.e., when the brightness of an image in each line is greater than the average brightness of the image), the potential of the pixel electrodes 112 in the corresponding line is changed by |ΔS| to the polarity opposite to that of the input image signal DATAi, thereby displaying an image in that line more brightly. In contrast, when the mean gray level Gfi is less than the reference gray level G0 (i.e., when the brightness of an image in each line is less than the average brightness of the image), the potential of the pixel electrodes 112 is changed by |ΔS| toward the same polarity as that of the image signal DATAi, thereby displaying the image more darkly.

In other words, in the setting table 82*d*, the gray level of the variation signal is set so that, when the gray level difference ΔG is positive, the gray level of the effective signal becomes greater than the gray level of the image signal DATA, and, when the gray level difference ΔG is negative, the gray level of the effective signal becomes less than the gray level of the image signal. As a result, a bright portion (line) of the image is displayed more brightly, whereas a dark portion (line) of the image is displayed more darkly.

Since the ninth exemplary embodiment has the same structure as that of the eighth exemplary embodiment except for the foregoing difference, a description of common portions is omitted.

Figure 46A:
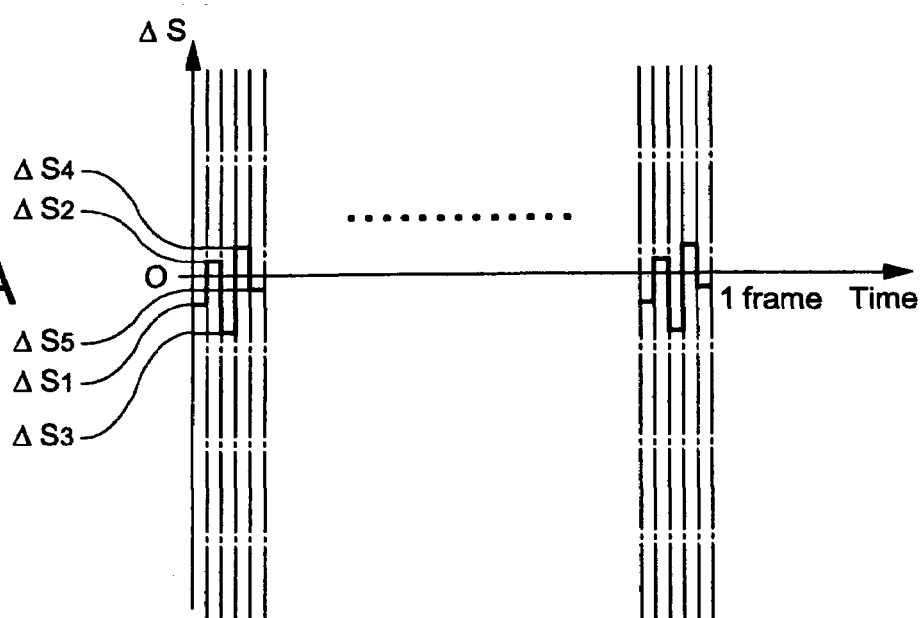
FIGS. 46(A) and 46(B) includes schematics describing the drive method according to the ninth exemplary embodiment.
Figure 46B:
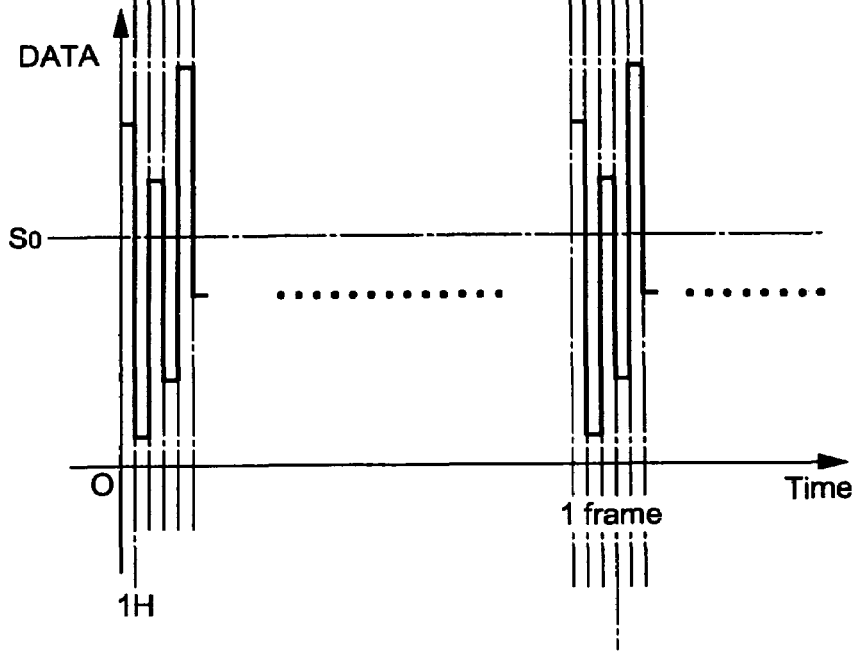
Figure 47:
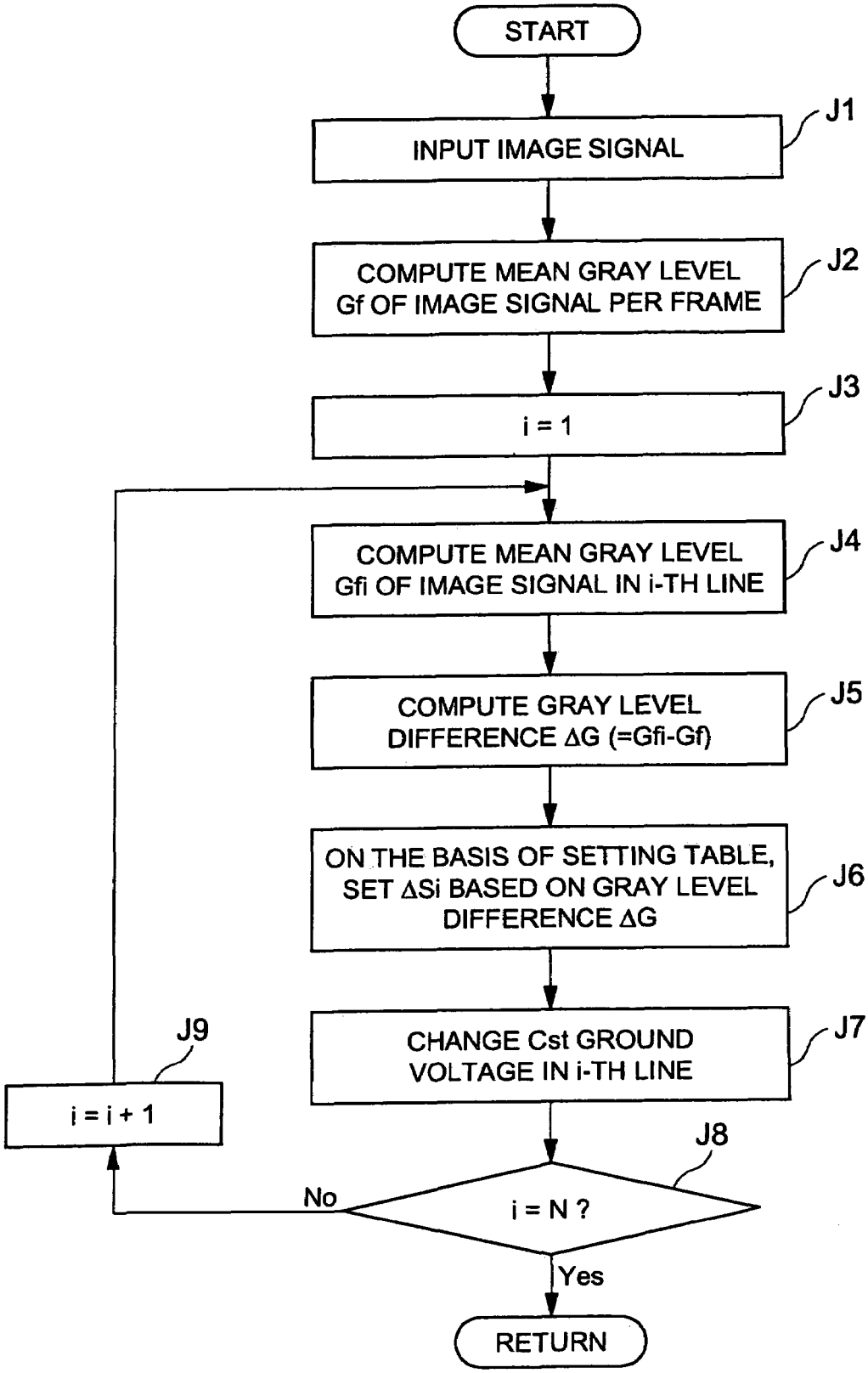
FIG. 47 is a flowchart describing the drive method according to the ninth exemplary embodiment.
Figure 48:
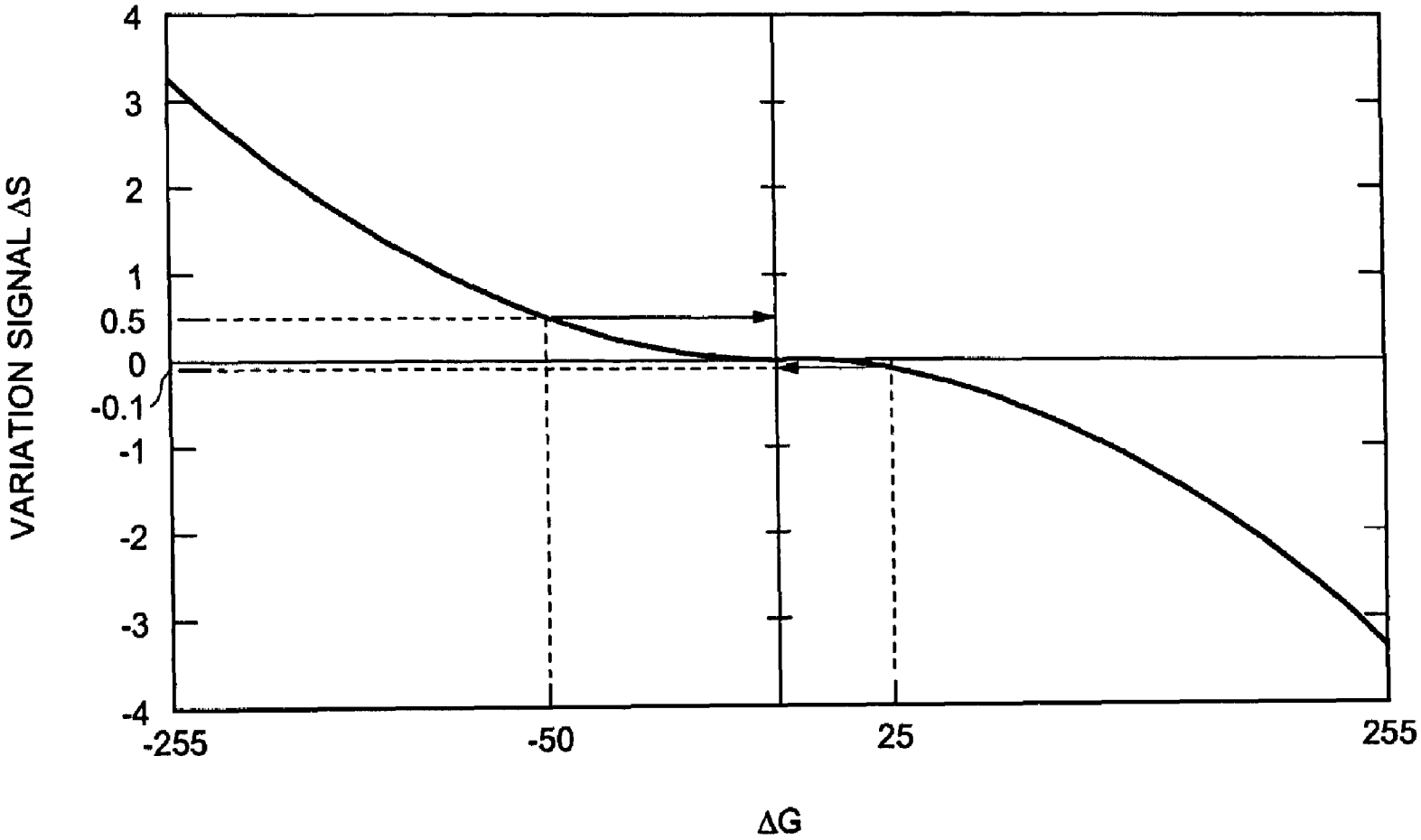
FIG. 48 is a graph describing a drive method according to a tenth exemplary embodiment of the present invention.

Referring to FIGS. 45 to 47, a method of driving the display device will now be described. An example in which the display device is driven by the line inversion method is described below. FIG. 46 shows an example of the waveform of the image signal DATA and an example of the waveform of the opposing electrode signal CDATA. FIG. 46(B) shows the waveform of the mean gray level Gfi of the image signal DATAi (i=1 to N) supplied to the pixel electrodes 112 in each line in one scanning period.

When the image signal DATA is input from the external device in step J1, the image signal DATA is converted by the DAC 5 into an analog signal, and the analog signal is written via the data driver 1 into the pixel electrodes 112 of the liquid crystal panel 13.

When the image signal DATA is also input to the hold-capacitor control circuit 82, the reference-gray-level setting unit 82*c* computes the mean gray level Gf of the image signal DATA per frame and outputs the mean gray level Gf serving as the reference gray level G0 to the variation-signal setting unit 82*b* (step J2).

The mean-gray-level computing unit 82*a* computes the mean gray level Gfi (i=1 to N) of the image signal DATAi (i=1 to N) in each line per frame (step J4). On the basis of the setting table 82*d*, the variation signal ΔSi (i=1 to N) in each line is set on the basis of the gray level difference between the mean gray level Gfi and the reference gray level G0 (steps J5 and J6). The hold-capacitor driver 71 changes the ground voltage of the hold capacitors 1171 in the corresponding line by the variation signal ΔSi (step J7).

The above-described steps, J4 to J7, are sequentially performed on the image signal DATAi in each line to adjust the brightness of an image in each line.

For example, in a case in which the image signal DATA whose mean gray level Gf (G0) is 200-th gray level is input in the first frame, when the mean gray level Gfl of the image signal DATA1 in the first line is 225-th gray level (>reference gray level G0) (see the first line of FIG. 46(B)), the variation signal ΔS1 is set to −0.1 (V) on the basis of the setting table 82*d* (see FIG. 45). The hold-capacitor driver 71 changes the ground voltage of the hold capacitors 1171 in the first line by 0.1 (V) to the polarity opposite to that of the image signal DATA1 (see the first line of FIG. 46(A). As a result, the effective voltage between the electrodes, 112 and 122, in the first line is reduced, thereby brightly displaying an image in the first line.

For example, in a case in which the mean gray level Gf2 of the image signal DATA2 in the second line is 150-th gray level (<reference gray level G0) (see the second line of FIG. 46(B)), the variation signal ΔS2 is set to 0.5 (V) on the basis of the setting table 82*d* (see FIG. 45). The hold-capacitor driver 71 changes the ground voltage of the hold capacitors 1171 in the second line by 0.5 (V) to the same polarity as that of the image signal DATA2 (see the second line of FIG. 46(A)). As a result, the effective voltage between the electrodes, 112 and 122, in the second line is increased, thereby displaying an image in the second line darkly. Since the polarity of the image signal DATA2 in the second line is inverted, a direction in which the holding voltage is changed is opposite to that of the previous line.

When the image signal DATA whose mean gray level Gf (G0) is 150-th gray level is input in the second frame, the brightness of the image in each line is adjusted similarly by setting the variation signal ΔSi on the basis of the reference gray level G0 in the second frame.

The above-described steps, J1 to J9, are repeated to sequentially display frame images whose brightness is adjusted in each line.

According to the display device of the ninth exemplary embodiment, the brightness of an image is adjusted in each line. Therefore, the contrast of a portion of an image can be adjusted, and an image whose portions differ in brightness can be displayed.

Since the adjustment is based on the mean gray level Gf in a frame, an image whose portions differ in brightness can be displayed. In other words, for example, according to the eighth exemplary embodiment, the variation range is determined on the basis of a prepared table. The eighth exemplary embodiment is less advantageous than the ninth exemplary embodiment in increasing the contrast of an image.

Tenth Exemplary Embodiment

Referring to FIGS. 48 to 51 a display device according to a tenth exemplary embodiment of the present invention will now be described. Since this display device has the same structure as that of the ninth exemplary embodiment, FIGS. 38, 39, and 44 are used unchanged, and a description of the structure of the display device is omitted.

The tenth embodiment is a modification of the drive method of the ninth exemplary embodiment. The ground voltage of the hold capacitors 1171 is gradually changed within unit time (e.g., one frame period in the tenth exemplary embodiment).

Specifically, according to the tenth exemplary embodiment, when the image signal DATA is input from the external device to the hold-capacitor control circuit 82 in step P1, the reference-gray-level setting unit (second detector) 82*c* computes the mean gray level Gf of the image signal DATA per frame and outputs the mean gray level Gf serving as the reference gray level (second gray level) G0 to the variation-signal setting unit 82*b* (step P2).

The corresponding image signal DATAi is written to the pixel electrodes 112 in a predetermined line, and the ground voltage of the hold capacitors 1171 in the corresponding line is reset (step P4).

The mean-gray-level computing unit (first detector) 82*a* computes the mean gray level Gfi (i=1 to N) of the image signal DATAi (i=1 to N) in each line per frame (step P5). On the basis of the setting table 82*d*, the variation signal ΔSi (i=1 to N) in each line is set on the basis of the gray level difference ΔG between the mean gray level Gfi and the reference gray level G0 (steps P6 and P7).

In a step-signal supplying routine (step P8), this variation signal ΔSi is divided into a plurality of (e.g., N) step signals (step B81). The step signals are sequentially supplied via the hold-capacitor driver 71 to the hold capacitors 1171 in the corresponding line at a predetermined time interval (e.g., in each H) (steps P82 to P85).

Figure 49:
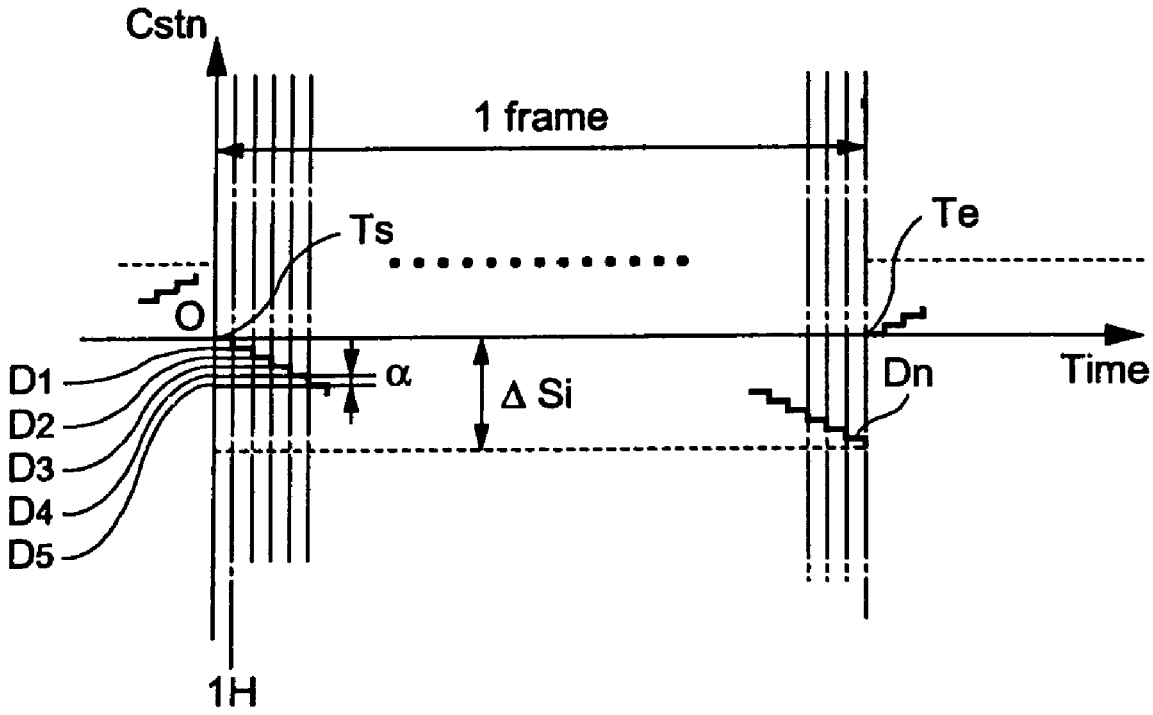
FIG. 49 includes schematics describing the drive method according to the tenth exemplary embodiment.
Figure 50:
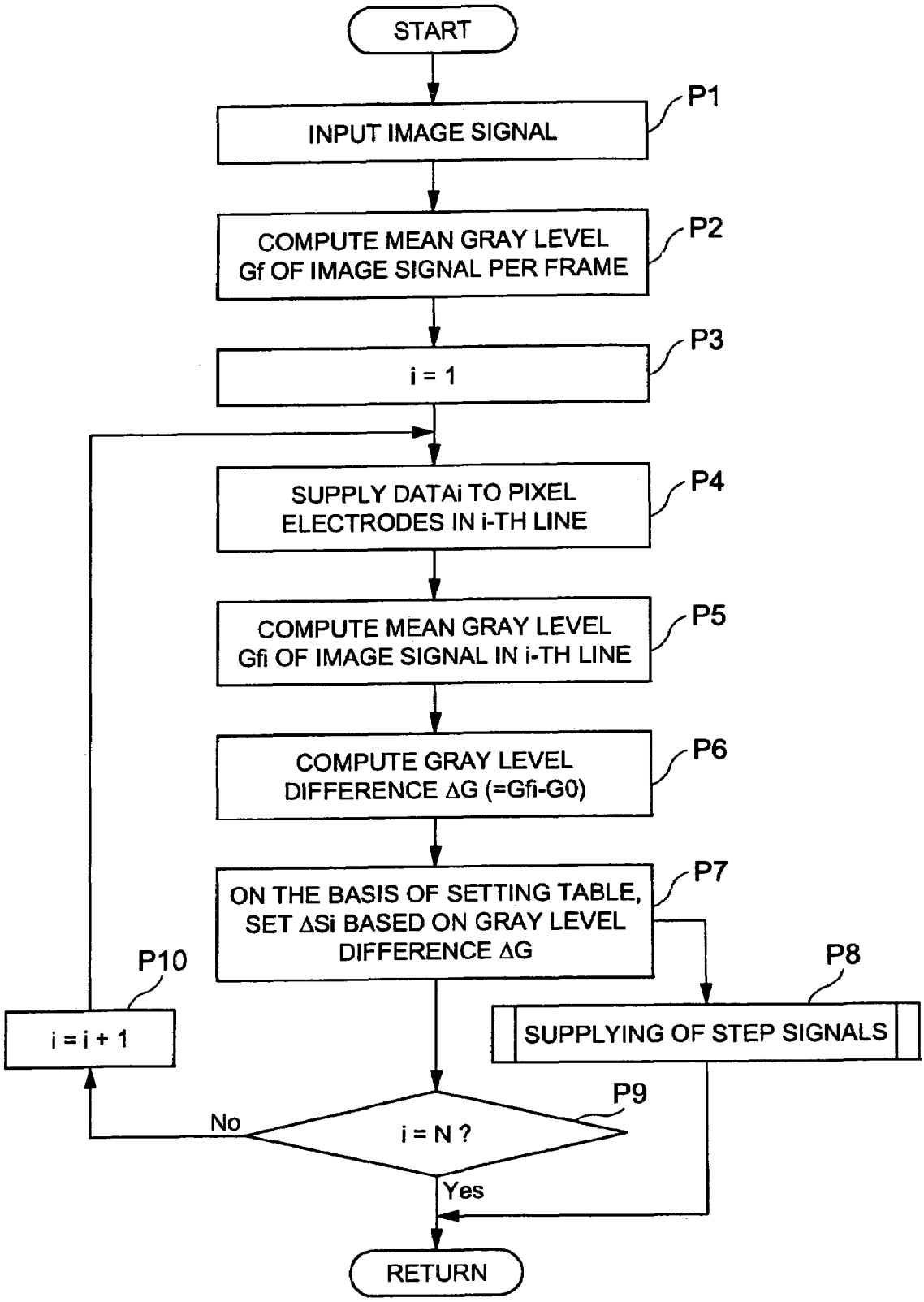
FIG. 50 is a flowchart describing the drive method according to the tenth exemplary embodiment.
Figure 51:
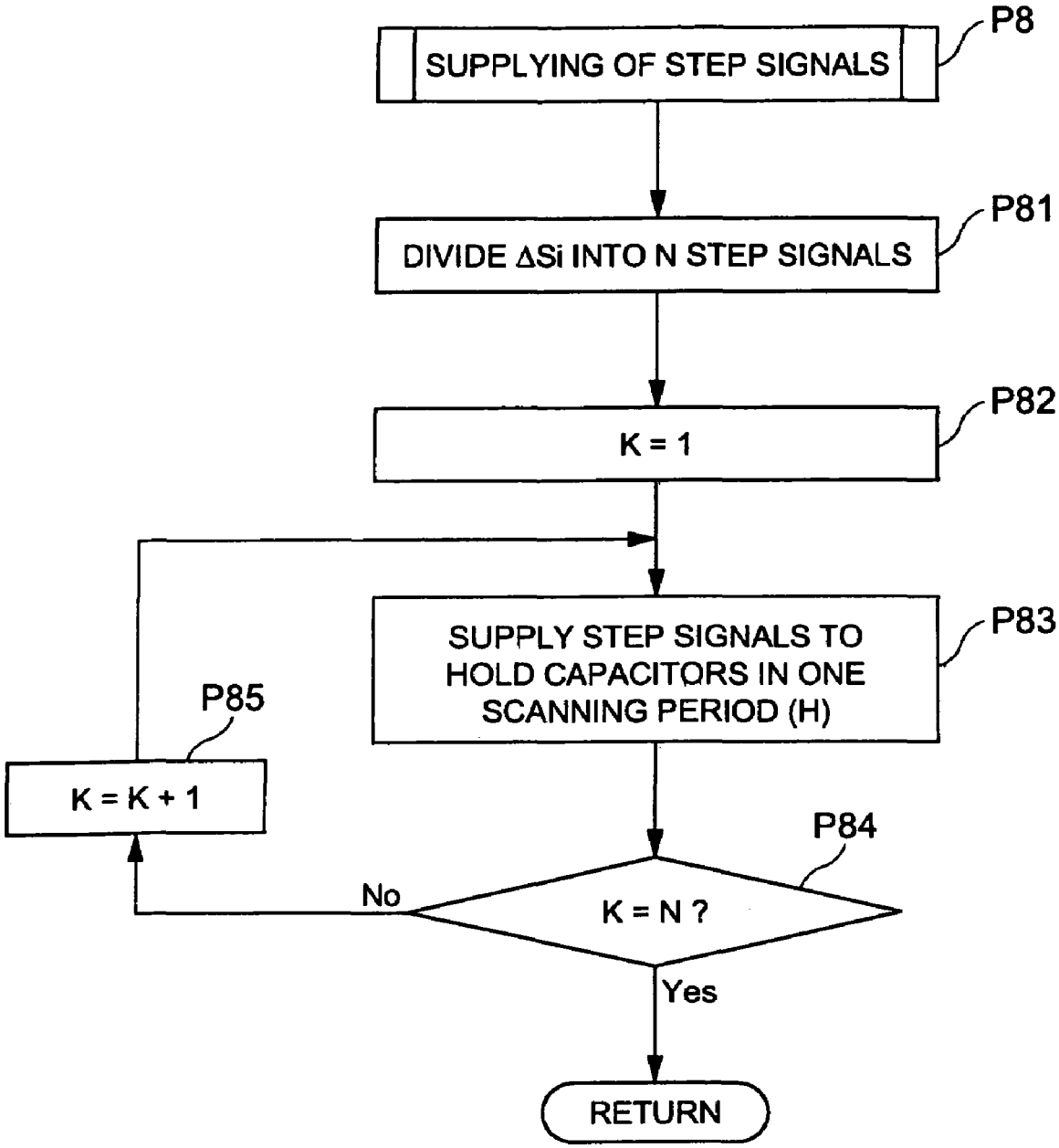
FIG. 51 is a flowchart describing the drive method according to the tenth exemplary embodiment.

FIG. 49 shows an example of variations in the variation signal ΔSi output to the hold capacitors 1171 in the i-th line over time. For example, in a case in which the image signal DATA whose mean gray level Gf (G0) is 200-th gray level is input in the first frame, when the mean gray level Gfi of the image signal DATAi in the i-th line is 225-th gray level (>reference gray level G0), the variation signal ΔSi is set to −0.1 (V) on the basis of the setting table 82*d* (see FIG. 48). This variation signal ΔSi is divided by the variation-signal setting unit 82*b* into N step signals α (signal value=ΔSi/N), and the N step signals α are sequentially supplied to the hold capacitors 1171 in the i-th line at a predetermined time interval within one frame period.

In FIG. 49, the supply start time Ts of the step signals α is the time at which the image signal DATAi is supplied to the pixel electrodes 112 in the i-th line, the supply end time Te of the step signals α is the time immediately before the image signal in the subsequent frame is supplied to the pixel electrodes 112 in the i-th line, and the supply period of the step signals (Te-Ts) is one frame. However, the supply start time Ts and the supply end time Te may be any time within a period between the writing of the image signal to the pixel electrodes 112 in the i-th line and the writing of the image signal in the subsequent frame to the pixel electrodes 112 in the i-th line, and the supply interval of the step signals α can be set to an arbitrary interval. Also, the number of segments N of the variation signal ΔSi can be set to an arbitrary number.

Accordingly, the effective voltage between the electrodes 112 and 122 in the i-th line is reduced by 0.1 (V) within one frame period, and the brightness of an image in the i-th line is gradually increased within one frame period.

When the image signal DATA(i+1) is written into the pixel electrodes 112 in the (i+1)-th line while the holding voltage in the i-th line is changed stepwise, the holding voltage in the (i+1) line is reset. In steps P5 to P8, the holding voltage in the (i+1)-th line is changed stepwise.

The above-described steps, P4 to P8, are sequentially performed on the image signal DATAi in each line to adjust the brightness of the image in each line.

The above-described steps, P1 to P8, are repeated to sequentially display frame images whose brightness is adjusted in each line.

According to the display device of the tenth exemplary embodiment, the brightness of an image is adjusted in each line. Therefore, the contrast of a portion of an image can be adjusted, and an image whose portions differ in brightness can be displayed.

According to the display device, the brightness of an image is adjusted stepwise. Compared with a case in which the variation signals are supplied at the same time, discontinuity of images when the variation signals are supplied is smoothed, and the images are displayed more naturally.

First Modification

Figure 52:
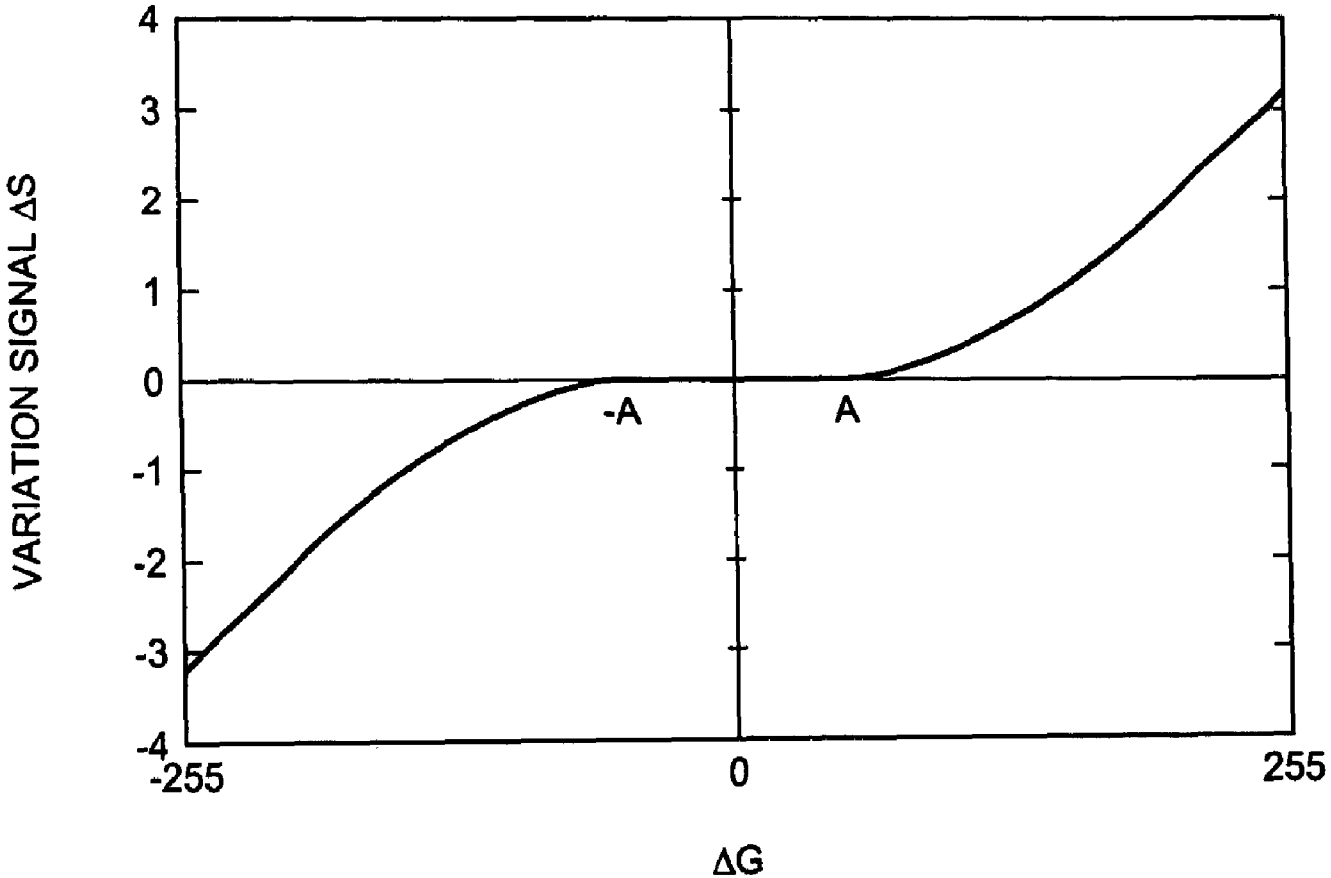
FIG. 52 is a graph showing a first modification of a setting table of the present invention.

Referring to FIG. 52, a first modification of the present invention will now be described.

The first modification is a modification of the setting table of the first to fifth embodiments. Since the first modification is the same as these exemplary embodiments except for the following difference, a description of common portions is omitted.

A setting table of the first modification defines the relationship of the gray level difference ΔG between the mean gray level (first gray level) of the image signal DATA per unit time (e.g., one frame period) and the reference gray level (second gray level) G0 with the variation signal ΔS. When the gray level difference ΔG is within a predetermined range, the signal value |ΔS| of the variation signal ΔS is set to zero.

By providing the variation signal ΔS with a dead zone, thereby preventing or suppressing variations near the mean gray level in an image, the image can be displayed naturally.

For example, the screen has three image areas with different brightnesses. When the gray levels of these three image areas are (1) the maximum gray level 255, (2) the minimum gray level 0, and (3) a gray level similar but not equal to the mean gray level, respectively, if a method not using a dead zone is employed (whereas the dead zone is provided in the first modification), all the image areas (1) to (3) are compensated for on the basis of the original image signal. In contrast, according to the first modification in which a dead zone is provided near the mean gray level, an uncompensated area is increased, and only gray levels separated from the mean gray level by a certain distance are compensated for. As a result, both ends of the gray scale are made different on the basis of the reference brightness.

In another example, two circles with different brightnesses are displayed on one dark screen. The brightness of one circle is near the maximum gray level, whereas the brightness of the other circle is slightly higher than the mean gray level. In such a case, since the two circles are brighter than the mean gray level, if a method not using a dead zone is employed, the two circles are adjusted to be brighter. In contrast, when the circle whose brightness is near the mean gray level is not compensated for, only the circle whose brightness is near the maximum gray level is made brighter. Contrast is thus increased, compared with a case in which the two circles are compensated for to be brighter. Since the reference portion near the mean gray level remains unchanged, there is a portion in which the original image signal is used, thereby displaying an image naturally (in which the brightness of the image continuously changes over frames, and flickering is reduced).

By inverting the polarity of the variation signal ΔS, this setting table is applicable to the sixth to tenth exemplary embodiments, and similar advantages can be achieved.

Second Modification

Referring to FIG. 53, a second modification of the present invention will now be described.

The second modification is a modification of the setting table of the first to fifth exemplary embodiments. Since the second modification is the same as these exemplary embodiments except for the following difference, a description of common portions is omitted.

A setting table of the second modification defines the relationship of the gray level difference ΔG between the mean gray level (first gray level) of the image signal DATA per unit time (e.g., one frame period) and the reference gray level (second gray level) G0 with the variation signal ΔS. For example, as shown in FIG. 53(A), the polarity of the variation signal ΔS is always set to negative. It is set so that the variation signal ΔS is reduced in accordance with an increase in the gray level difference ΔG between the mean gray level Gf and the reference gray level G0.

When such a setting table is applied to the above-described normally white liquid crystal panels 10 and 11, the brightness of a dark image is almost unchanged, whereas the brightness of a bright image is reduced. The brighter the image, the more the brightness is reduced. As a result, the overall brightness of an image is reduced.

Figure 53B:
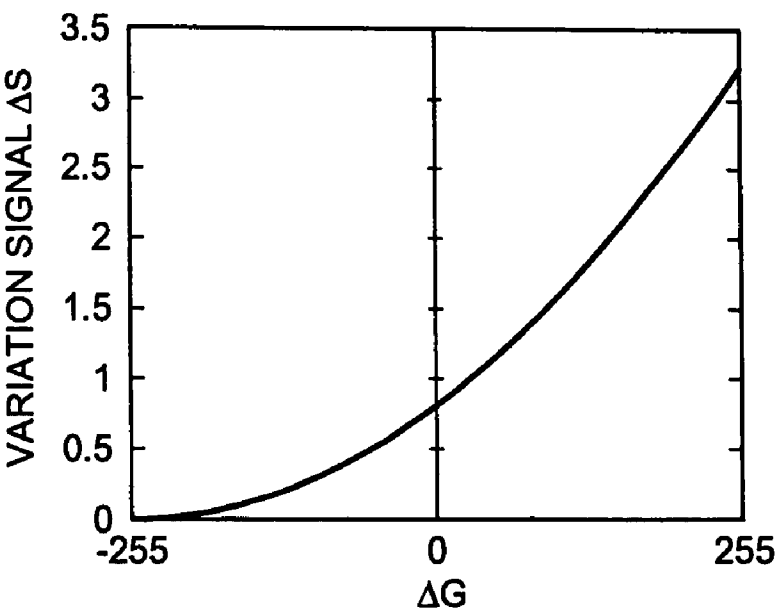
FIGS. 53(A) and 53(B) includes graphs showing a second modification of the setting table of the present invention.
Figure 53A:
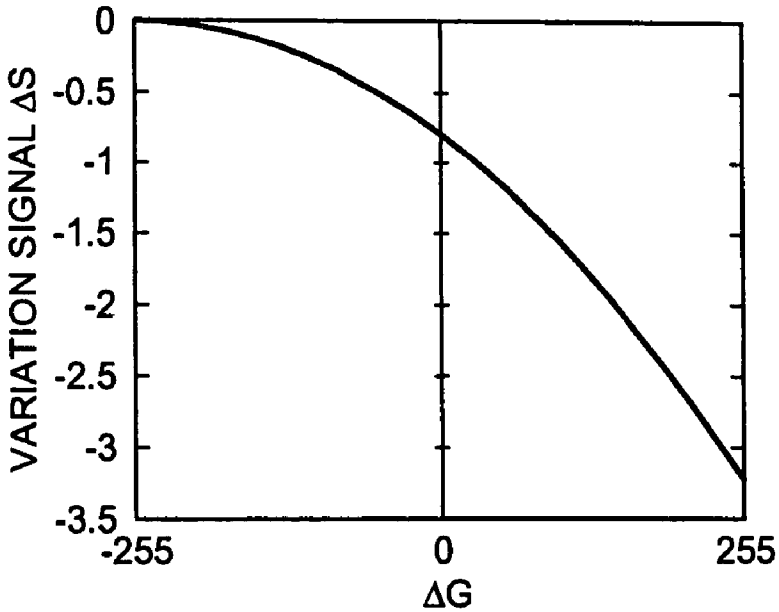

As shown in FIG. 53(B), the polarity of the variation signal ΔS may always be set to positive, and it may be set so that the variation signal ΔS is increased in accordance with an increase in the gray level difference ΔG.

In this case, the brightness of a bright image is increased whereas the brightness of a dark image is almost unchanged. As a result, the overall brightness of an image is increased.

This setting table is applicable to the display devices of the sixth to tenth exemplary embodiments. In this case, the overall brightness of an image is increased by using the setting table of FIG. 53(A), while the overall brightness of an image is reduced by using the setting table of FIG. 53(B).

Application to Projection Display Device

Figure 54:
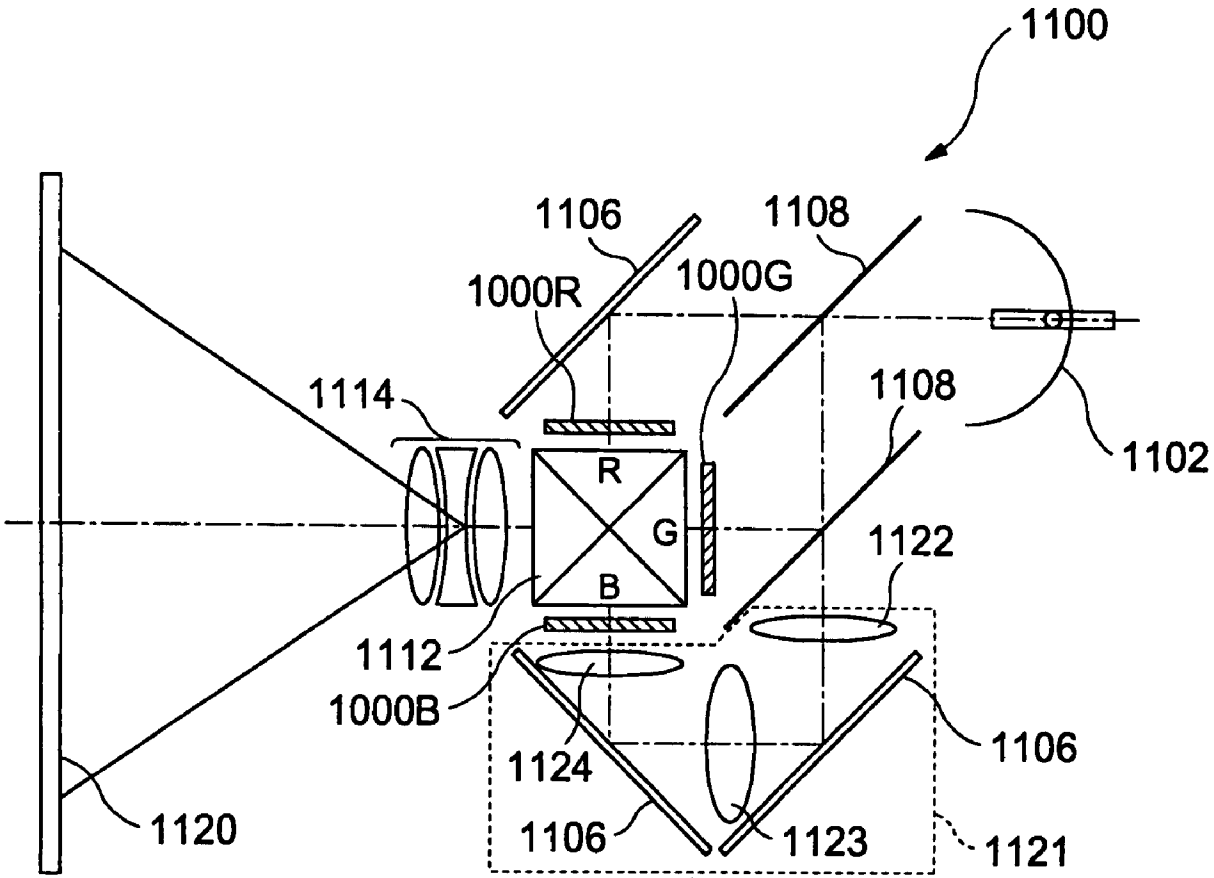
FIG. 54 is an illustration of an example of a projection display device of the present invention.

Referring to FIG. 54, a projection display device serving as an example of the foregoing display device will now be described.

A projection display device 1100 shown in FIG. 54 is a projector including three liquid crystal modules including active matrix liquid crystal devices (light modulators) 1000 serving as RGB light valves 1000R, 1000G, and 1000B. In this liquid crystal projector 1100, light emitted from a white-light-source lamp unit 1102, such as a metal halide lamp, is split by three mirrors 1106 and two dichroic mirrors 1108 into light components R, G, and B corresponding to the three primary colors R, G, and B (light splitting means), and the light components R, G, and B are guided to the corresponding light valves 1000R, 1000G, and 1000B (liquid crystal devices 1000/liquid crystal light valves). Since the light component B has a long light path, the light component B is guided via a relay lens system 1121 including an incident lens 1122, a relay lens 1123, and an outgoing lens 1124 in order to minimize optical loss.

The light components R, G, and B corresponding to the three primary colors, which are modulated by the corresponding light valves 1000R, 1000G, and 1000B, are introduced from three directions into a dichroic prism 1112 (photosynthesis device) to be re-combined, which in turn is enlarged and projected as a color image onto a screen 1120 via a projection lens (projection optical system) 1114.

Referring to FIG. 54, the liquid crystal light valves, 1000R to 1000B, are driven by the above-described drive circuit, and the amount of light modulated by each of the light valves, 1000R to 1000B, is adjusted by an image signal.

According to the present projection display device, a high-contrast image can be displayed.

The present invention is not limited to the foregoing exemplary embodiments, and various modifications may be made without deviating from the scope of the present invention.

For example, although one frame period is described as unit time serving as a reference for computing the mean gray level in the foregoing exemplary embodiments, the present invention is not limited to this. A desired period, such as plural frame periods, may be set.

Although the opposing electrode 1221 is provided in association with each line of the pixel electrodes 112 arranged in a matrix in the third to fifth exemplary embodiments, the present invention is not limited to this structure. A single stripe-shaped opposing electrode may be provided in association with plural lines of the pixel electrodes 112. The opposing electrodes 1221 need not be in the form of stripes. The opposing electrodes 1221 may be a plurality of independently-driven block electrodes. In particular, when opposing electrodes are arranged in a matrix, each opposing electrode being associated with one pixel electrode 112, the brightness of each pixel area is optimized.

A similar mechanism applies to the eighth to tenth exemplary embodiments. The simultaneously-driven hold capacitors 1171 may be grouped into arbitrary blocks. The individual hold capacitors 1171 may be set to hold individual voltages. As a result, the brightness of each display area (block area) associated with each block may be adjusted.

The dependence of the variation signal ΔS on the gray level difference ΔG, that is, the curve shape in the setting table, may be arbitrarily set. The curve shape may be symmetrical or asymmetrical relative to the reference gray level G0.

In the second and seventh exemplary embodiments, the supply start time of the step signals may differ depending on the level of the variation signal |ΔS|. For example, when the amount of variation |ΔS| is large, the supply may start early, thereby increasing the number of segments of the variation signal ΔS when the supply interval of the step signals is constant. Accordingly, images become more continuous.

Although the mean gray level Gf of an image signal per unit time serves as the first gray level characterizing the brightness of an image in the foregoing exemplary embodiments, the present invention is not limited to this. The first gray level may be, for example, the maximum gray level of an image signal per unit time or the mode of gray levels.

Even when the mean gray level serves as the first gray level as described above, an image signal from which the mean is computed may be limited to those in a specific gray level range. For example, the mean may be computed from each signal excluding those with a gray level in a specific range (e.g., 10%) from the maximum gray level of an image signal. When such a detection method is adopted, in particular, the appropriate brightness for an image displaying subtitles may be detected. In other words, to enhance visibility, the gray level of a subtitle portion is set to a gray level near the maximum displayable gray level. By excluding a peak signal near the maximum gray level from computation, the effect of a subtitle portion that is not very meaningful to image information may be eliminated. Needless to say, the mean may be computed from each signal excluding those with a gray level within a predetermined range from the minimum gray level (0-th gray level).

A similar mechanism applies to computation of the reference gray level in the fourth, fifth, ninth, and tenth exemplary embodiments. The reference gray level G0 may be computed as the mean gray level of an image signal that belongs to a specific gray level range. The reference gray level G0 may be computed not only as the foregoing mean gray level, but also as the first gray level, such as the maximum gray level of the image signal DATA or the mode of gray levels, characterizing the brightness of an image.

A reference for detecting the brightness of an image of the image signal DATAi in each line (i.e., each block area) per unit time (first gray level) may differ from a reference for detecting the brightness of an image of the image signal DATA in all lines (i.e., all block areas) (second gray level). For example, the first gray level may be the mean gray level, whereas the second gray level may be the mode of gray levels.

Although the median of the maximum displayable gray levels (e.g., 255 gray levels) serves as the reference gray level G0 in the first to third and sixth to eighth exemplary embodiments, the present invention is not limited to this. A user may manually set the reference gray level G0 to an arbitrary level.

Although the liquid crystal panel is described as a normally white display in the foregoing exemplary embodiments, the present invention is not limited to this. The liquid crystal panel may be a normally black display. In this case, the polarity of the variation signal ΔS in the setting table described in the foregoing exemplary embodiments (i.e., the direction in which the potential of the opposing electrode is changed) is opposite to that in the foregoing exemplary embodiments.

The present invention is applicable not only to the foregoing projection display device, but also, for example, to a direct-viewing display device.

What is claimed is:

1. A drive circuit for driving a display device including an active matrix substrate provided with a plurality of pixel electrodes arranged in a matrix, an opposing substrate provided with a transparent opposing electrode, and a liquid crystal layer held between the active matrix substrate and the opposing substrate, the drive circuit comprising:

a first signal supplying unit that supplies an image signal to the pixel electrodes;

a first detector that detects, on the basis of the image signal per unit time, a first gray level characterizing the brightness of an image;

a variation-signal setting unit that sets a variation signal on the basis of the first gray level; and a second signal supplying unit that supplies the variation signal to the opposing electrode, the liquid crystal layer being driven by an effective voltage signal generated by modulating the image signal using the variation signal, and the variation-signal setting unit setting the variation signal so that the gray level of the effective voltage signal becomes greater than the gray level of the image signal in accordance with an increase in the first gray level.

2. The drive circuit for driving a display device according to claim 1, further comprising:

a second detector that detects a second gray level, the variation-signal setting unit computing the difference between the first gray level and the second gray level and setting the variation signal so that, when the first gray level is greater than the second gray level, the gray level of the effective voltage signal becomes greater than the gray level of the image signal, and, when the first gray level is less than the second gray level, the gray level of the effective voltage signal becomes less than the gray level of the image signal.

3. The drive circuit for driving a display device according to claim 2, the opposing electrode including a plurality of block electrodes, the second detector detecting, as the second gray level, a gray level that is detected on the basis of the image signal per unit time and that characterizes the brightness of the image on the entirety of a display area, the first detector detecting, on the basis of the image signal supplied to the pixel electrodes in an area opposing each of the block electrodes per unit time, the first gray level in that area, the variation-signal setting unit setting the variation signal for each of the block electrodes on the basis of the gray level difference between the first gray level and the second gray level, and the second signal supplying unit supplying the variation signal set for each of the block electrodes to the corresponding block electrode.

4. A drive method to drive a display device including an active matrix substrate provided with a plurality of pixel electrodes arranged in a matrix, an opposing substrate provided with a transparent opposing electrode, and a liquid crystal layer held between the active matrix substrate and the opposing substrate, the drive method comprising:

detecting a first gray level characterizing the brightness of an image on the basis of an image signal per unit time;

setting, on the basis of a setting table defining the relationship between the first gray level and a variation signal, the variation signal based on the first gray level; and supplying the image signal and the variation signal to the pixel electrodes and the opposing electrode, respectively, thereby applying an effective voltage signal to the liquid crystal layer, the effective voltage signal being generated by modulating the image signal using the variation signal, the setting table defining the variation signal so that the gray level of the effective voltage signal becomes greater than the gray level of the image signal in accordance with an increase in the first gray level.

5. A drive method to drive a display device including an active matrix substrate provided with a plurality of pixel electrodes arranged in a matrix, an opposing substrate provided with a plurality of transparent individually-driven block electrodes, and a liquid crystal layer held between the active matrix substrate and the opposing substrate, the drive method comprising:

detecting a second gray level characterizing the brightness of an image on the entirety of a display area on the basis of an image signal per unit time;

detecting a first gray level characterizing the brightness of the image on the basis of the image signal supplied to the pixel electrodes in an area opposing each of the block electrodes per unit time;

computing the gray level difference between the first gray level and the second gray level;

setting, on the basis of a setting table defining the relationship between the gray level difference and a variation signal, the variation signal for each of the block electrodes based on the gray level difference; and supplying the image signal and the variation signal to the pixel electrodes and the opposing electrode, respectively, thereby applying an effective voltage signal to the liquid crystal layer, the effective voltage signal being generated by modulating the image signal using the variation signal, the setting table defining the variation signal so that the gray level of the effective voltage signal becomes greater than the gray level of the image signal in accordance with an increase in the gray level difference.

6. A display device, comprising:

an active matrix substrate provided with a plurality of pixel electrodes arranged in a matrix;

an opposing substrate provided with a transparent opposing electrode;

a liquid crystal layer held between the active matrix substrate and the opposing substrate; and the drive circuit as set forth in claim 1.

7. A display device, comprising:

an active matrix substrate provided with a plurality of pixel electrodes arranged in a matrix;

an opposing substrate provided with a transparent opposing electrode including a plurality of block electrodes;

a liquid crystal layer held between the active matrix substrate and the opposing substrate; and the drive circuit as set forth in claim 3.

8. A projection display device, comprising:

a light source;

a light modulator including an active matrix substrate provided with a plurality of pixel electrodes arranged in a matrix, an opposing substrate provided with a transparent opposing electrode, and a liquid crystal layer held between the active matrix substrate and the opposing substrate;

the drive circuit as set forth in claim 1 to drive the light modulator; and a projection optical system that projects light emitted from the light modulator.

9. A projection display device, comprising:

a light source;

a light modulator including an active matrix substrate provided with a plurality of pixel electrodes arranged in a matrix, an opposing substrate provided with a transparent opposing electrode including a plurality of block electrodes, and a liquid crystal layer held between the active matrix substrate and the opposing substrate;

the drive circuit as set forth in claim 3 to drive the light modulator; and a projection optical system that projects light emitted from the light modulator.

10. The drive circuit for driving a display device according to claim 1, the variation signal setting unit including a setting table that defines a relationship between the first gray level and the variation signal.

11. The drive method to driving a display device according to claim 4, the variation signal setting unit including a setting table that defines a relationship between the first gray level and the variation signal.

12. The display device according to claim 6, the variation signal setting unit including a setting table that defines a relationship between the first gray level and the variation signal.

13. The projection display device according to claim 8, the variation signal setting unit including a setting table that defines a relationship between the first gray level and the variation signal.

* * * * *